US009109468B2

(12) United States Patent
Meldolesi et al.

(10) Patent No.: US 9,109,468 B2
(45) Date of Patent: Aug. 18, 2015

(54) LOST-MOTION VARIABLE VALVE ACTUATION SYSTEM

(71) Applicant: Scuderi Group, LLC, West Springfield, MA (US)

(72) Inventors: Riccardo Meldolesi, East Sussex (GB); John A. Schwoerer, Storrs, CT (US); Ian P. Gilbert, West Sussex (GB); Clive Lacy, West Sussex (GB); Glenn Wendel, Pipe Creek, TX (US)

(73) Assignee: Scuderi Group, LLC, West Springfield, MA (US)

( * ) Notice: Subject to any disclaimer, the term of this patent is extended or adjusted under 35 U.S.C. 154(b) by 243 days.

(21) Appl. No.: 13/714,984

(22) Filed: Dec. 14, 2012

(65) Prior Publication Data

US 2013/0152889 A1 Jun. 20, 2013

Related U.S. Application Data

(60) Provisional application No. 61/583,913, filed on Jan. 6, 2012, provisional application No. 61/594,186, filed on Feb. 2, 2012, provisional application No. 61/644,846, filed on May 9, 2012.

(51) Int. Cl.
*F01L 1/34* (2006.01)
*F01L 1/02* (2006.01)
(Continued)

(52) U.S. Cl.
CPC ..... *F01L 1/02* (2013.01); *F01L 13/0063* (2013.01); *F02B 33/22* (2013.01); *F02B 33/443* (2013.01);
(Continued)

(58) Field of Classification Search
CPC ..... F01L 2001/256; F01L 1/255; F01L 1/25; F01L 1/245; F01L 2001/2444; F01L 2001/2438; F01L 2001/2433; F01L 1/2422; F01L 1/2416; F01L 1/2411; F01L 1/24; F01L 1/2405; F01L 2001/34446; F01L 2013/0089; F01L 13/0031; F01L 13/0021; F01L 13/0005; F01L 13/065; F01L 13/06; F01L 13/00; F01L 1/18; F01L 1/12; F01L 13/0063; F01L 1/20; F01L 2013/0068; F01L 2013/0073; F01L 1/181
USPC ..... 123/90.16, 90.1, 90.12, 320, 321
See application file for complete search history.

(56) References Cited

U.S. PATENT DOCUMENTS 1,531,909 A 3/1925 Engemann
1,936,653 A 11/1933 Almen
(Continued)

FOREIGN PATENT DOCUMENTS

DE 101 15 967 A1 10/2002
GB 2 250 801 A 6/1992
(Continued)

OTHER PUBLICATIONS

Phillips, et al. (Southwest Research Institute), Scuderi Split Cycle Research Engine: Overview, Architecture and Operation, SAE paper 2011-01-0403 (Jan. 18, 2011) (21 pages).
(Continued)

*Primary Examiner* — Thomas Denion
*Assistant Examiner* — Daniel Bernstein
(74) *Attorney, Agent, or Firm* — Nutter McClennen & Fish LLP; John J. Penny, Jr.; Michael P. Visconti, III

(57) ABSTRACT

Valve actuation systems are disclosed herein that allow valve opening timing to be varied using a cam phaser and that allow valve closing timing to be varied using a lost-motion system. In one embodiment, an actuation system is provided that has a locked configuration in which a bearing element is held in place between a cam and a rocker to transmit cam motion to an engine valve. The actuation system also has an unlocked configuration in which the bearing element is permitted to be at least partially ejected from between the cam and rocker, such that cam motion is not transmitted to the engine valve. The actuation system is switched to the unlocked configuration by draining fluid therefrom through a main valve which is piloted by a trigger valve. The actuation system also includes integrated autolash and seating control functionality.

41 Claims, 36 Drawing Sheets

(51) Int. Cl.

| | |
|---|---|
| ***F02B 33/22*** | (2006.01) |
| ***F01L 13/00*** | (2006.01) |
| *F01L 1/24* | (2006.01) |
| *F02B 33/44* | (2006.01) |
| *F02B 41/06* | (2006.01) |
| *F01L 3/00* | (2006.01) |

(52) U.S. Cl.

CPC ..... *F01L 1/2416* (2013.01); *F01L 2003/258* (2013.01); *F02B 33/44* (2013.01); *F02B 41/06* (2013.01)

(56) References Cited

U.S. PATENT DOCUMENTS

| | | | | |
|---|---|---|---|---|
| 2,109,809 | A | 3/1938 | Van Ranst | |
| 2,218,575 | A | 10/1940 | Griswold | |
| 2,394,354 | A | 2/1946 | Barr | |
| 2,772,667 | A | 12/1956 | Nallinger | |
| 3,209,737 | A | 10/1965 | Isao | |
| 3,774,581 | A | 11/1973 | Lundy | |
| 3,786,792 | A | 1/1974 | Pelizzoni et al. | |
| 3,808,818 | A | 5/1974 | Cataldo | |
| 3,880,126 | A | 4/1975 | Thurston et al. | |
| 3,908,701 | A | 9/1975 | Dawawala | |
| 3,935,765 | A | 2/1976 | Peltier et al. | |
| 3,938,483 | A | 2/1976 | Firey | |
| 3,949,964 | A | 4/1976 | Freeman | |
| 4,133,172 | A | 1/1979 | Cataldo | |
| 4,224,798 | A | 9/1980 | Brinkerhoff | |
| 4,418,657 | A | 12/1983 | Wishart | |
| 4,606,314 | A | 8/1986 | Yamazaki | |
| 4,825,717 | A | 5/1989 | Mills | |
| 4,860,716 | A | 8/1989 | Deutschmann | |
| 4,934,652 | A | 6/1990 | Golden | |
| 5,018,487 | A | 5/1991 | Shinkai | |
| 5,080,054 | A | 1/1992 | Nakamura | |
| 5,101,776 | A | 4/1992 | Ma | |
| 5,113,813 | A | 5/1992 | Rosa | |
| 5,193,495 | A | 3/1993 | Wood, III | |
| 5,213,072 | A | 5/1993 | Dohring | |
| 5,402,756 | A | 4/1995 | Bohme et al. | |
| 5,445,119 | A | 8/1995 | Regueiro | |
| 5,555,861 | A | 9/1996 | Mayr et al. | |
| 5,664,531 | A | 9/1997 | Kim | |
| 5,690,066 | A | 11/1997 | Hampton et al. | |
| 5,713,316 | A | 2/1998 | Sturman | |
| 5,964,087 | A | 10/1999 | Tort-Oropeza | |
| 5,975,036 | A | 11/1999 | Hayashi et al. | |
| 5,988,124 | A | 11/1999 | Duesmann | |
| 6,085,705 | A | 7/2000 | Vorih | |
| 6,152,714 | A | 11/2000 | Mitsuya et al. | |
| 6,192,841 | B1 | 2/2001 | Vorih et al. | |
| 6,230,472 | B1 | 5/2001 | Stahlecker | |
| 6,230,742 | B1 | 5/2001 | Bircann | |
| 6,257,183 | B1 | 7/2001 | Vorih et al. | |
| 6,267,098 | B1 | 7/2001 | Vanderpoel | |
| 6,273,057 | B1 | 8/2001 | Schwoerer et al. | |
| 6,302,370 | B1 | 10/2001 | Schwoerer et al. | |
| 6,318,325 | B1 * | 11/2001 | Lechner | 123/90.55 |
| 6,332,917 | B1 | 12/2001 | Schollkopf | |
| 6,397,579 | B1 | 6/2002 | Negre | |
| 6,412,457 | B1 | 7/2002 | Vorih et al. | |
| 6,474,277 | B1 | 11/2002 | Vanderpoel et al. | |
| 6,510,824 | B2 | 1/2003 | Vorih et al. | |
| 6,543,225 | B2 | 4/2003 | Scuderi | |
| 6,550,433 | B2 | 4/2003 | Vorih et al. | |
| 6,584,885 | B2 | 7/2003 | Lou | |
| 6,609,371 | B2 | 8/2003 | Scuderi | |
| 6,619,873 | B2 | 9/2003 | Parker | |
| 6,647,954 | B2 | 11/2003 | Yang et al. | |
| 6,655,327 | B1 | 12/2003 | Hedman | |
| 6,694,933 | B1 | 2/2004 | Lester | |
| 6,789,514 | B2 | 9/2004 | Suh et al. | |
| 6,874,453 | B2 | 4/2005 | Coney et al. | |
| 6,883,775 | B2 | 4/2005 | Coney et al. | |
| 6,886,511 | B1 | 5/2005 | Tong et al. | |
| 6,952,923 | B2 | 10/2005 | Branyon et al. | |
| 7,077,083 | B2 | 7/2006 | Dingle et al. | |
| 7,140,332 | B2 | 11/2006 | Klein et al. | |
| 7,156,062 | B2 | 1/2007 | Vanderpoel | |
| 7,171,930 | B2 | 2/2007 | Keel | |
| 7,314,027 | B2 | 1/2008 | Murata | |
| 7,353,786 | B2 | 4/2008 | Scuderi et al. | |
| 7,430,997 | B2 | 10/2008 | Muraji et al. | |
| 7,481,190 | B2 | 1/2009 | Scuderi | |
| 7,513,224 | B2 | 4/2009 | Heaton | |
| 7,536,984 | B2 | 5/2009 | Lou | |
| 7,603,970 | B2 | 10/2009 | Scuderi et al. | |
| 7,628,126 | B2 | 12/2009 | Scuderi | |
| 7,637,234 | B2 | 12/2009 | Tussing et al. | |
| 7,690,337 | B2 | 4/2010 | Pirault et al. | |
| 7,810,459 | B2 | 10/2010 | Branyon et al. | |
| 7,823,547 | B2 | 11/2010 | Forner, Sr. et al. | |
| 7,963,259 | B2 | 6/2011 | Meldolesi et al. | |
| 8,051,812 | B2 | 11/2011 | Lou | |
| 8,079,338 | B2 | 12/2011 | Schwoerer et al. | |
| 8,087,392 | B2 | 1/2012 | Swanbon et al. | |
| 8,146,547 | B2 | 4/2012 | Lou | |
| 2002/0152976 | A1 | 10/2002 | Nguyen | |
| 2002/0185091 | A1 | 12/2002 | Vorih et al. | |
| 2003/0192496 | A1 | 10/2003 | Walters | |
| 2003/0221663 | A1 | 12/2003 | Vanderpoel et al. | |
| 2004/0065308 | A1 | 4/2004 | Bryant | |
| 2005/0022768 | A1 | 2/2005 | Tores et al. | |
| 2005/0076868 | A1 | 4/2005 | Mott et al. | |
| 2005/0132987 | A1 | 6/2005 | Chang | |
| 2005/0268609 | A1 | 12/2005 | Branyon et al. | |
| 2006/0011154 | A1 | 1/2006 | Scuderi et al. | |
| 2006/0096560 | A1 | 5/2006 | Afjeh et al. | |
| 2006/0273271 | A1 * | 12/2006 | Yang et al. | 251/54 |
| 2007/0101958 | A1 | 5/2007 | Seitz | |
| 2007/0157894 | A1 | 7/2007 | Scuderi et al. | |
| 2007/0204818 | A1 | 9/2007 | Dingle | |
| 2007/0272180 | A1 | 11/2007 | Lou | |
| 2008/0054205 | A1 | 3/2008 | Lou | |
| 2008/0078345 | A1 | 4/2008 | Knauf et al. | |
| 2008/0105225 | A1 | 5/2008 | Scuderi et al. | |
| 2008/0196683 | A1 | 8/2008 | Hayman et al. | |
| 2008/0202159 | A1 | 8/2008 | Fountain | |
| 2008/0202454 | A1 | 8/2008 | Pirault | |
| 2008/0251041 | A1 | 10/2008 | Lou | |
| 2009/0038596 | A1 | 2/2009 | Pirault et al. | |
| 2009/0038598 | A1 | 2/2009 | Phillips | |
| 2009/0044778 | A1 | 2/2009 | Scuderi et al. | |
| 2009/0107433 | A1 | 4/2009 | Tanaka | |
| 2009/0133648 | A1 | 5/2009 | Lou | |
| 2009/0184273 | A1 * | 7/2009 | Schwoerer et al. | 251/63.5 |
| 2009/0205598 | A1 | 8/2009 | Takahashi et al. | |
| 2009/0266347 | A1 | 10/2009 | Scuderi et al. | |
| 2009/0276992 | A1 | 11/2009 | Maeda et al. | |
| 2010/0095918 | A1 | 4/2010 | Cecur | |
| 2010/0116231 | A1 | 5/2010 | Toda et al. | |
| 2010/0126442 | A1 | 5/2010 | Lou | |
| 2010/0132644 | A1 | 6/2010 | Methley et al. | |
| 2010/0161202 | A1 | 6/2010 | Ide et al. | |
| 2010/0180847 | A1 | 7/2010 | Meldolesi et al. | |
| 2010/0180848 | A1 | 7/2010 | Meldolesi et al. | |
| 2010/0180875 | A1 | 7/2010 | Meldolesi et al. | |
| 2010/0186693 | A1 | 7/2010 | Ezaki | |
| 2010/0263646 | A1 | 10/2010 | Giannini et al. | |
| 2010/0274466 | A1 | 10/2010 | Takamiya | |
| 2010/0282225 | A1 | 11/2010 | Gilbert et al. | |
| 2010/0300385 | A1 | 12/2010 | Durrett et al. | |
| 2011/0036316 | A1 | 2/2011 | de Ojeda et al. | |
| 2011/0220081 | A1 | 9/2011 | Meldolesi et al. | |
| 2011/0308505 | A1 | 12/2011 | Meldolesi | |
| 2012/0073552 | A1 | 3/2012 | Phillips | |
| 2012/0073553 | A1 | 3/2012 | Phillips | |
| 2012/0080017 | A1 | 4/2012 | Phillips et al. | |
| 2012/0192817 | A1 | 8/2012 | Meldolesi et al. | |
| 2012/0192818 | A1 | 8/2012 | Meldolesi et al. | |
| 2012/0192840 | A1 | 8/2012 | Meldolesi et al. | |

(56) References Cited

U.S. PATENT DOCUMENTS

| | | | |
|---|---|---|---|
| 2012/0192841 | A1 | 8/2012 | Meldolesi et al. |
| 2012/0255296 | A1 | 10/2012 | Phillips et al. |
| 2012/0298086 | A1 | 11/2012 | Scuderi |

FOREIGN PATENT DOCUMENTS

| | | | |
|---|---|---|---|
| GB | 2 340 881 | A | 3/2000 |
| JP | 40-010860 | | 4/1965 |
| JP | 10-274105 | A | 10/1998 |
| JP | 2004-293695 | A | 10/2004 |
| WO | 2006/094213 | A1 | 9/2006 |

OTHER PUBLICATIONS

Meldolesi, et al. (Southwest Research Institute), Scuderi Split Cycle Fast Acting Valvetrain: Architecture and Development, SAE paper 2011-01-0404 (Jan. 18, 2011) (23 pages).

Urata, et al. (Honda), A Study of Vehicle Equipped with Non-Throttling S.I. Engine with Early Intake Valve Closing Mechanism, SAE paper 930820 (Mar. 1, 1993) (13 pages).

International Search Report and Written Opinion for Application No. PCT/US2012/069796, issued Apr. 11, 2013 (10 Pages).

* cited by examiner

LOST-MOTION VARIABLE VALVE ACTUATION SYSTEM

CROSS-REFERENCE TO RELATED APPLICATIONS

This application claims the benefit of priority of U.S. Provisional Patent Application No. 61/583,913, filed on Jan. 6, 2012; U.S. Provisional Patent Application No. 61/594,186, filed on Feb. 2, 2012; and U.S. Provisional Patent Application No. 61/644,846, filed on May 9, 2012, the entire contents of each of which are hereby incorporated by reference.

FIELD

The present invention relates to internal combustion engines. More particularly, the invention relates to lost-motion variable valve actuation systems for internal combustion engines and corresponding methods.

BACKGROUND

For purposes of clarity, the term "conventional engine" as used in the present application refers to an internal combustion engine wherein all four strokes of the well-known Otto cycle (the intake, compression, expansion and exhaust strokes) are contained in each piston/cylinder combination of the engine. Each stroke requires one half revolution of the crankshaft (180 degrees crank angle ("CA")), and two full revolutions of the crankshaft (720 degrees CA) are required to complete the entire Otto cycle in each cylinder of a conventional engine.

Also, for purposes of clarity, the following definition is offered for the term "split-cycle engine" as may be applied to engines disclosed in the prior art and as referred to in the present application.

A split-cycle engine generally comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween.

A split-cycle air hybrid engine combines a split-cycle engine with an air reservoir (also commonly referred to as an air tank) and various controls. This combination enables the engine to store energy in the form of compressed air in the air reservoir. The compressed air in the air reservoir is later used in the expansion cylinder to power the crankshaft. In general, a split-cycle air hybrid engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft;

a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween; and an air reservoir operatively connected to the crossover passage and selectively operable to store compressed air from the compression cylinder and to deliver compressed air to the expansion cylinder.

FIG. 1 illustrates one exemplary embodiment of a prior art split-cycle air hybrid engine. The split-cycle engine 100 replaces two adjacent cylinders of a conventional engine with a combination of one compression cylinder 102 and one expansion cylinder 104. The compression cylinder 102 and the expansion cylinder 104 are formed in an engine block in which a crankshaft 106 is rotatably mounted. Upper ends of the cylinders 102, 104 are closed by a cylinder head 130. The crankshaft 106 includes axially displaced and angularly offset first and second crank throws 126, 128, having a phase angle therebetween. The first crank throw 126 is pivotally joined by a first connecting rod 138 to a compression piston 110, and the second crank throw 128 is pivotally joined by a second connecting rod 140 to an expansion piston 120 to reciprocate the pistons 110, 120 in their respective cylinders 102, 104 in a timed relation determined by the angular offset of the crank throws and the geometric relationships of the cylinders, crank, and pistons. Alternative mechanisms for relating the motion and timing of the pistons can be utilized if desired. The rotational direction of the crankshaft and the relative motions of the pistons near their bottom dead center (BDC) positions are indicated by the arrows associated in the drawings with their corresponding components.

The four strokes of the Otto cycle are thus "split" over the two cylinders 102 and 104 such that the compression cylinder 102 contains the intake and compression strokes and the expansion cylinder 104 contains the expansion and exhaust strokes. The Otto cycle is therefore completed in these two cylinders 102, 104 once per crankshaft 106 revolution (360 degrees CA).

During the intake stroke, intake air is drawn into the compression cylinder 102 through an inwardly-opening (opening inward into the cylinder and toward the piston) poppet intake valve 108. During the compression stroke, the compression piston 110 pressurizes the air charge and drives the air charge through a crossover passage 112, which acts as the intake passage for the expansion cylinder 104. The engine 100 can have one or more crossover passages 112.

The geometric compression ratio of the compression cylinder 102 of the split-cycle engine 100 (and for split-cycle engines in general) is herein referred to as the "compression ratio" of the split-cycle engine. The geometric compression ratio of the expansion cylinder 104 of the engine 100 (and for split-cycle engines in general) is herein referred to as the "expansion ratio" of the split-cycle engine. The geometric compression ratio of a cylinder is well known in the art as the ratio of the enclosed (or trapped) volume in the cylinder (including all recesses) when a piston reciprocating therein is at its BDC position to the enclosed volume (i.e., clearance volume) in the cylinder when said piston is at its top dead center (TDC) position. Specifically for split-cycle engines as defined herein, the compression ratio of a compression cylinder is determined when the XovrC valve is closed. Also specifically for split-cycle engines as defined herein, the expansion ratio of an expansion cylinder is determined when the XovrE valve is closed.

Due to very high geometric compression ratios (e.g., 20 to 1, 30 to 1, 40 to 1, or greater) within the compression cylinder 102, an outwardly-opening (opening outwardly away from the cylinder and piston) poppet crossover compression (XovrC) valve 114 at the inlet of the crossover passage 112 is used to control flow from the compression cylinder 102 into the crossover passage 112. Due to very high geometric compression ratios (e.g., 20 to 1, 30 to 1, 40 to 1, or greater) within the expansion cylinder 104, an outwardly-opening poppet crossover expansion (XovrE) valve 116 at the outlet of the crossover passage 112 controls flow from the crossover passage 112 into the expansion cylinder 104. The actuation rates and phasing of the XovrC and XovrE valves 114, 116 are timed to maintain pressure in the crossover passage 112 at a high minimum pressure (typically 20 bar or higher at full load) during all four strokes of the Otto cycle.

At least one fuel injector 118 injects fuel into the pressurized air at the exit end of the crossover passage 112 in coordination with the XovrE valve 116 opening. Alternatively, or in addition, fuel can be injected directly into the expansion cylinder 104. The fuel-air charge fully enters the expansion cylinder 104 shortly after the expansion piston 120 reaches its TDC position. As the piston 120 begins its descent from its TDC position, and while the XovrE valve 116 is still open, one or more spark plugs 122 are fired to initiate combustion (typically between 10 to 20 degrees CA after TDC of the expansion piston 120). Combustion can be initiated while the expansion piston is between 1 and 30 degrees CA past its TDC position. More preferably, combustion can be initiated while the expansion piston is between 5 and 25 degrees CA past its TDC position. Most preferably, combustion can be initiated while the expansion piston is between 10 and 20 degrees CA past its TDC position. Additionally, combustion can be initiated through other ignition devices and/or methods, such as with glow plugs, microwave ignition devices, or through compression ignition methods.

The XovrE valve 116 is then closed before the resulting combustion event enters the crossover passage 112. The combustion event drives the expansion piston 120 downward in a power stroke. Exhaust gases are pumped out of the expansion cylinder 104 through an inwardly-opening poppet exhaust valve 124 during the exhaust stroke.

With the split-cycle engine concept, the geometric engine parameters (i.e., bore, stroke, connecting rod length, compression ratio, etc.) of the compression and expansion cylinders are generally independent from one another. For example, the crank throws 126, 128 for the compression cylinder 102 and expansion cylinder 104, respectively, have different radii and are phased apart from one another with TDC of the expansion piston 120 occurring prior to TDC of the compression piston 110. This independence enables the split-cycle engine to potentially achieve higher efficiency levels and greater torques than typical four-stroke engines.

The geometric independence of engine parameters in the split-cycle engine 100 is also one of the main reasons why pressure can be maintained in the crossover passage 112 as discussed earlier. Specifically, the expansion piston 120 reaches its TDC position prior to the compression piston 110 reaching its TDC position by a discrete phase angle (typically between 10 and 30 crank angle degrees). This phase angle, together with proper timing of the XovrC valve 114 and the XovrE valve 116, enables the split-cycle engine 100 to maintain pressure in the crossover passage 112 at a high minimum pressure (typically 20 bar absolute or higher during full load operation) during all four strokes of its pressure/volume cycle. That is, the split-cycle engine 100 is operable to time the XovrC valve 114 and the XovrE valve 116 such that the XovrC and XovrE valves 114, 116 are both open for a substantial period of time (or period of crankshaft rotation) during which the expansion piston 120 descends from its TDC position towards its BDC position and the compression piston 110 simultaneously ascends from its BDC position towards its TDC position. During the period of time (or crankshaft rotation) that the crossover valves 114, 116 are both open, a substantially equal mass of gas is transferred (1) from the compression cylinder 102 into the crossover passage 112 and (2) from the crossover passage 112 to the expansion cylinder 104. Accordingly, during this period, the pressure in the crossover passage is prevented from dropping below a predetermined minimum pressure (typically 20, 30, or 40 bar absolute during full load operation). Moreover, during a substantial portion of the intake and exhaust strokes (typically 80% of the entire intake and exhaust strokes or greater), the XovrC valve 114 and XovrE valve 116 are both closed to maintain the mass of trapped gas in the crossover passage 112 at a substantially constant level. As a result, the pressure in the crossover passage 112 is maintained at a predetermined minimum pressure during all four strokes of the engine's pressure/volume cycle.

For purposes herein, the method of opening the XovrC 114 and XovrE 116 valves while the expansion piston 120 is descending from TDC and the compression piston 110 is ascending toward TDC in order to simultaneously transfer a substantially equal mass of gas into and out of the crossover passage 112 is referred to as the "push-pull" method of gas transfer. It is the push-pull method that enables the pressure in the crossover passage 112 of the engine 100 to be maintained at typically 20 bar or higher during all four strokes of the engine's cycle when the engine is operating at full load.

The crossover valves 114, 116 are actuated by a valve train that includes one or more cams (not shown). In general, a cam-driven mechanism includes a camshaft mechanically linked to the crankshaft. One or more cams are mounted to the camshaft, each having a contoured surface that controls the valve lift profile of the valve event (i.e., the event that occurs during a valve actuation). The XovrC valve 114 and the XovrE valve 116 each can have its own respective cam and/or its own respective camshaft. As the XovrC and XovrE cams rotate, actuating portions thereof impart motion to a rocker arm, which in turn imparts motion to the valve, thereby lifting (opening) the valve off of its valve seat. As the cam continues to rotate, the actuating portion passes the rocker arm and the valve is allowed to close.

The split-cycle air hybrid engine 100 also includes an air reservoir (tank) 142, which is operatively connected to the crossover passage 112 by an air reservoir tank valve 152. Embodiments with two or more crossover passages 112 may include a tank valve 152 for each crossover passage 112 which connect to a common air reservoir 142, may include a single valve which connects all crossover passages 112 to a common air reservoir 142, or each crossover passage 112 may operatively connect to separate air reservoirs 142.

The tank valve 152 is typically disposed in an air tank port 154, which extends from the crossover passage 112 to the air tank 142. The air tank port 154 is divided into a first air tank port section 156 and a second air tank port section 158. The first air tank port section 156 connects the air tank valve 152 to the crossover passage 112, and the second air tank port section 158 connects the air tank valve 152 to the air tank 142. The volume of the first air tank port section 156 includes the volume of all additional recesses which connect the tank valve 152 to the crossover passage 112 when the tank valve 152 is closed. Preferably, the volume of the first air tank port section 156 is small relative to the second air tank port section 158. More preferably, the first air tank port section 156 is substantially non-existent, that is, the tank valve 152 is most preferably disposed such that it is flush against the outer wall of the crossover passage 112.

The tank valve 152 may be any suitable valve device or system. For example, the tank valve 152 may be an active valve which is activated by various valve actuation devices (e.g., pneumatic, hydraulic, cam, electric, or the like). Additionally, the tank valve 152 may comprise a tank valve system with two or more valves actuated with two or more actuation devices.

The air tank 142 is utilized to store energy in the form of compressed air and to later use that compressed air to power the crankshaft 106. This mechanical means for storing potential energy provides numerous potential advantages over the current state of the art. For instance, the split-cycle air hybrid engine 100 can potentially provide many advantages in fuel efficiency gains and NOx emissions reduction at relatively low manufacturing and waste disposal costs in relation to other technologies on the market, such as diesel engines and electric-hybrid systems.

The engine 100 typically runs in a normal operating or firing (NF) mode (also commonly called the engine firing (EF) mode) and one or more of four basic air hybrid modes. In the NF mode, the engine 100 functions normally as previously described in detail herein, operating without the use of the air tank 142. In the NF mode, the air tank valve 152 remains closed to isolate the air tank 142 from the basic split-cycle engine. In the four air hybrid modes, the engine 100 operates with the use of the air tank 142.

The four basic air hybrid modes include:

1) Air Expander (AE) mode, which includes using compressed air energy from the air tank 142 without combustion;

2) Air Compressor (AC) mode, which includes storing compressed air energy into the air tank 142 without combustion;

3) Air Expander and Firing (AEF) mode, which includes using compressed air energy from the air tank 142 with combustion; and 4) Firing and Charging (FC) mode, which includes storing compressed air energy into the air tank 142 with combustion.

Further details on split-cycle engines can be found in U.S. Pat. No. 6,543,225 entitled Split Four Stroke Cycle Internal Combustion Engine and issued on Apr. 8, 2003; and U.S. Pat. No. 6,952,923 entitled Split-Cycle Four-Stroke Engine and issued on Oct. 11, 2005, each of which is incorporated by reference herein in its entirety.

Further details on air hybrid engines are disclosed in U.S. Pat. No. 7,353,786 entitled Split-Cycle Air Hybrid Engine and issued on Apr. 8, 2008; U.S. Patent Application No. 61/365,343 entitled Split-Cycle Air Hybrid Engine and filed on Jul. 18, 2010; and U.S. Patent Application No. 61/313,831 entitled Split-Cycle Air Hybrid Engine and filed on Mar. 15, 2010, each of which is incorporated by reference herein in its entirety.

In order to operate split-cycle engines, and split-cycle air hybrid engines, of the type described above at high efficiency, a valve actuation system is required that is capable of (1) opening and closing the crossover valves at extremely rapid accelerations, and (2) allowing cycle-to-cycle variation in at least the closing timing.

In split-cycle engines, the dynamic actuation of the crossover valves (i.e. 114, 116) is very demanding. This is due to the fact that the crossover valves must achieve sufficient lift to fully transfer the fuel-air charge in a very short period of crankshaft rotation (possibly as little as 6 degrees CA) relative to that of a conventional engine, which normally actuates the valves for a period of at least 180 degrees CA. For example, when operating in NF mode, it is desirable to open the XovrE valve, transfer a fluid charge into the expansion cylinder, and close the XovrE valve while the expansion piston is very close to TDC. Thus, the XovrE valve must typically open and close in a window of about 30 degrees CA to about 35 degrees CA.

Certain air hybrid modes introduce even more-stringent requirements. One such mode is the AEF mode, wherein a volume of compressed air from the air reservoir 142 is combined with fuel and combusted. During AEF mode operation, shortly after the expansion piston reaches TDC, the XovrE valve is opened to direct a charge of compressed air (mixed with added fuel) from the reservoir 142 into the combustion chamber where it is then ignited during an expansion stroke. If the engine is operating under only part load and the air reservoir 142 is charged to a high pressure (e.g., above approximately 20 bar), the XovrE valve only needs to be opened for a very short period (e.g., about 6 degrees CA) to transfer the requisite mass of air and fuel into the combustion chamber. In other words, the relatively small mass of air-fuel mixture required for part-load operation will quickly flow into the combustion chamber when the air reservoir 142 is charged to a high pressure, and therefore the XovrE valve need only open for a few degrees CA. The crossover valves must therefore be capable of actuation rates that are several times faster than the valves of a conventional engine, which means the valve train associated therewith must be stiff enough and at the same time light enough to achieve such fast actuation rates.

Meanwhile, other operating modes may require that the valves stay open for a relatively long period of time. For example, in AE mode, a volume of compressed air stored in the air reservoir 142 is delivered to the combustion chamber without spark or added fuel, forcing the expansion piston down and providing power to the crankshaft. If, however, the air pressure remaining in the reservoir is low (e.g., less than approximately 15 bar) and there is a high torque requirement (e.g., when a vehicle being powered by the engine is accelerating up a hill), the XovrE valve must remain open much longer to allow a sufficient mass of compressed air into the expansion chamber. In some cases, this can be 100 degrees CA or more. Thus, large variations in closing timing are required, since the XovrE valve might need to close 6 degrees CA after opening in one operating mode while it may need to remain open for 100 degrees CA or more in other operating modes, as presented above.

Air hybrid split-cycle engines can also require large variations in the opening timing of the crossover valves 114, 116, especially in modes that involve charging the air reservoir (e.g., AC mode and FC mode). In AC mode for instance, the opening timing of the XovrC valve 114 will vary considerably depending on load and the pressure in the air reservoir 142. If the XovrC valve is opened before the pressure in the compression cylinder is greater than or equal to the pressure in the air reservoir, fluid in the air reservoir will undesirably flow back into the compression cylinder 102. The energy required to re-compress this backflow reduces the efficiency of the engine. Therefore, the XovrC valve should not be opened until the pressure in the compression cylinder matches or exceeds that of the air reservoir 142. Thus, a range of approximately 30 to 60 degrees CA of opening timing variability is required for the XovrC valve, depending on the pressure in the air reservoir.

Accordingly, the opening timing, closing timing, and/or various other engine valve parameters must be variable over a wide range of possible values in order to efficiently operate each of the various engine modes.

Moreover, these parameters must be, in some cases, adjustable on a cycle-to-cycle basis. For example, the XovrE valve 116 can be used for load control in operating modes that employ combustion (e.g., NF mode, FC mode, and AEF mode). By closing the XovrE valve at various points along the expansion piston's stroke, the mass of air/fuel supplied to the cylinder can be metered, thereby controlling the engine load. To achieve precise load control in this case, the actuation rate of the XovrE valve must be variable from one cycle to the next.

Existing valve actuation systems are simply incapable of meeting these requirements. They are either too heavy or not stiff enough to be actuated at the velocities and accelerations needed to achieve the required short opening periods. In addition, they provide only a limited range of opening or closing variability and are not responsive enough for cycle-to-cycle variation. Accordingly, there is a need for improved valve actuation systems.

SUMMARY

Valve actuation systems are disclosed herein that allow valve opening timing to be varied using a cam phaser and that allow valve closing timing to be varied using a lost-motion system. In one embodiment, an actuation system is provided that has a locked configuration in which a bearing element is held in place between a cam and a rocker to transmit cam motion to an engine valve. The actuation system also has an unlocked configuration in which the bearing element is permitted to be at least partially ejected from between the cam and rocker, such that cam motion is not transmitted to the engine valve. The actuation system is switched to the unlocked configuration by draining fluid therefrom through a main valve which is piloted by a trigger valve. The actuation system also includes integrated autolash and seating control functionality.

In one aspect of at least one embodiment of the invention, an actuation system is provided that includes a housing having a bore formed therein and an autolash piston slidably disposed within the bore in the housing, the autolash piston including a proximal chamber, a middle chamber, and a distal chamber. The system also includes a main valve slidably disposed within the autolash piston, the main valve having a closed configuration in which the main valve substantially prevents fluid flow between the distal chamber and the middle chamber and an open configuration in which the distal chamber is in fluid communication with the middle chamber and a main accumulator. The system also includes a trigger valve configured to selectively place the proximal chamber in fluid communication with a trigger accumulator and a lost-motion piston slidably disposed within the distal chamber, the lost-motion piston being coupled to a component of a valve train. When the trigger valve is opened, fluid flows out of the proximal chamber through the trigger valve, the main valve moves to the open configuration, fluid flows out of the distal chamber into the main accumulator, and the lost-motion piston moves proximally within the autolash piston, thereby allowing the valve train component to be pushed away from one or more other valve train components to allow an engine valve to close.

Related aspects of at least one embodiment of the invention provide an actuation system, e.g., as described above, in which the valve train component is a bearing element coupled to the lost-motion piston by a connecting arm, the one or more other valve train components include a cam and a rocker, and the bearing element is positioned between the cam and the rocker.

Related aspects of at least one embodiment of the invention provide an actuation system, e.g., as described above, in which the main valve includes a pressure-balancing orifice formed therethrough, the orifice placing the distal chamber in fluid communication with the proximal chamber.

Related aspects of at least one embodiment of the invention provide an actuation system, e.g., as described above, that includes a bias spring configured to bias the main valve towards the closed configuration.

Related aspects of at least one embodiment of the invention provide an actuation system, e.g., as described above, in which an autolash plenum is defined by a clearance space between the autolash piston and the housing, the autolash plenum being selectively filled with and drained of fluid to adjust a position of the autolash piston relative to the housing to take up lash in the valve train.

Related aspects of at least one embodiment of the invention provide an actuation system, e.g., as described above, that includes a first fluid leakage path extending from the autolash plenum to a drain.

Related aspects of at least one embodiment of the invention provide an actuation system, e.g., as described above, that includes a second fluid leakage path extending from the proximal chamber to the autolash plenum.

Related aspects of at least one embodiment of the invention provide an actuation system, e.g., as described above, in which the lost-motion piston includes a seating control protrusion configured to be received within a seating control opening formed in a dividing wall that separates the distal chamber from the middle chamber, such that the seating control opening is progressively occluded by the seating control protrusion as the engine valve approaches an engine valve seat.

Related aspects of at least one embodiment of the invention provide an actuation system, e.g., as described above, in which the seating control protrusion has a substantially cylindrical distal portion and a tapered proximal portion.

Related aspects of at least one embodiment of the invention provide an actuation system, e.g., as described above, that includes at least one refill check valve configured to permit one-way flow of fluid from the middle chamber to the distal chamber when pressure in the middle chamber is greater than pressure in the distal chamber.

Related aspects of at least one embodiment of the invention provide an actuation system, e.g., as described above, in which the lost-motion piston includes a lubrication aperture that supplies fluid from the distal chamber to an interface between the lost-motion piston and the valve train component.

Related aspects of at least one embodiment of the invention provide an actuation system, e.g., as described above, that includes a third leakage path extending from the main accumulator to a drain.

Related aspects of at least one embodiment of the invention provide an actuation system, e.g., as described above, that includes a check valve configured to permit one-way flow of fluid from a fluid source to the main accumulator when pressure in the main accumulator is less than pressure in the fluid source.

Related aspects of at least one embodiment of the invention provide an actuation system, e.g., as described above, in which the engine valve is an outwardly-opening crossover valve of a split-cycle engine.

In another aspect of at least one embodiment of the invention, an actuation system is provided that includes an autolash piston configured to slide within a housing to take up lash in a valve train to which the actuation system is coupled. The system also includes a main valve disposed within the autolash piston and having a first position in which fluid is prevented from escaping from a lost-motion chamber formed in the autolash piston and a second position in which fluid is permitted to escape from the lost-motion chamber. The system also includes a lost-motion piston that slides within the lost-motion chamber when the main valve is transitioned from the first position to the second position, thereby allowing an engine valve to close. The lost-motion piston progressively occludes a fluid path through which fluid escapes the lost-motion chamber when the main valve is in the second position.

Related aspects of at least one embodiment of the invention provide an actuation system, e.g., as described above, that includes a trigger valve that, when opened, allows the main valve to move from the first position to the second position.

Related aspects of at least one embodiment of the invention provide an actuation system, e.g., as described above, in which a flow area through the main valve is approximately five times greater than a flow area through the trigger valve.

In another aspect of at least one embodiment of the invention, a method of operating an engine that includes an engine valve actuated by a valve train is provided that includes adjusting a position of an autolash piston relative to a housing in which the autolash piston is disposed to take up lash in the valve train, the autolash piston having a main valve chamber and a lost-motion chamber formed therein. The method also includes opening a main valve disposed within the main valve chamber to permit fluid to escape from the lost-motion chamber, thereby allowing a lost-motion piston to slide within the lost-motion chamber to allow the engine valve to close. The method also includes progressively occluding a fluid path through which fluid escapes the lost-motion chamber with a portion of the lost-motion piston to control a seating velocity of the engine valve.

Related aspects of at least one embodiment of the invention provide a method, e.g., as described above, in which opening the main valve comprises opening a trigger valve to allow fluid to escape from the main valve chamber.

In another aspect of at least one embodiment of the invention, a lost-motion variable valve actuation system is provided that includes a bearing element and an actuation system configured to selectively permit the bearing element to be at least partially ejected from between first and second valve train components to allow an engine valve to close. The bearing element is coupled to a lost-motion piston disposed within the actuation system by a connecting arm.

Related aspects of at least one embodiment of the invention provide a system, e.g., as described above, in which the connecting arm is pivotally coupled to the lost-motion piston.

Related aspects of at least one embodiment of the invention provide a system, e.g., as described above, in which the connecting arm has a cylindrical proximal end that is seated within a corresponding cylindrical recess formed in a distal end of the lost-motion piston.

Related aspects of at least one embodiment of the invention provide a system, e.g., as described above, that includes a meniscus having a planar proximal surface and a spherical distal surface, the meniscus being disposed between a planar distal surface of the lost-motion piston and a spherical recess formed in a proximal surface of the connecting arm.

Related aspects of at least one embodiment of the invention provide a system, e.g., as described above, in which the lost-motion piston includes a lubrication aperture through which fluid can be communicated to proximal and distal fluid cavities formed in the meniscus.

Related aspects of at least one embodiment of the invention provide a system, e.g., as described above, in which the proximal fluid cavity comprises a set of interconnected concentric grooves formed in the proximal surface of the meniscus and the distal fluid cavity comprises first and second linear intersecting grooves formed in the distal surface of the meniscus.

Related aspects of at least one embodiment of the invention provide a system, e.g., as described above, in which the connecting arm has a cylindrical proximal end that bears against a planar distal surface of the lost-motion piston.

Related aspects of at least one embodiment of the invention provide a system, e.g., as described above, in which the first valve train component is a cam and the second valve train component is a rocker.

Related aspects of at least one embodiment of the invention provide a system, e.g., as described above, in which the first valve train component is an upper portion of a rocker pedestal and the second valve train component is a lower portion of the rocker pedestal.

Related aspects of at least one embodiment of the invention provide a system, e.g., as described above, in which the first valve train component is a cam and the second valve train component is an engine valve stem.

Related aspects of at least one embodiment of the invention provide a system, e.g., as described above, in which the engine valve is an outwardly-opening crossover valve of a split-cycle engine.

Related aspects of at least one embodiment of the invention provide a system, e.g., as described above, in which the bearing element comprises a major portion and a pad, the pad being slidably disposed in a pocket formed in the major portion.

Related aspects of at least one embodiment of the invention provide a system, e.g., as described above, in which the pocket includes a convex pad-facing surface and the pad includes a concave pocket-facing surface, the convex pad-facing surface having a widthwise radius of curvature that is less than a widthwise radius of curvature of the concave pocket-facing surface.

Related aspects of at least one embodiment of the invention provide a system, e.g., as described above, in which the pocket includes a concave pad-facing surface and the pad includes a convex pocket-facing surface, the concave pad-facing surface having a widthwise radius of curvature that is greater than a widthwise radius of curvature of the convex pocket-facing surface.

Related aspects of at least one embodiment of the invention provide a system, e.g., as described above, in which the major portion has a bearing surface formed thereon that engages the first valve train component and the pad has a bearing surface formed thereon that engages the second valve train component.

Related aspects of at least one embodiment of the invention provide a system, e.g., as described above, in which the connecting arm has a mating portion at its proximal end, the mating portion comprising a major portion that is a section of a sphere and a minor portion that is a section of a cylinder, the minor portion bearing against a planar distal surface of the lost-motion piston.

Related aspects of at least one embodiment of the invention provide a system, e.g., as described above, in which the pocket is defined by proximal and distal stops, the proximal and distal stops each having a rib projecting therefrom on which proximal and distal tabs extending from the pad are slidably disposed.

In another aspect of at least one embodiment of the invention, a valve train is provided that includes a cam having a cam surface, a rocker having a rocker pad surface, and a bearing element having a cam-facing surface that slidably engages the cam surface and a rocker-facing surface that slidably engages the rocker pad surface. The valve train also includes an actuation system configured to selectively permit the bearing element to be at least partially ejected from between the cam and the rocker. The cam surface has a substantially infinite widthwise radius of curvature, the cam-facing surface has a finite lengthwise radius of curvature and a substantially infinite widthwise radius of curvature, the rocker-facing surface has a finite lengthwise radius of curvature and a finite widthwise radius of curvature, and the rocker pad surface has a finite lengthwise radius of curvature and a finite widthwise radius of curvature.

Related aspects of at least one embodiment of the invention provide a valve train, e.g., as described above, in which the lengthwise radius of curvature of the cam-facing surface is less than the lengthwise radius of curvature of the rocker-facing surface.

Related aspects of at least one embodiment of the invention provide a valve train, e.g., as described above, in which the widthwise radius of curvature of the rocker-facing surface is substantially the same as the widthwise radius of curvature of the rocker pad surface.

Related aspects of at least one embodiment of the invention provide a valve train, e.g., as described above, in which the widthwise radius of curvature of the rocker-facing surface is greater than the lengthwise radius of curvature of the rocker-facing surface.

Related aspects of at least one embodiment of the invention provide a valve train, e.g., as described above, in which the lengthwise radius of curvature of the cam-facing surface is about 17 mm, the lengthwise radius of curvature of the rocker-facing surface is about 50 mm, the widthwise radius of curvature of the rocker-facing surface is about 1 meter, the lengthwise radius of curvature of the rocker pad surface is about 35 mm, and the widthwise radius of curvature of the rocker pad surface is about 1 meter.

In another aspect of at least one embodiment of the invention, an actuation system is provided. The system includes a sleeve having a proximal chamber, a middle chamber, and a distal chamber. The system also includes a main valve slidably disposed within the sleeve, the main valve having a closed configuration in which the main valve substantially prevents fluid flow between the distal chamber and the middle chamber, and an open configuration in which the distal chamber is in fluid communication with the middle chamber and a main accumulator. The system also includes a trigger valve configured to selectively place the proximal chamber in fluid communication with a trigger accumulator. The system also includes a lost-motion piston slidably disposed within the distal chamber, the lost-motion piston being coupled to a component of a valve train. The system also includes an autolash chamber formed in the lost-motion piston and having a valve catch plunger slidably disposed therein. When the trigger valve is opened, fluid flows out of the proximal chamber through the trigger valve, the main valve moves to the open configuration, fluid flows out of the distal chamber into the main accumulator, and the lost-motion piston moves proximally within the sleeve, thereby allowing the valve train component to be pushed away from one or more other valve train components to allow an engine valve to close.

Related aspects of at least one embodiment of the invention provide a system, e.g., as described above, in which valve train component is a bearing element coupled to the lost-motion piston by a connecting arm, the one or more other valve train components comprise a cam and a rocker, and the bearing element is positioned between the cam and the rocker.

Related aspects of at least one embodiment of the invention provide a system, e.g., as described above, in which the main valve includes a pressure-balancing orifice formed therethrough, the orifice placing the distal chamber in fluid communication with the proximal chamber.

Related aspects of at least one embodiment of the invention provide a system, e.g., as described above, that includes a bias spring configured to bias the main valve towards the closed configuration.

Related aspects of at least one embodiment of the invention provide a system, e.g., as described above, in which the valve catch plunger is biased away from the lost-motion piston by an autolash spring.

Related aspects of at least one embodiment of the invention provide a system, e.g., as described above, in which the valve catch plunger moves away from the lost-motion piston when the valve catch plunger is substantially not in contact with a dividing wall formed in the sleeve, allowing the autolash chamber to be filled with hydraulic fluid and taking up lash in the valve train.

Related aspects of at least one embodiment of the invention provide a system, e.g., as described above, in which the valve catch plunger moves towards the lost-motion piston when the valve catch plunger is substantially in contact with a dividing wall formed in the sleeve, causing hydraulic fluid to be expelled from the autolash chamber.

Related aspects of at least one embodiment of the invention provide a system, e.g., as described above, in which the valve catch plunger includes a seating control protrusion configured to be received within a seating control opening formed in a dividing wall that separates the distal chamber from the middle chamber, such that the seating control opening is progressively occluded by the seating control protrusion as the engine valve approaches an engine valve seat.

In another aspect of at least one embodiment of the invention, an actuation system is provided. The system includes a main valve disposed within a sleeve and having a first position in which fluid is prevented from escaping from a lost-motion chamber formed in the sleeve and a second position in which fluid is permitted to escape from the lost-motion chamber. The system also includes a lost-motion piston that slides within the lost-motion chamber when the main valve moves from the first position to the second position, thereby allowing an engine valve to close. The system also includes a valve catch plunger configured to slide within the lost-motion piston to take up lash in a valve train to which the actuation system is coupled. The valve catch plunger progressively occludes a fluid path through which fluid escapes the lost-motion chamber when the main valve is in the second position.

Related aspects of at least one embodiment of the invention provide a system, e.g., as described above, that includes a trigger valve that, when opened, allows the main valve to move from the first position to the second position.

In another aspect of at least one embodiment of the invention, a method of operating an engine that includes an engine valve actuated by a valve train is provided. The method includes opening a main valve disposed within a main valve chamber of a sleeve to permit fluid to escape from a lost-motion chamber formed in the sleeve, thereby allowing a lost-motion piston to slide within the lost-motion chamber to allow the engine valve to close. The method also includes progressively occluding a fluid path through which fluid escapes the lost-motion chamber with a portion of a valve catch plunger disposed within the lost-motion piston to control a seating velocity of the engine valve. The method also includes adjusting a position of the valve catch plunger relative to the lost-motion piston to compensate for changes in valve seating control caused by changes in position of the lost-motion piston as a result of changes in valve train lash.

Related aspects of at least one embodiment of the invention provide a method, e.g., as described above, in which opening the main valve comprises opening a trigger valve to allow fluid to escape from the main valve chamber.

The present invention further provides devices, systems, and methods as claimed.

BRIEF DESCRIPTION OF THE DRAWINGS

The invention will be more fully understood from the following detailed description taken in conjunction with the accompanying drawings, in which:

FIG. 5B is a schematic cross-sectional view of the actuation system and valve train of FIG. 5A when early closing of the engine valve is called for;

DETAILED DESCRIPTION

Certain exemplary embodiments will now be described to provide an overall understanding of the principles of the structure, function, manufacture, and use of the methods, systems, and devices disclosed herein. One or more examples of these embodiments are illustrated in the accompanying drawings. Those skilled in the art will understand that the methods, systems, and devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Although certain methods and devices are disclosed herein in the context of a split-cycle engine and/or an air hybrid engine, a person having ordinary skill in the art will appreciate that the methods and devices disclosed herein can be used in any of a variety of contexts, including, without limitation, non-hybrid engines, two-stroke and four-stroke engines, conventional engines, natural gas engines, diesel engines, etc.

As explained above, in order to operate the split-cycle engines disclosed herein at maximum efficiency, and in particular to operate each of the various air hybrid modes contemplated herein, it is desirable to vary the opening timing and/or closing timing of one or more of the engine's valves.

Figure 1:
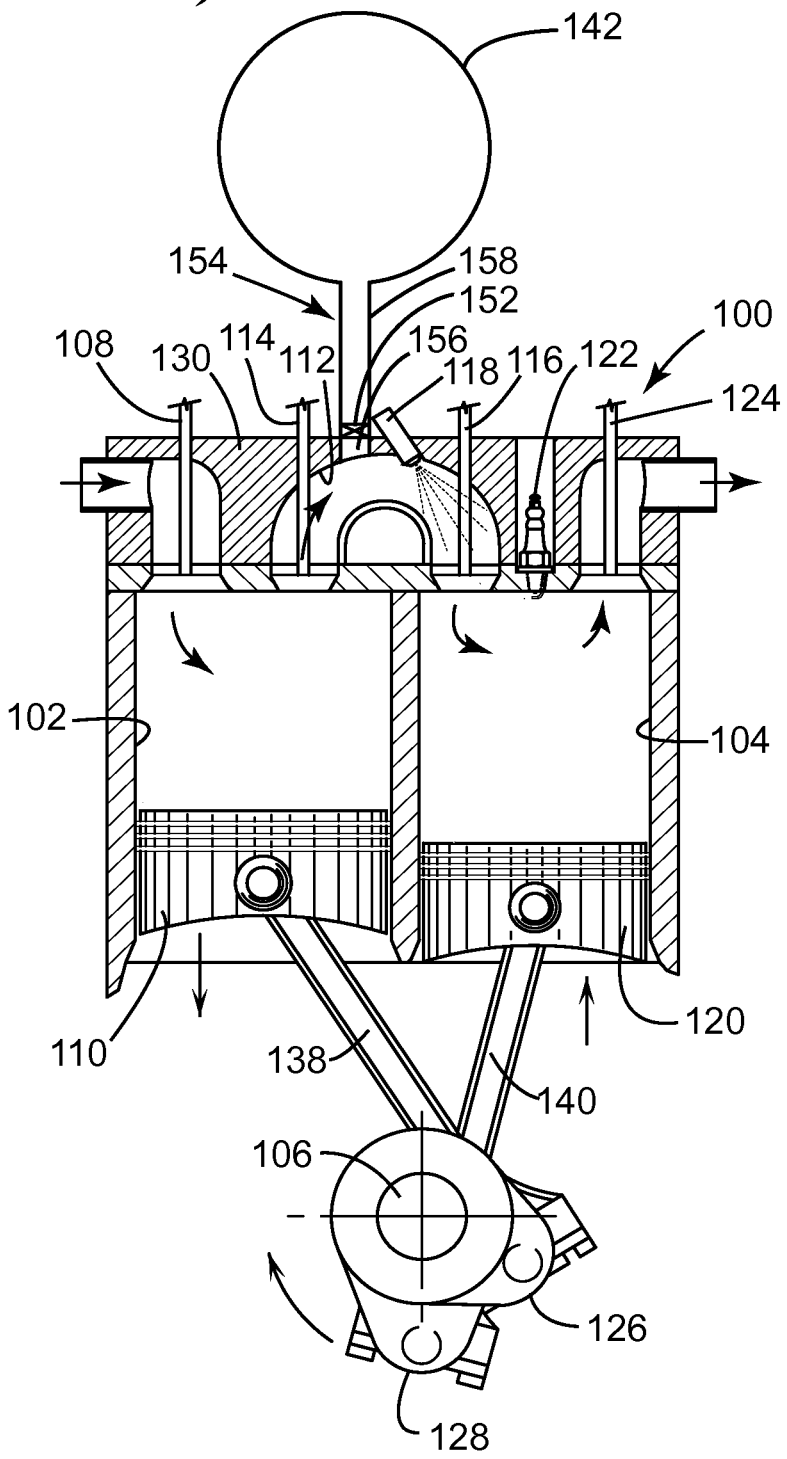
FIG. 1 (Prior Art)
FIG. 1 is a schematic cross-sectional view of a prior art air hybrid split-cycle engine.
Figure 2A:
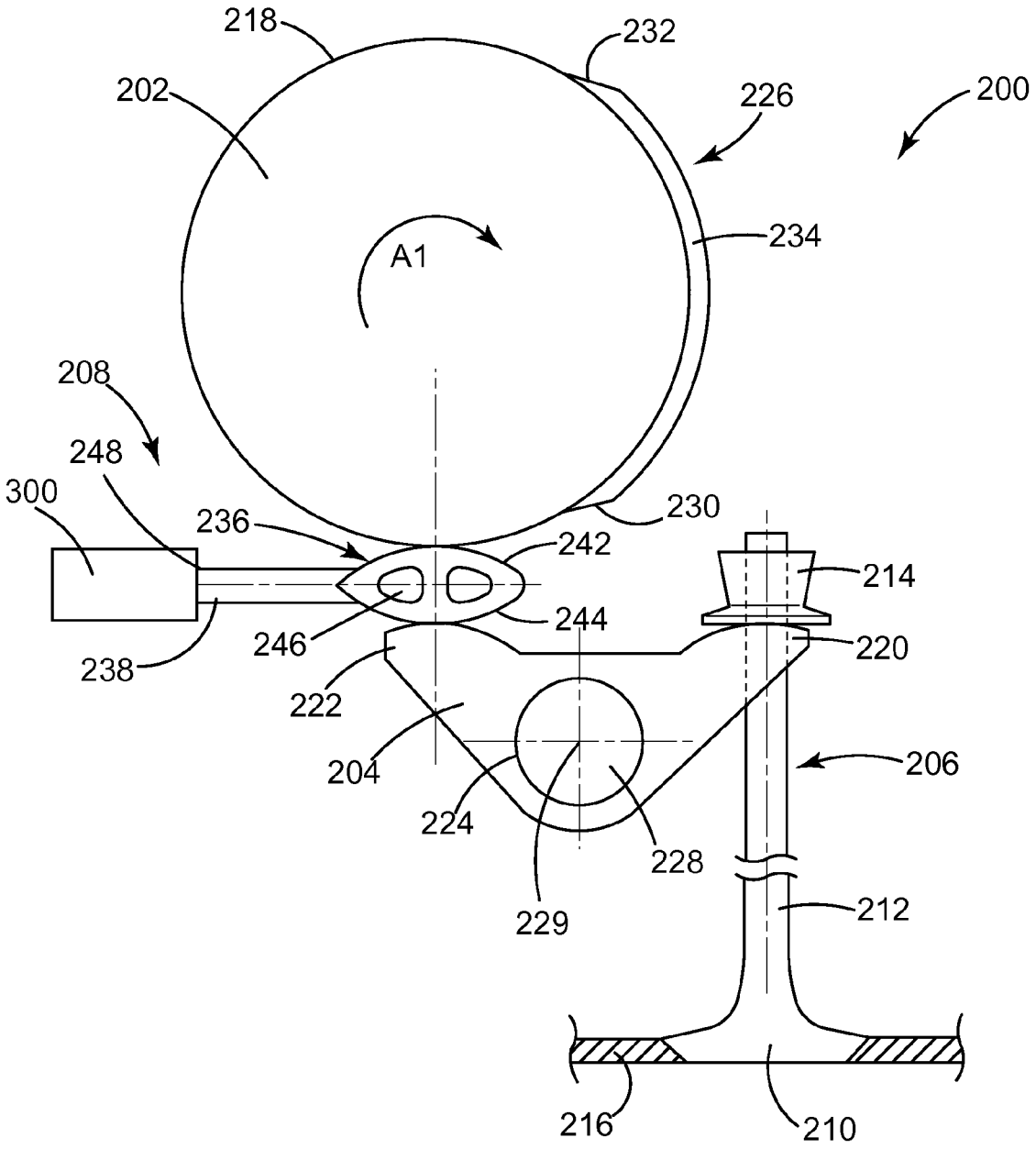
FIG. 2A is a schematic view of one embodiment of a valve train in which a valve is closed.
Figure 2B:
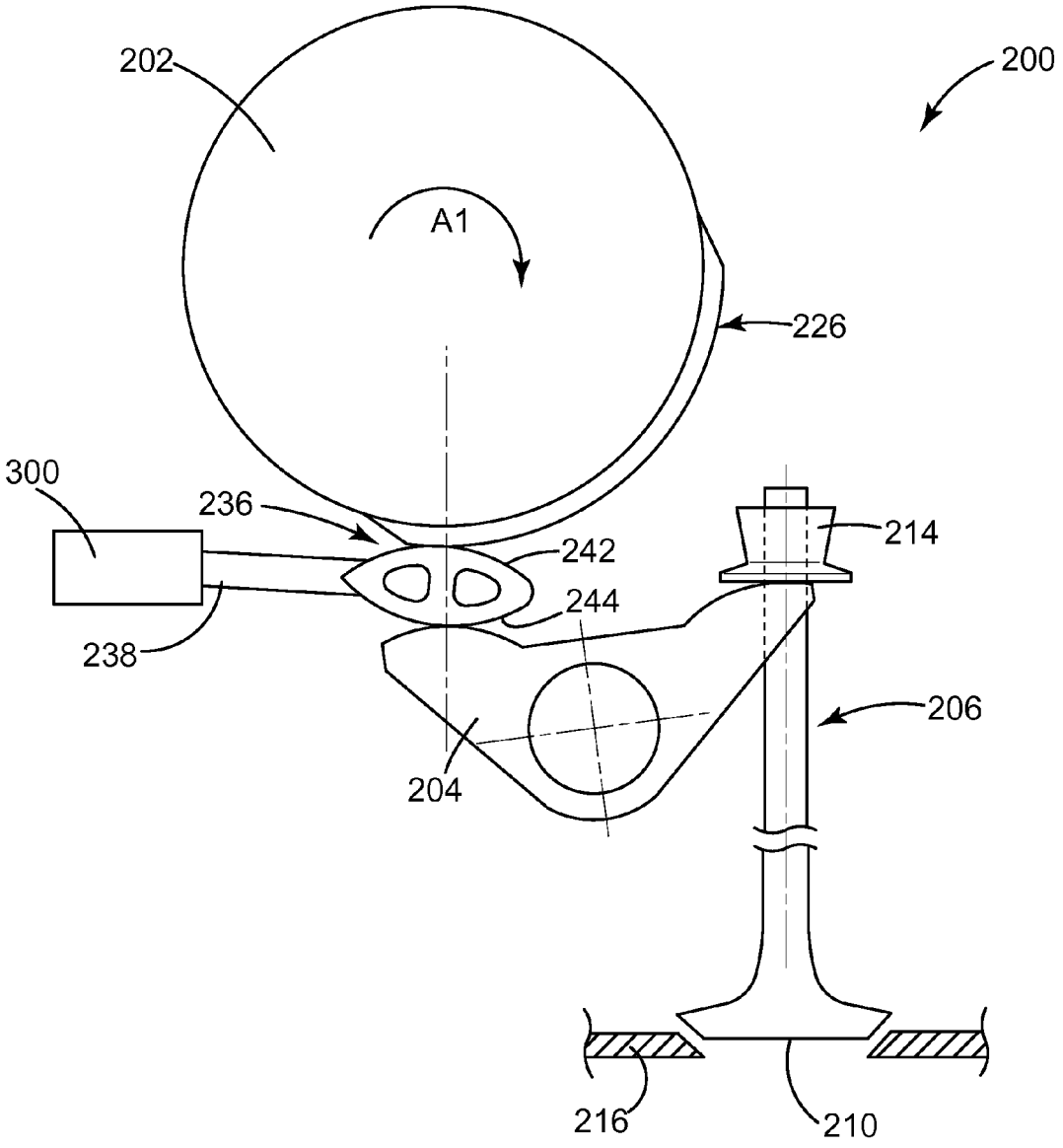
FIG. 2B is a schematic view of the valve train of FIG. 2A in which the valve is opened.
Figure 2C:
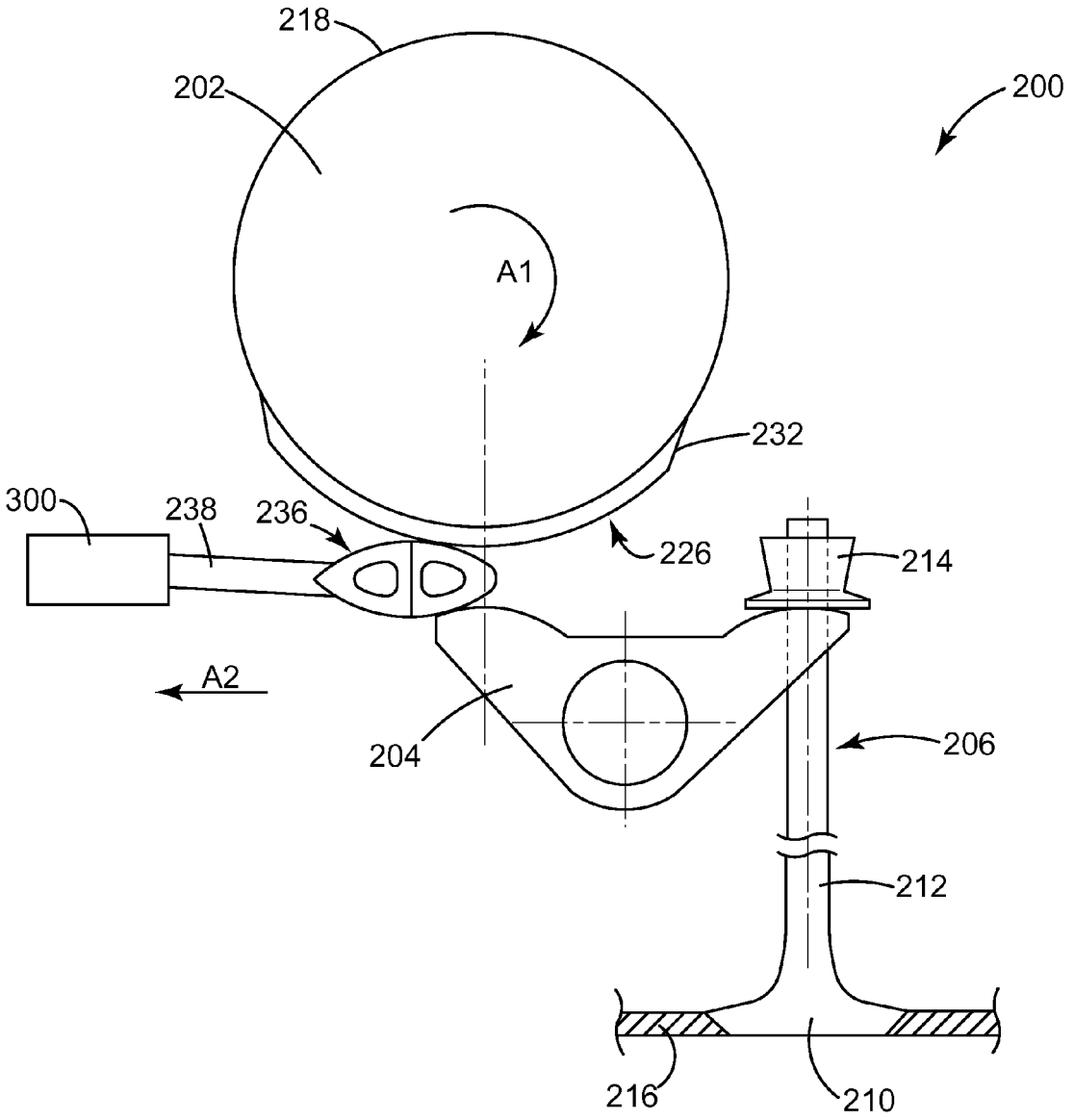
FIG. 2C is a schematic view of the valve train of FIGS. 2A and 2B in which the valve is closed earlier than what is called for by a profile of a cam.

FIGS. 2A-2C illustrate one exemplary embodiment of a valve train 200 suitable for adjusting the opening and closing timing of an engine valve (e.g., by modifying the valve motion proscribed by a cam profile). The illustrated valve train 200 can be used to actuate any of the valves of the engine 100 described above including without limitation the XovrC and XovrE crossover valves. For purposes herein, a valve train of an internal combustion engine is defined as a system of valve train elements, which are used to control the actuation of the valves. The valve train elements generally comprise a combination of actuating elements and their associated support elements. The actuating elements (e.g., cams, tappets, springs, rocker arms, and the like) are used to directly impart the actuation motion to the valves (i.e., to actuate the valves) of the engine during each valve event. The support elements (e.g., shafts, pedestals, and the like) securely mount and guide the actuating elements.

As shown in FIG. 2A, the valve train 200 generally includes a cam 202, a rocker 204, a valve 206, and an adjustable mechanical element 208. The valve train 200 can also include one or more associated support elements, which for purposes of brevity are not illustrated.

The valve 206 includes a valve head 210 and a valve stem 212 extending vertically from the valve head 210. A valve adapter assembly 214 is disposed at the tip of the stem 212 opposite the head 210 and is securely fixed thereto. A valve spring (not shown) holds the valve head 210 securely against a valve seat 216 when the valve 206 is in its closed position. Any of a variety of valve springs can be used for this purpose, including, for example, air or gas springs. In addition, although the illustrated valve 206 is an outwardly-opening poppet valve, any cam actuated valve can be used, including inwardly-opening poppet valves, without departing from the scope of the present invention.

The rocker 204 includes a forked rocker pad 220 at one end, which straddles the valve stem 212 and engages the underside of the valve adapter assembly 214. Additionally, the rocker 204 includes a solid rocker pad 222 at an opposing end, which slidably contacts the adjustable mechanical element 208. The rocker 204 also includes a rocker shaft bore 224 extending therethrough. The rocker shaft bore 224 is disposed over a supporting rocker shaft 228 such that the rocker 204 rotates on the rocker shaft 228 about an axis of rotation 229. Either of the rocker pads 220, 222 can include one or more rollers. One or more roller bearings can also be provided in the rocker shaft bore 224, where the rocker 204 articulates relative to the rocker shaft 228.

The forked rocker pad 220 of the rocker 204 contacts the valve adapter assembly 214 of the outwardly-opening poppet valve 206 such that a downward direction of the rocker pad 222 caused by the actuation of the cam 202 and adjustable mechanical element 208 translates into an upward movement of the rocker pad 220, which in turn opens the valve 206. The geometry of the rocker 204 is selected to achieve a desired ratio of the distance between the forked rocker pad 220 and the axis of the rocker rotation 229 to the distance between the rocker pad 222 and the axis of rocker rotation 229. In one embodiment, this ratio can be between about 1:1 and about 2:1, and preferably about 1.3:1, about 1.4:1, about 1.5:1, about 1.6:1, or about 1.7:1. In addition, the ratio between the peak valve lift and the peak cam lift, which can dictate the diameter of the cam lobe base circle and the cam concavity, can have any of a variety of values. In exemplary embodiments, the ratio between the peak valve lift and the peak cam lift is between about 1.0:1 and about 2.0:1, e.g., about 1.3:1, about 1.5:1, etc.

The cam 202 is a "dwell cam," which as used herein is a cam that includes a dwell section (i.e., a section of the actuating portion of the cam having a constant cam lift) of at least 1 degree CA, and preferably at least 5 degrees CA. In the illustrated embodiment, the dwell cam 202 rotates clockwise (in the direction of the arrow A1). The dwell cam 202 generally includes a base circle portion 218 and an actuating portion 226. As the actuating portion 226 of the cam 202 contacts the adjustable mechanical element 208, the adjustable mechanical element pivots, which then causes the rocker 204 to rotate about the rocker shaft 228 to lift the valve 206 off of its seat 216.

The actuating portion 226 comprises an opening ramp 230, a closing ramp 232, and a dwell section 234. The dwell section 234 can be of various sizes, (i.e., at least 1 degree CA or at least 5 degrees CA) and in the illustrated embodiment, is sized to match the longest possible valve event duration (i.e., maximum valve event) needed over a full range of engine operating conditions and/or air hybrid modes. The opening ramp 230 of the cam 202 is contoured to a shape that adequately achieves the desired lift of the engine valve 206 at the desired rate. The closing ramp 232 (or "refill" ramp) is shaped to control the refill rate of a hydraulic actuation system 300, as described below. Further detail on dwell cams can be found in U.S. Patent Application Publication No. 2012/0192841, filed on Jan. 27, 2012, entitled "SPLIT-CYCLE AIR HYBRID ENGINE WITH DWELL CAM," the entire contents of which are incorporated herein by reference.

The opening timing of the valve 206 can be adjusted by changing the timing within a given engine cycle at which the opening ramp 230 of the cam 202 contacts the adjustable mechanical element 208. In an exemplary embodiment, this is accomplished using a cam phaser which is configured to selectively alter the rotational position of the cam 202 relative to the rotational position of the engine's crankshaft. Further detail on cam phasers and their use to adjust the opening timing of an engine valve can be found in U.S. Patent Publication No. 2012/0192818, filed on Jan. 27, 2012, entitled "LOST-MOTION VARIABLE VALVE ACTUATION SYSTEM WITH CAM PHASER," the entire contents of which are incorporated herein by reference.

The closing timing of the valve 206 can be controlled using the adjustable mechanical element 208. In the embodiment of FIGS. 2A-2C, the adjustable mechanical element 208 includes a bearing element 236, a connecting arm 238, and an actuation system 300.

As shown, the bearing element 236 has a generally elliptical-shaped cross-section defined by opposed first and second bearing surfaces 242, 244, each having a generally convex profile. It will be appreciated that other configurations are also possible, as described below. The bearing element 236 is selectively positioned between the cam 202 and the rocker 204 such that the first bearing surface 242 slidably engages the cam 202 and the second bearing surface 244 slidably engages the rocker pad 222. The bearing element 236 can have one or more cavities 246 formed therein, for example to reduce the overall mass of the bearing element 236 and thus facilitate faster actuation.

The bearing element 236 is coupled to the actuation system 300 via the connecting arm 238, which can be formed integrally with the bearing element 236 or can be coupled thereto by a rotation joint that permits rotation of the bearing element 236 about one or more axes relative to the connecting arm 238. The proximal end 248 of the connecting arm 238 can be mated to the actuation system 300 in a variety of ways, as discussed below. Preferably, the proximal end 248 of the connecting arm 238 is pivotable with respect to the actuation system 300. In other words, the connecting arm 238 is free to rotate about a rotational axis that is substantially transverse to a longitudinal axis of the actuation system 300. As described below, the actuation system 300 is configured to allow the position of the bearing element 238 relative to the cam 202 and rocker 204 to be adjusted.

In operation, the cam 202 rotates clockwise as a camshaft, to which it is mounted, is driven by rotation of the engine's crankshaft. As shown in FIG. 2A, when the base circle portion 218 of the cam 202 engages the bearing element 236, the rocker 204 remains in a "fully closed" position in which the forked rocker pad 220 is either not in contact with or does not apply sufficient lifting force to the valve 206 to overcome the bias of the valve spring, and therefore the valve 206 remains closed.

As shown in FIG. 2B, the actuating portion 226 of the cam 202 engages the first bearing surface 242 of the bearing element 236 during a portion of the cam's rotation. The actuating portion 226 imparts a downward motion to the bearing element 236, causing the connecting arm 238 to pivot in a clockwise direction relative to the actuation system 300. As the connecting arm 238 pivots, some or all of the downward motion of the bearing element 236 is imparted to the rocker 204, which engages the second bearing surface 244 of the bearing element 236. This results in a counterclockwise rotation of the rocker 204, which in turn is effective to lift the valve 206 off of the seat 216. In FIG. 2B, the actuation system 300 is in a "locked" configuration in which the connecting arm 238 and bearing element 236 are held between the cam 202 and rocker 204. In this configuration, some or all of the motion imparted to the bearing element 236 is transferred to the valve 206, lifting it off of the seat 216. In other words, with the actuation system 300 in the locked configuration, the motion of the valve 206 will substantially follow the profile of the cam 202 according to the geometry of the actuation elements of the valve train.

As shown in FIG. 2C, the valve train 200 is capable of closing the valve 206 before the closing ramp 232 of the cam 202, as the cam rotates, reaches the bearing element 236. For example, the actuation system 300 can be transitioned to an "unlocked" configuration in which the connecting arm 238 and bearing element 236 are allowed to move in the direction of the arrow A2. Such movement is encouraged by a squeezing force in the direction of the arrow A2, which pushes the bearing element 236 away from the cam 202 and the rocker 204. The squeezing force is generated by a combination of the force of the valve spring biasing the rocker arm 204 in a clockwise direction, the force of the cam's actuating portion 226 rotating against the bearing element 236 in a clockwise direction, and the net force imparted to the valve head 210 by fluid pressure within the engine cylinder or crossover passage. It will be appreciated that the squeezing force can be only a minor component of the force acting on the bearing element 236, and that the bearing element 236 can be shaped such that the majority of the force of the cam 202 is applied downwards onto the rocker pad 222 and vice versa.

As shown in FIG. 2C, when the actuation system 300 is unlocked, the bearing element 236 can be withdrawn far enough from the cam 202 and the rocker 204 such that insufficient motion is imparted from the actuating portion 226 of the cam 202 to the rocker 204 for the valve 206 to actually be lifted off of the seat 216, and thus the valve 206 closes or remains closed. The valve train 200 thus provides a lost-motion feature that allows for variable valve actuation (i.e., permits the valve 206 to close at an earlier time than that provided by the profile of the cam 202). The valve train 200 is therefore configured to transmit all of the cam motion to the valve 206, to transmit only a portion of the cam motion to the valve 206, or to transmit none of the cam motion to the valve 206.

As discussed below, the actuation system 300 can also be configured to take up any lash that may exist in the valve train 200, for example due to thermal expansion and contraction, component wear, etc. For purposes herein, the terms "valve lash" or "lash" are defined as the total clearance existing between the rocker pad 220 and the valve adapter assembly 214 when all of the other components of the valve train 200 are positioned in such a way as to have no other clearance other than the clearance between the rocker pad 220 and the valve adapter assembly 214 when the valve 206 is fully seated. The valve lash is equal to the total contribution of all the individual clearances between all individual valve train elements (i.e., actuating elements and support elements) of the valve train 200. In the valve train 200, the actuation system 300 biases the bearing element 236 towards the cam 202 and the rocker 204 such that any lash that may exist in the valve train 200 is taken up by the gradually increasing thickness of the bearing element 236. The biasing force can be relatively low, such that once the lash is taken up by the bearing element 236, the bearing element 236 is not advanced further towards the cam 202 or rocker 204. In this manner, the lash is taken up without the valve 206 opening during a period when it should be closed.

Figure 3:
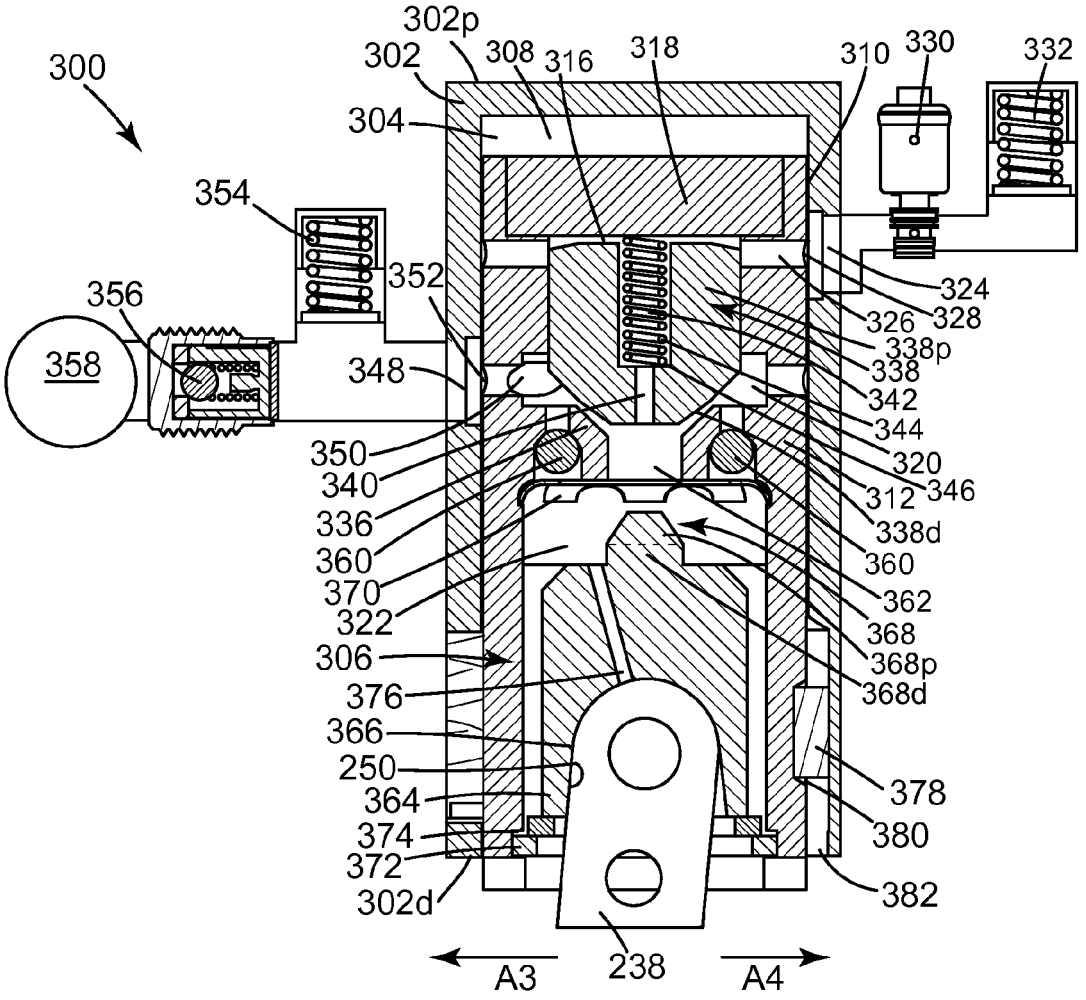
FIG. 3 is a schematic cross-sectional view of one embodiment of an actuation system.

FIG. 3 illustrates one exemplary embodiment of the actuation system 300. As shown, the system 300 includes a cylindrical housing 302 having a bore 304 formed therein, the bore extending from an open distal end 302*d* of the housing 302 to a closed proximal end 302*p* of the housing 302. An autolash piston 306 is slidably disposed within the bore 304. An autolash plenum 308 is formed by the clearance space between the proximal end of the autolash piston 306 and the closed proximal end 302*p* of the housing 302. A small clearance space 310 also exists between the outer surface of the autolash piston 306 and the housing 302 such that the autolash plenum 308 can be gradually filled with or drained of fluid (e.g., over the span of one or several engine cycles). Any lash that would otherwise exist in the valve train 200 is taken up by this leakage filling of the autolash plenum 308, which forces the autolash piston 306 distally and advances the bearing element 236 towards the cam 202 and rocker 204 to take up any lash in the valve train 200.

The autolash piston 306 includes a dividing wall 312 that defines two generally cylindrical chambers. A proximal chamber 316 is defined between a plug 318 that forms the proximal end of the autolash piston 306 and the dividing wall 312. A distal chamber 322 is defined between the dividing wall 312 and the open distal end of the autolash piston 306.

The proximal chamber 316 is in fluid communication with a first opening 324 formed in the housing 302 via one or more holes 326 extending from the proximal chamber 316, through the sidewall of the autolash piston 306, and into a first annular groove 328 formed in the external surface of the autolash piston 306. The first opening 324 in the housing 302 has a height greater than the height of the first annular groove 328, such that fluid communication is maintained between the two regardless of the position of the autolash piston 306 relative to the housing 302. In other words, fluid communication is maintained both when a small amount of lash is taken up and the autolash piston 306 is near the proximal end of its stroke, and when a large amount of lash is taken up and the autolash piston 306 is near the distal end of its stroke.

The first opening 324 in the housing 302 is coupled to a hydraulic circuit that includes a high-speed trigger (or pilot) valve 330 and a trigger (or pilot) accumulator 332. The trigger valve 330 can be actuated (e.g., under the control of a engine control computer or other electronic controller) to selectively place the proximal chamber 316 in fluid communication with the trigger accumulator 332. Any of a variety of trigger valves can be used, such as solenoid-type valves available from Jacobs Vehicle Systems, Inc. of Bloomfield, Conn. In one embodiment, the high-speed trigger valve 330 has a volume of 0.492 $cm^3$ and a 0.8 ms actuation time.

A main valve 338 is slidably disposed in the proximal chamber 316 such that it can travel between a fully closed position (in which a distal tapered portion 338*d* of the main valve 338 is seated against a valve seat 336 formed in the dividing wall 312) and a fully-opened position (in which the main valve 338 approaches and/or contacts the plug 318 that defines the proximal extent of the proximal chamber 316).

The main valve 338 has a proximal portion 338*p* that is generally cylindrical and a distal portion 338*d* that is tapered. In one embodiment, the proximal portion 338*p* has an outside diameter of approximately 11 mm and the distal portion 338*d* has an outside diameter of approximately 5 mm at the contact line where the tapered distal portion 338*d* contacts the valve seat 336. In this exemplary embodiment, the distal portion 338*d* tapers further distally from the contact line until it terminates at a distal end having an outside diameter that is less than approximately 5 mm. The taper of the distal portion 338*d* can be linear (e.g., the distal portion 338*d* can be conical or frustoconical) or non-linear (e.g., the distal portion 338*d* can have a shape of some other solid of revolution). An orifice 340 formed through the distal portion 338*d* is in fluid communication with a central lumen 342 formed in the proximal portion 338*p*, in which a bias spring 344 is disposed. The bias spring 344 is compressed between the plug 318 and a shoulder 346 formed at the junction of the orifice 340 and the lumen 342 such that the spring 344 biases the main valve 338 towards the fully-closed position. In one embodiment, the bias spring 344 has a preload of approximately 50N and a stiffness of approximately 13N/mm.

The orifice 340 and the central lumen 342 together define a fluid passageway that extends all the way through the valve 338, which facilitates pressure balancing across the valve 338 as discussed below. In one embodiment, the orifice 340 can have a diameter of approximately 1 mm.

The main valve 338 can optionally be a multi-component device formed from one or more different materials. For example, the exterior of the main valve 338 can be formed from steel to provide stiffness and favorable thermal expansion and contraction properties, while the core of the main valve 338 can be formed from aluminum, resin, or plastic to reduce the weight of the valve 338 and increase its reaction time.

A middle chamber 320 of generally annular shape is formed below the main valve 338 adjacent to the main valve seat 336. The middle chamber 320 is in fluid communication with a second opening 348 formed in the housing via one or more holes 350 extending from the middle chamber 320, through the sidewall of the autolash piston 306, and into a second annular groove 352 formed in the external surface of the autolash piston 306. The second opening 348 has a height greater than the height of the second annular groove 352, such that fluid communication is maintained between the two regardless of the position of the autolash piston 306 relative to the housing 302. In other words, fluid communication is maintained both when a small amount of lash is taken up and the autolash piston 306 is near the proximal end of its stroke, and when a large amount of lash is taken up and the autolash piston 306 is near the distal end of its stroke.

The second opening 348 in the housing 302 is coupled to a hydraulic circuit that includes a main accumulator 354 and check valve 356 coupled to a hydraulic fluid source 358 (e.g., the oil supply of an engine in which the actuation system 300 is installed). The check valve 356 permits one-way flow of fluid from the source 358 to the middle chamber 320. The main accumulator 354 is positioned in close proximity to the housing 302, which is preferred over alternative arrangements (such as those in which the accumulator 354 is omitted in favor of a long threading back to the engine oil supply) because it allows fluid to be supplied to refill the middle chamber 320 and distal chamber 322 very quickly.

The dividing wall 312 includes the valve seat 336 and one or more refill check valves 360 which permit one-way flow of fluid from the middle chamber 320 to the distal chamber 322. In one embodiment, four check valves 360 are provided in the dividing wall 312, spaced approximately 90 degrees apart from one another about the circumference of the valve seat 336. The use of multiple small check valves 360 provides a faster reaction time than a single large check valve, allowing a large aggregate flow area to be provided very quickly. A seating control opening 362 extends through the valve seat 336 and the dividing wall 312 to provide a fluid passageway between the distal chamber 322 and the middle chamber 320.

A lost-motion piston 364 is slidably disposed in the distal chamber 322 and is coupled to the connecting arm 238 of the valve train 200. The lost-motion piston 364 can be coupled to the connecting arm 238 in any of a variety of ways, as described in detail below. In the illustrated embodiment, the proximal end of the connecting arm 238 has a male curved surface 250 that forms part of a cylinder. The male curved surface 250 is seated within a corresponding female recess 366 formed in the distal end of the lost-motion piston 364, such that the connecting arm 238 can pivot relative to the lost-motion piston 364 in the direction of the illustrated arrows A3, A4. In one embodiment, the lost-motion piston 364 has a diameter of between about 10 mm and about 14 mm. Preferably, the lost-motion piston 364 has a diameter of about 12 mm.

The lost-motion piston 364 includes a seating control protrusion 368 that extends from the proximal-facing surface of the lost-motion piston 364 and that is sized to be received in the seating control opening 362 of the dividing wall 312. The seating control protrusion 368 can have a variety of shapes and sizes depending on the valve deceleration profile that is desired, as will be understood by one skilled in the art. In the illustrated embodiment, the seating control protrusion 368 includes a generally cylindrical distal portion 368*d* and a tapered proximal portion 368*p*. The taper of the proximal portion 368*p* can be linear or non-linear.

Figure 4A:
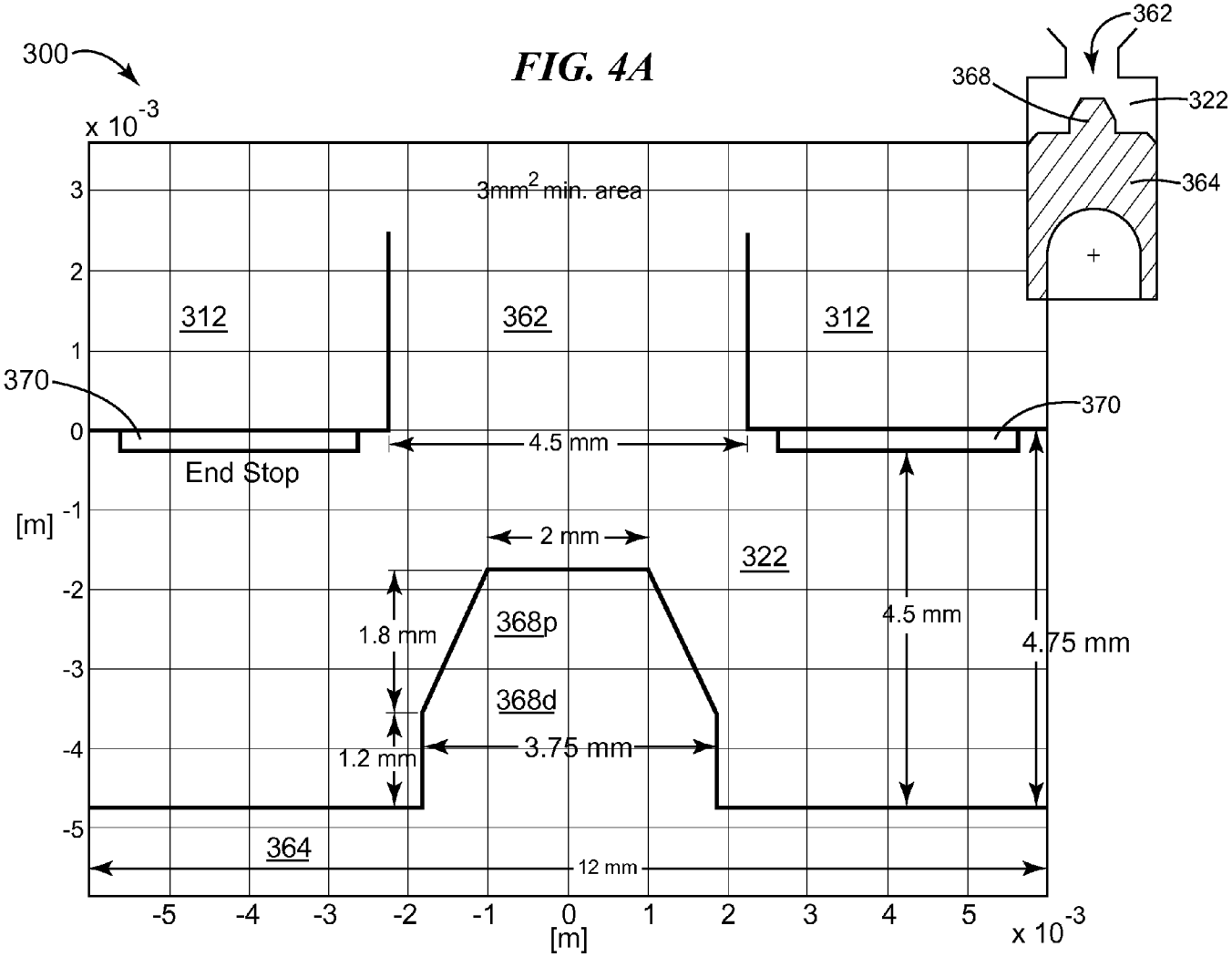
FIG. 4A is a schematic diagram of a seating control opening and a seating control protrusion formed on a lost-motion piston.

The dimensions of the lost-motion piston 364 and the distal chamber 322 in one exemplary embodiment of the actuation system 300 are shown in FIG. 4A. As shown, the lost-motion piston 364 has an outside diameter of 12 mm. The seating control protrusion 368 has a cylindrical distal portion 368*d* with a height of 1.2 mm and a diameter of 3.75 mm. The seating control protrusion 368 also includes a proximal tapered portion 368*p* that tapers linearly from a diameter of 3.75 mm to a diameter of 2 mm over a height of 1.8 mm. The diameter of the seating control opening 362 is 4.5 mm. At the distal extent of its stroke, the proximal-facing surface of the lost-motion piston 364 is 4.75 mm from the distal-facing surface of the dividing wall 312 and 4.5 mm from the distal-facing surface of one or more end stop protrusions 370 formed on the dividing wall 312. As the lost-motion piston 364 translates proximally within the distal chamber 322, the seating control protrusion 368 enters the seating control opening 362, thereby forming a variable area flow opening.

Figure 4B:
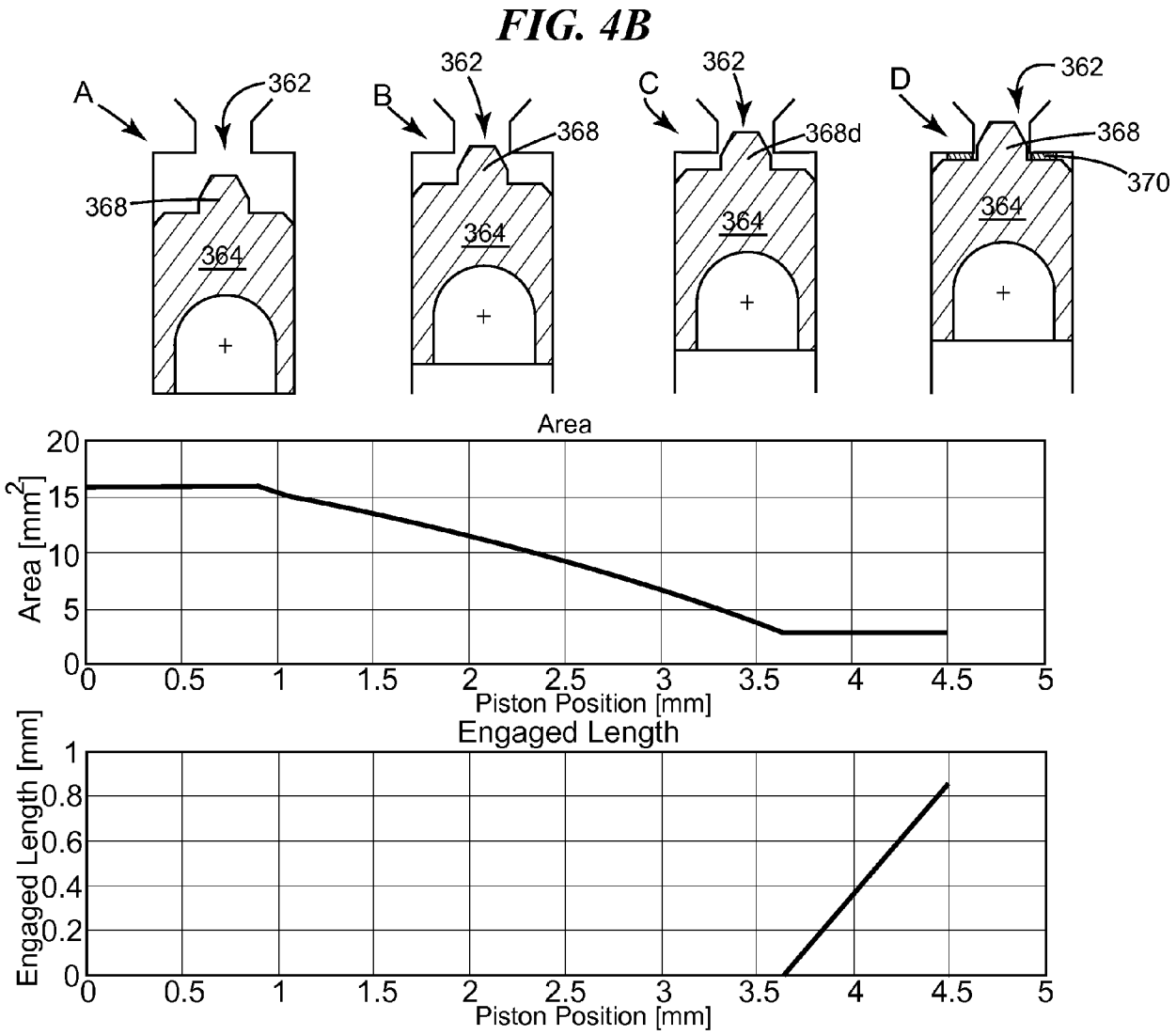
FIG. 4B is a plot of seating control opening area as a function of lost-motion piston position and a plot of seating control protrusion engaged length as a function of lost-motion piston position.

FIG. 4B plots the opening area as a function of lost-motion piston 364 position for the embodiment of FIG. 4A. As shown, the area of the seating control opening 362 is approximately 16 $mm^2$ when the lost-motion piston 364 is at position A (a position in which the seating control protrusion 368 is not within the seating control opening 362). When the lost-motion piston 364 is at position B (a position in which the seating control protrusion 368 begins to enter the seating control opening 362), the area of the opening 362 begins to decrease. The area decreases substantially linearly until the lost-motion piston 364 advances proximally to position C (a position in which the distal cylindrical portion 368*d* of the seating control protrusion 368 begins to enter the seating control opening 362), at which point the opening 362 reaches its minimum area of approximately 3 $mm^2$. The area continues to be 3 $mm^2$ at position D (a position in which the proximal-facing surface of the lost-motion piston 364 is in contact with the end stops 370 formed on the distal-facing surface of the dividing wall 312). The lower plot in FIG. 4B shows the engaged length (the length of the distal cylindrical portion 368*d* of the seating control protrusion 368 that lies within the seating control opening 362) as a function of lost-motion piston 364 position.

Referring again to FIG. 3, proximal movement of the lost-motion piston 364 is limited by the end stops 370 formed on the dividing wall 312, whereas distal movement of the lost-motion piston 364 is limited by a retaining clip 372 mounted within a recess 374 formed at the distal end of the autolash piston 306 and/or by other valve train components such as the cam 202 and rocker 204. It will be appreciated that in some embodiments, the retaining clip 372 can be eliminated and the distal travel of the lost-motion piston 364 can be limited solely by the connecting arm 238, cam 202, and rocker 204. This can advantageously permit a greater degree of angular rotation of the connecting arm 238 relative to the lost-motion piston 364.

A lubrication aperture 376 is formed in the lost-motion piston 364 to allow fluid to flow from the distal chamber 322 into the pivot joint formed between the lost-motion piston 364 and the connecting arm 238. When the actuation system 300 is loaded by the valve train 200, the connecting arm 238 is seated firmly against the lubrication aperture 376, preventing fluid in the distal chamber 322 from escaping therethrough. Later, when the bearing element 236 is on the base circle 218 of the cam 202 and the loading of the actuation system 300 is reduced, the connecting arm 238 lifts off of the aperture 376 slightly, creating a small path for fluid to enter the pivot joint and lubricate the contact surfaces 250, 366. In one embodiment, this path has a height between about 2 micrometers and about 3 micrometers.

A rotation lock 378 is provided to maintain the autolash piston 306 in a substantially fixed rotational orientation relative to the housing 302. A first portion of the rotation lock 378 extends into a recess 380 formed in the exterior of the autolash piston 306 while a second portion of the rotation lock 378 extends into a recess 382 formed in the interior of the housing 302. The resulting interference prevents rotation of the autolash piston 306 relative to the housing 302. In a variation on the illustrated system 300, the annular grooves 328, 352 can be omitted and instead single openings 326, 350 on only one side of the autolash piston 306 can be provided to allow fluid communication between the proximal and middle chambers 316, 320 and the first and second openings 324, 348, respectively. In this case, the rotational alignment provided by the rotation lock 378 ensures that the single openings 326, 350 remain substantially aligned with the openings 324, 348 in the housing 302. An advantage to this variation is that eliminating the annular grooves 328, 352 reduces the overall fluid volume, which increases the stiffness of the actuation system 300.

Figure 5A:
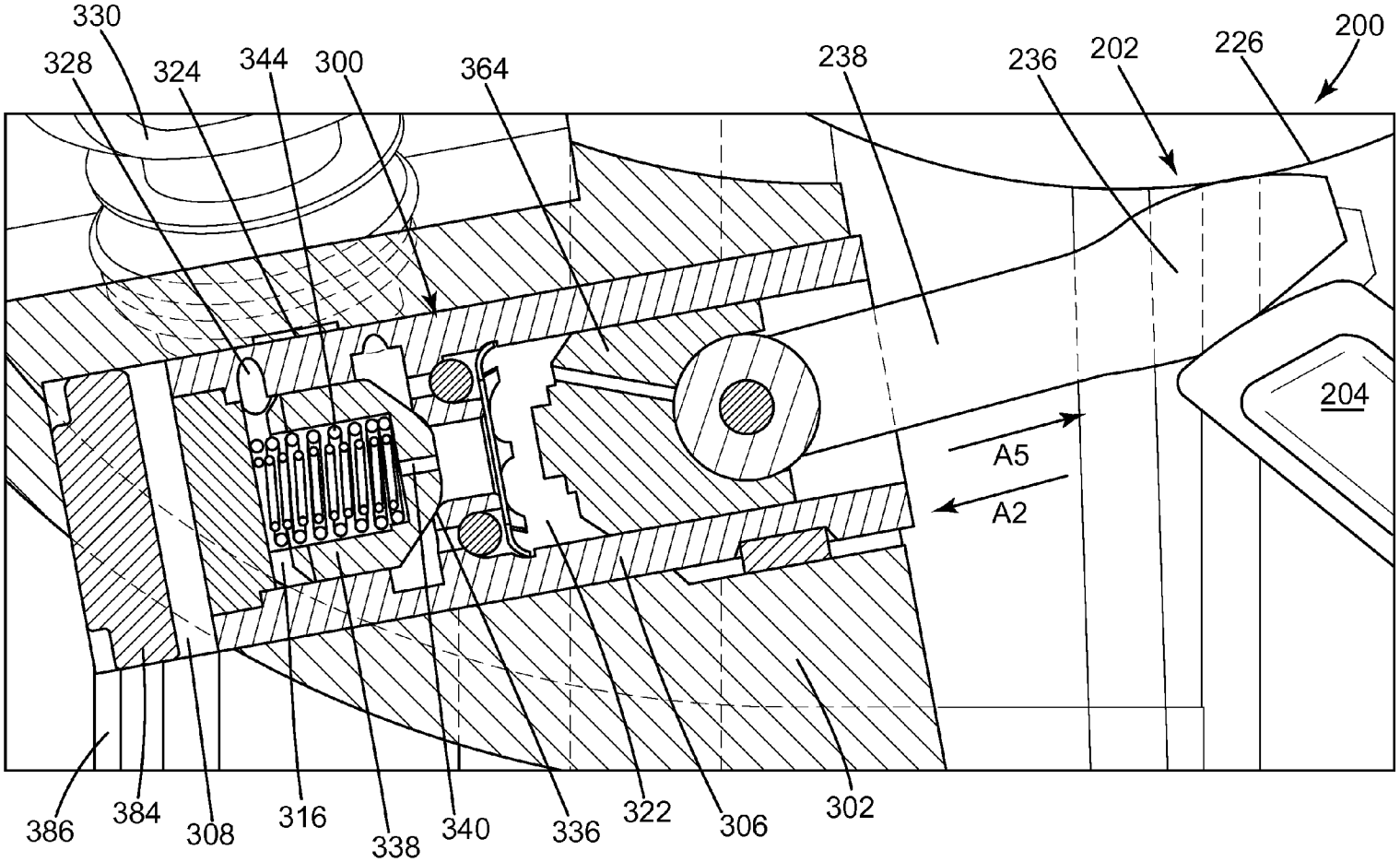
FIG. 5A is a schematic cross-sectional view of the actuation system of FIG. 3 when a bearing element of a valve train is pressed against an actuating portion of a cam, and when an engine valve of the valve train is open.

Operation of the actuation system 300 is described below with reference to FIGS. 5A-5E. In FIG. 5A, the actuating portion 226 of the cam 202 is in contact with the bearing element 236, which is fully advanced in the direction of arrow A5 towards the cam 202 and rocker 204. The actuating portion 226 of the cam 202 bears against the bearing element 236, causing the connecting arm 238 to pivot relative to the lost-motion piston 364 and causing the rocker 204 to rotate counterclockwise to open the outwardly-opening engine valve. The valve train 200 is thus configured as shown schematically in FIG. 2B.

At this time, the bearing element 236 is loaded in the direction of arrow A2 by the cam rotation, the valve spring acting on the rocker 204, and net cylinder/port pressure acting on the engine valve head. This loading causes the pressure to rise in the distal chamber 322 of the actuation system 300. With the high-speed trigger valve 330 closed, the pressure in the proximal chamber 316 approximates that of the distal chamber 322, as fluid is unable to escape from the proximal chamber 316 and the pressure from the distal chamber 322 is communicated to the proximal chamber 316 through the orifice 340 in the main valve 338. Although the pressure is substantially the same, the main valve 338 is held closed against its seat 336 because the surface area of the main valve 338 exposed to the proximal chamber 316 is greater than the surface area of the main valve 338 exposed to the distal chamber 322. In addition, the main valve bias spring 344 helps hold the main valve 338 in the closed position, particularly during transient pressure fluctuations. Preferably, the volume of the proximal chamber 316 above the main valve 338 is small relative to the volume of the distal chamber 322. This allows the pressure across the main valve 338 to be balanced quickly, preventing the valve 338 from inadvertently popping open when the lost-motion piston 364 is loaded by the valve train 200. At the same time, the volume of the proximal chamber 316 above the main valve 338 must be large enough to allow the main valve 338 to open far enough to achieve the desired flow rate therethrough. The volume of the proximal chamber 316 includes the first annular groove 328 and the fluid line running to the trigger valve 330, and therefore to help balance this tradeoff, the trigger valve 330 can be positioned in very close proximity to the proximal chamber 316 to keep the volume down.

During this time, the pressure in the autolash plenum 308 is less than the pressure in the distal chamber 322 because the autolash piston 306 has a diameter greater than that of the lost-motion piston 364. This results in leakage flow from the first opening 324 in the housing 302, across the exterior surface of the autolash piston 306, and into the autolash plenum 308. As the plenum 308 is filled, the autolash piston 306 advances distally to take up any lash in the valve train 200. A leakage path 384 from the autolash plenum 308 to a drain 386 is also provided to prevent overfilling the autolash plenum 308 and progressively jacking the engine valve 206 from one cycle to the next.

Figure 5B:
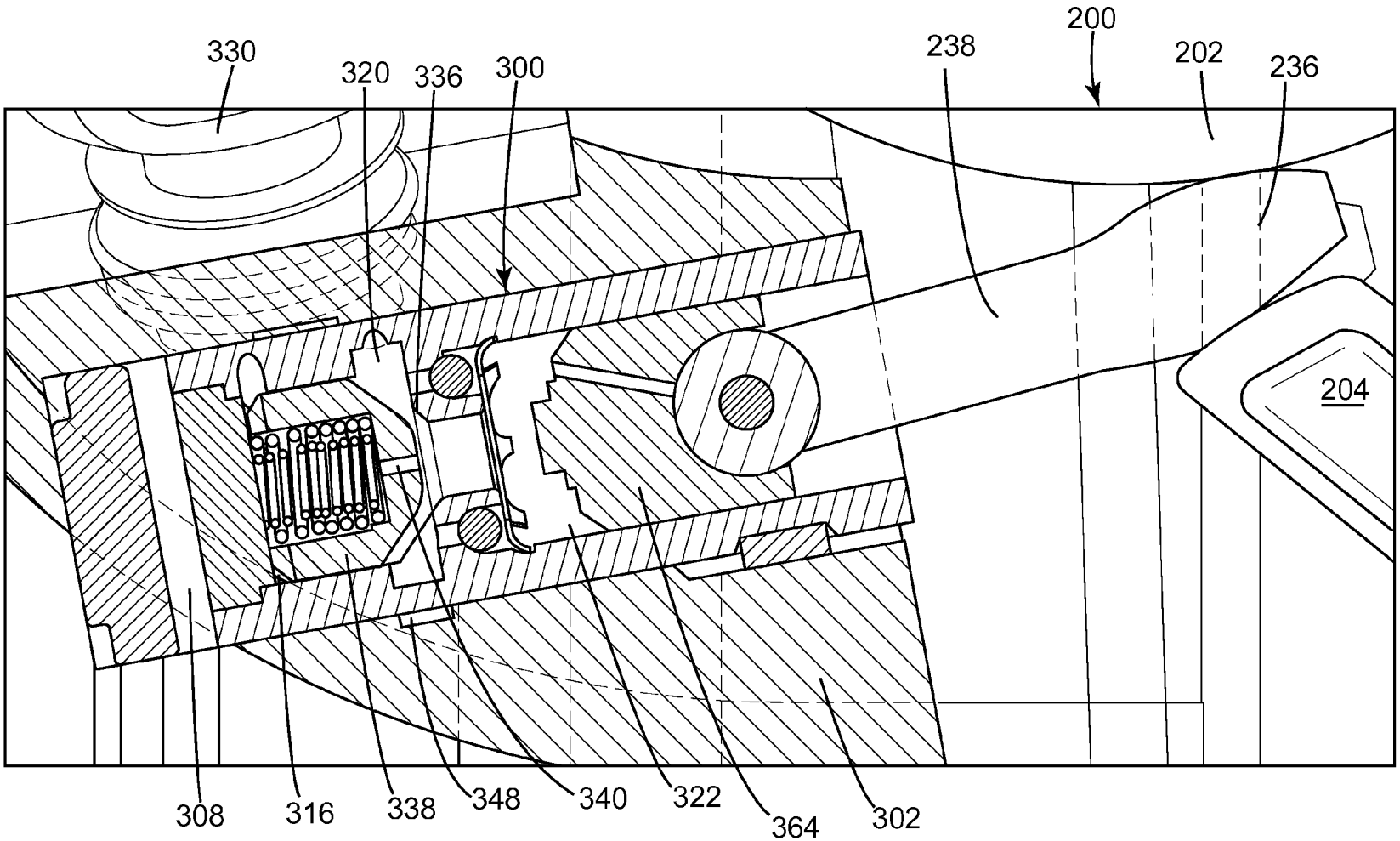

As shown in FIG. 5B, the actuation system 300 can be actuated to close the engine valve 206 early (i.e., before the closing ramp 232 of the cam 202 is reached). When valve closing control is called for, the high-speed trigger valve 330 is opened, which allows the pressurized fluid in the proximal chamber 316 to flow into the trigger accumulator 332 (shown in FIG. 3). Fluid also begins to flow from the distal chamber 322, through the main valve orifice 340, and into the proximal chamber 316 and trigger accumulator 332. The size of the orifice 340 is small enough, however, that the fluid cannot flow fast enough to balance the pressure across the main valve 338. The resulting pressure differential causes the main valve 338 to slide proximally, opening off of its seat 336. With the main valve 338 open, the forces acting on the lost-motion piston 364 drive it proximally within the distal chamber 322, evacuating fluid into the middle chamber 320, through the second opening 348 in the housing 302, and into the main accumulator 354 (shown in FIG. 3). It will thus be appreciated that the size of the orifice 340 in the main valve 338 is critical to operation of the actuation system 300. The orifice 340 must be small enough so that, when the system 300 is actuated, the main valve 338 opens instead of pressure just flowing through the orifice 340. At the same time, the orifice 340 must be big enough to allow pressure across the valve 338 to balance quickly as described above with respect to FIG. 5A. In an exemplary embodiment, the orifice has a diameter of about 1 mm.

As the lost-motion piston 364 moves proximally within the distal chamber 322, the connecting arm 238 and bearing element 236 are partially ejected from the cam 202 and rocker 204 interface. The portion of the bearing element 236 positioned between the cam 202 and rocker 204 when it is partially ejected is thinner than the portion that is so-positioned when the bearing element 236 is fully inserted. As a result, the rocker 204 begins to rotate clockwise to close the engine valve 206. This is illustrated schematically in FIG. 2C. Leakage flow into the autolash plenum 308 continues at this time, such that contact is maintained at all times between the cam 202, the bearing element 236, and the rocker 204.

Figure 5C:
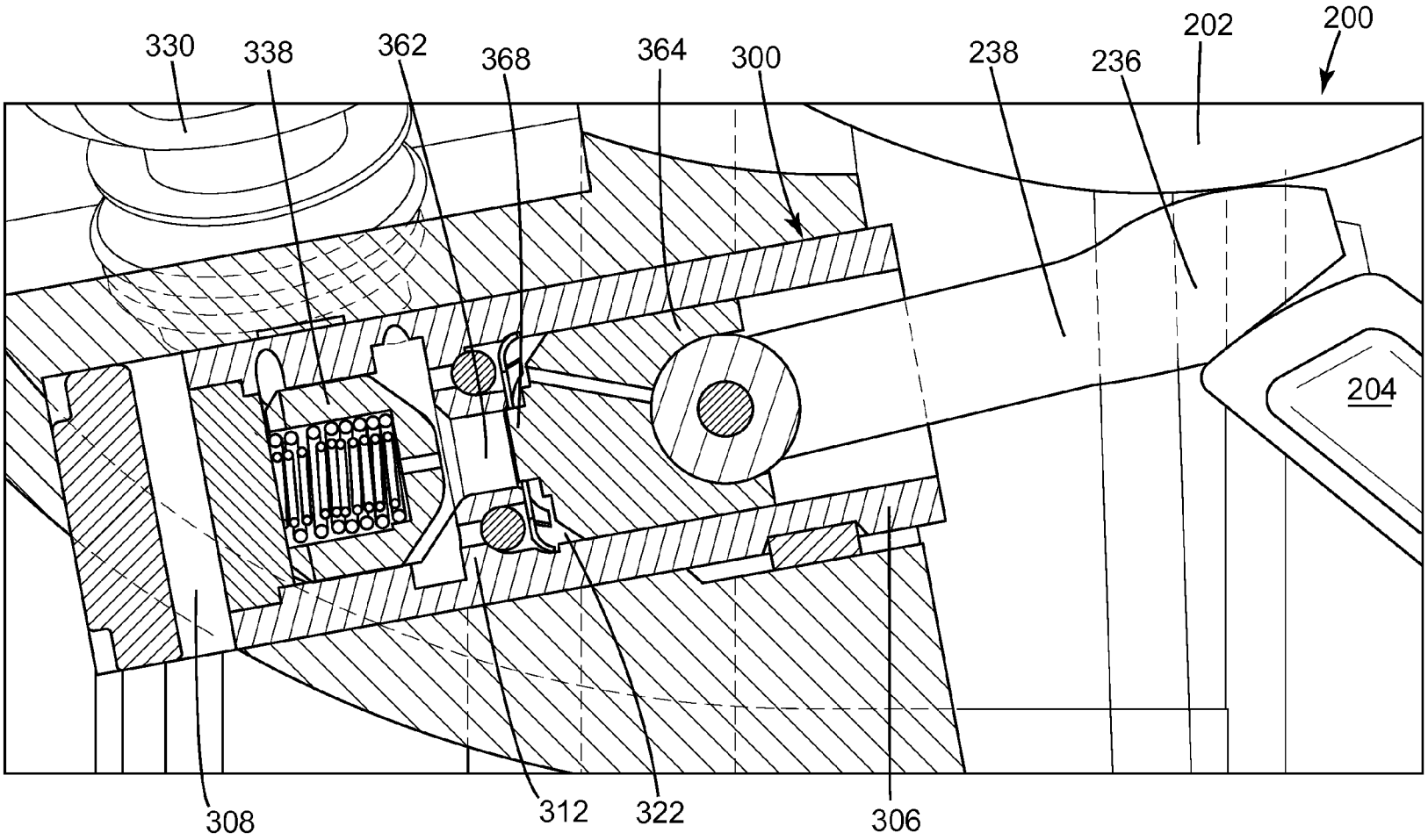
FIG. 5C is a schematic cross-sectional view of the actuation system and valve train of FIG. 5A during a seating control phase of operation.

As shown in FIG. 5C, the actuation system 300 performs a valve catch function to slow the velocity of the engine valve 206 as it approaches its seat 216 with the peak dwell portion of the cam 202 active. In particular, as the engine valve 206 approaches its seat 216, the seating control protrusion 368 on the lost-motion piston 364 begins to enter the seating control opening 362 formed in the dividing wall 312, throttling the flow of fluid out of the distal chamber 322. The tapered shape of the seating control protrusion 368, coupled with the cylindrical seating control opening 362 defines a valve catch orifice having an area that decreases progressively as the engine valve 206 gets closer to its seat. The decreasing area causes the pressure in the distal chamber 322 to increase, slowing the engine valve 206. The autolash function ensures that a consistent relationship, regardless of thermal expansion and contraction and wear of the valve train 200 components, exists between the position of the lost-motion piston 364 relative to the autolash piston 306 and the lift of the engine valve 206 relative to its valve seat 216 when the peak dwell portion of the cam 202 is active. This prevents the seating control function from starting too early or too late relative to the engine valve 206 approaching its valve seat 216.

Figure 5D:
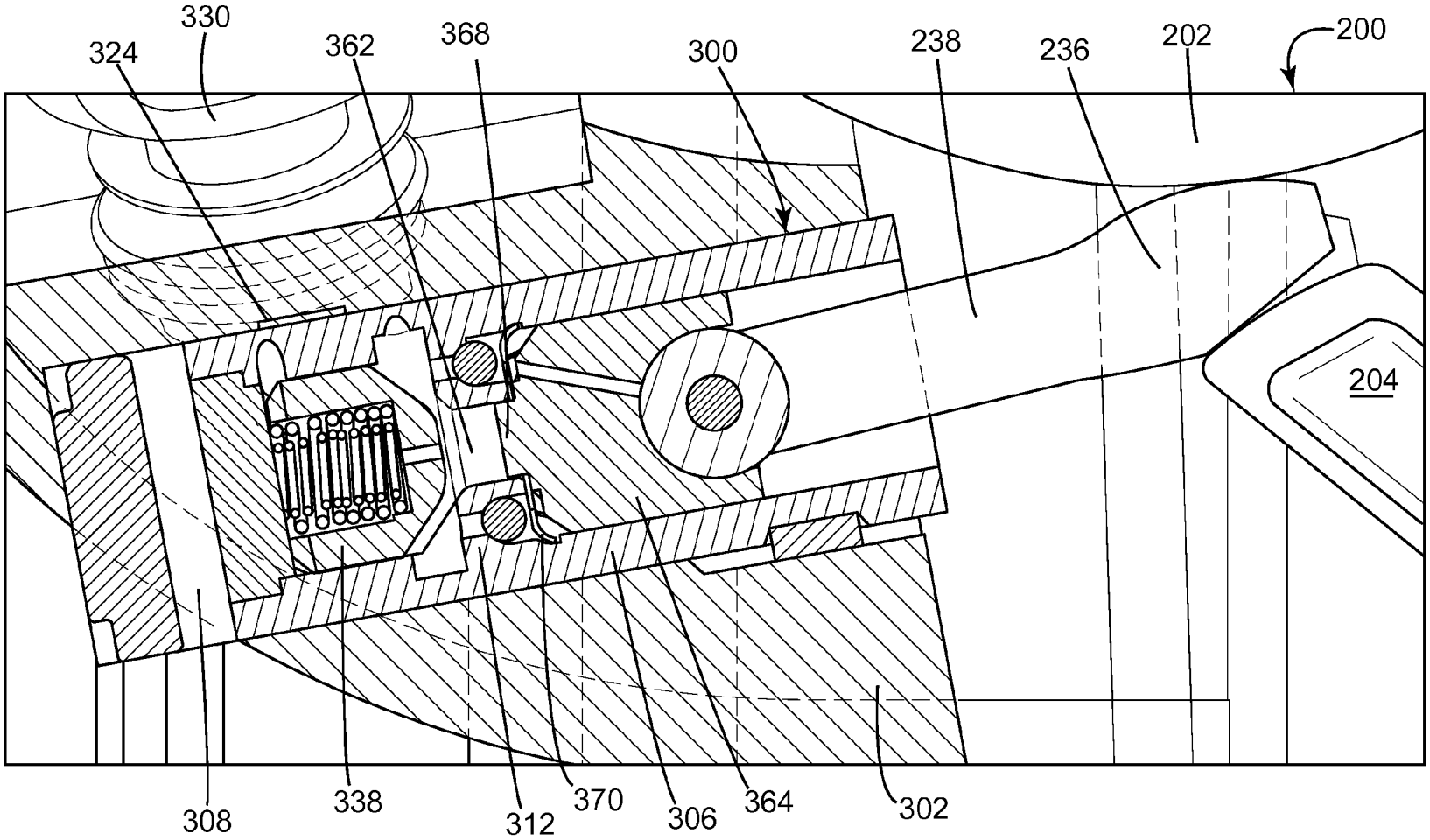
FIG. 5D is a schematic cross-sectional view of the actuation system and valve train of FIG. 5A when the engine valve is fully closed.

When the lost-motion piston 364 eventually contacts the end stops 370 on the dividing wall 312, as shown in FIG. 5D, the orifice area between the seating control protrusion 368 and the seating control opening 362 goes to zero and a squeeze film contact effect helps to seat the engine valve 206 at the required low velocity. As the engine valve 206 is decelerated, the loading on the autolash piston 306 increases the pressure in the autolash plenum 308. As a result, fluid leaks out of the autolash plenum 308 and through the first opening 324 in the housing 302 to the lower pressure trigger accumulator 332 (best seen in FIG. 3). Eventually, the engine valve 206 completely closes against its seat 216, at which point the seat 216 bears the majority of the valve spring force. This reduces the pressure in the autolash plenum 308 to pre-actuation levels, thereby "resetting" the autolash function of the actuation system 300. In one embodiment, the autolash piston 306 moves distally about 0.3 mm relative to the housing 302 while the engine valve 206 is open. The autolash piston 306 then moves proximally about 0.3 mm relative to the housing 302 as the engine valve 206 approaches its seat 216. During this reciprocating motion, any lash in the valve train 200 is taken up by the autolash function.

During the seating control operation, a significant portion of the engine valve's kinetic energy is dissipated in the fluid in the distal chamber 322 as thermal energy. To prevent overheating, the main accumulator 354, or optionally the trigger accumulator 332, (seen in FIG. 3) includes a leakage path to allow some of this heated fluid to escape. The heated fluid is then replaced with cooler fluid fed from the fluid source 358 through the check valve 356, as described below. This bleed cooling process repeats with each actuation of the system 300.

Figure 5E:
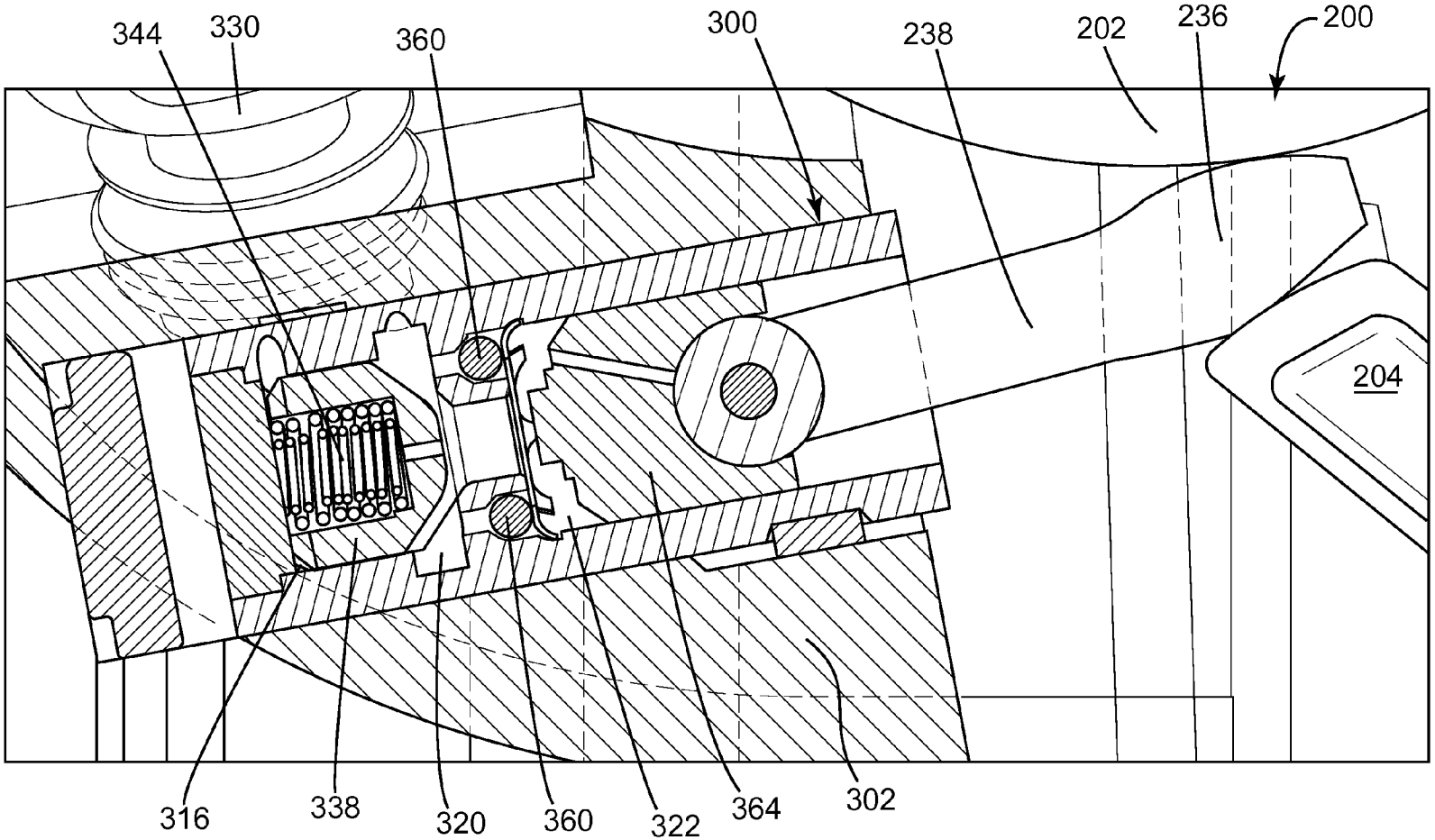
FIG. 5E is a schematic cross-sectional view of the actuation system and valve train of FIG. 5A during a refill phase of operation.

As shown in FIG. 5E, the cam 202 eventually rotates to a point where the end of the actuating portion 226 reaches the bearing element 236 and the bearing element 236 is in contact with a closing/refill ramp 232 of the cam 202 and/or the base circle 218 of the cam 202 while the engine valve 206 is closed (e.g., as shown schematically in FIG. 2A). At this time, the accumulator springs of the main accumulator 354 and the trigger accumulator 332 force fluid back into the proximal chamber 316 and the middle chamber 320 of the actuation system 300. Any fluid that was lost during the previous cycle is replenished by fluid flowing from the fluid source 358 through the check valve 356. The fluid entering the middle chamber 320 opens the refill check valves 360 and flows into the distal chamber 322, displacing the lost-motion piston 364 distally and returning the bearing element 236 to the fully-inserted position between the cam 202 and rocker 204. The pressure in the distal chamber 322 drops enough at this time to allow the main valve 338 to close, under the pressure of the trigger accumulator 332 and the bias spring 344. When sufficient time has passed to allow the distal chamber 322 to refill, the high-speed trigger valve 330 is closed, locking the main valve 338 in the closed position and readying the actuation system 300 for the next engine valve 206 opening event. Preferably, the main accumulator 354 and the trigger accumulator 332 are sized such that they are never completely filled or emptied (i.e., such that their accumulator springs are never "bottomed-out").

The refill process described above can be performed during the closing or "refill" ramp 232 of the cam 202. If the closing ramp 232 is too fast, the bearing element 236 can move onto the base circle 218 of the cam 202 before the actuation system 300 has a chance to refill. This can undesirably allow the bearing element 236 to momentarily lose contact with either or both of the cam 202 and the rocker 204. Subsequent reengagement can generate noise and vibration, and can potentially damage the valve train 200 components. Accordingly, the cam 202 can be provided with a closing ramp 232 that is slow relative to the opening ramp 230, to allow adequate time for the refill operation to complete. In one embodiment, the opening ramp 230 of the cam 202 generates an engine valve 206 velocity of between about 6 m/s and about 7 m/s, while the closing ramp 232 corresponds to an engine valve 206 velocity of about 0.5 m/s. Thus, the closing ramp 232 can be approximately 10-15 times slower than the opening ramp 230.

The actuation system 300 provides a number of distinct advantages. For example, in the actuation system 300, the trigger valve 330 is used as a piloting device for opening the main valve 338, which allows a relatively large flow area to be opened in a relatively short amount of time. Trigger valves are available with very high actuation speeds, but in order to obtain those speeds, the flow area through the valve must be relatively small. A trigger valve could not be used by itself to drain the actuation system 300, as the flow area provided by even the best available trigger valves is approximately one fifth of the required flow area. By using the trigger valve 330 as a pilot for a larger main valve 338, the actuation system 300 permits for very fast actuation without sacrificing flow area. The tapered main valve 338 in the illustrated embodiment opens a flow area that is approximately 5-6 mm in diameter with an approximately 1.2 mm opening height. Preferably, the flow area of the main valve is at least five times greater than the flow area of the trigger valve. This allows for rapid discharge of fluid from the distal chamber 322 and corresponding very fast engine valve 206 closing speed.

Another advantage of the actuation system 300 is the coaxial arrangement of the main valve 338, autolash piston 306, and lost-motion piston 364. Among other benefits, this provides for easier packaging of the system 300 within an engine and reduces the volume of the proximal chamber 316, which provides faster pressure balancing across the main valve 338 and reduces system compliance.

Yet another advantage of the actuation system 300 is that it combines at least three valve train functions into a single device: lost-motion actuation, autolash, and seating control.

In addition, the seating control capability of the actuation system 300 eliminates the need for a separate seating control device, which typically would be coupled directly to the engine valve. This reduces system complexity, helps with packaging, and reduces the overall mass of the engine valve, which can lead to faster actuation.

The actuation system 300 also provides for easier manufacturability. For example, the distal chamber 322 and seating control opening 362 can be machined into a first end of the autolash piston 306, while the main valve bore can be machined from the other end of the autolash piston 306.

Figure 6A:
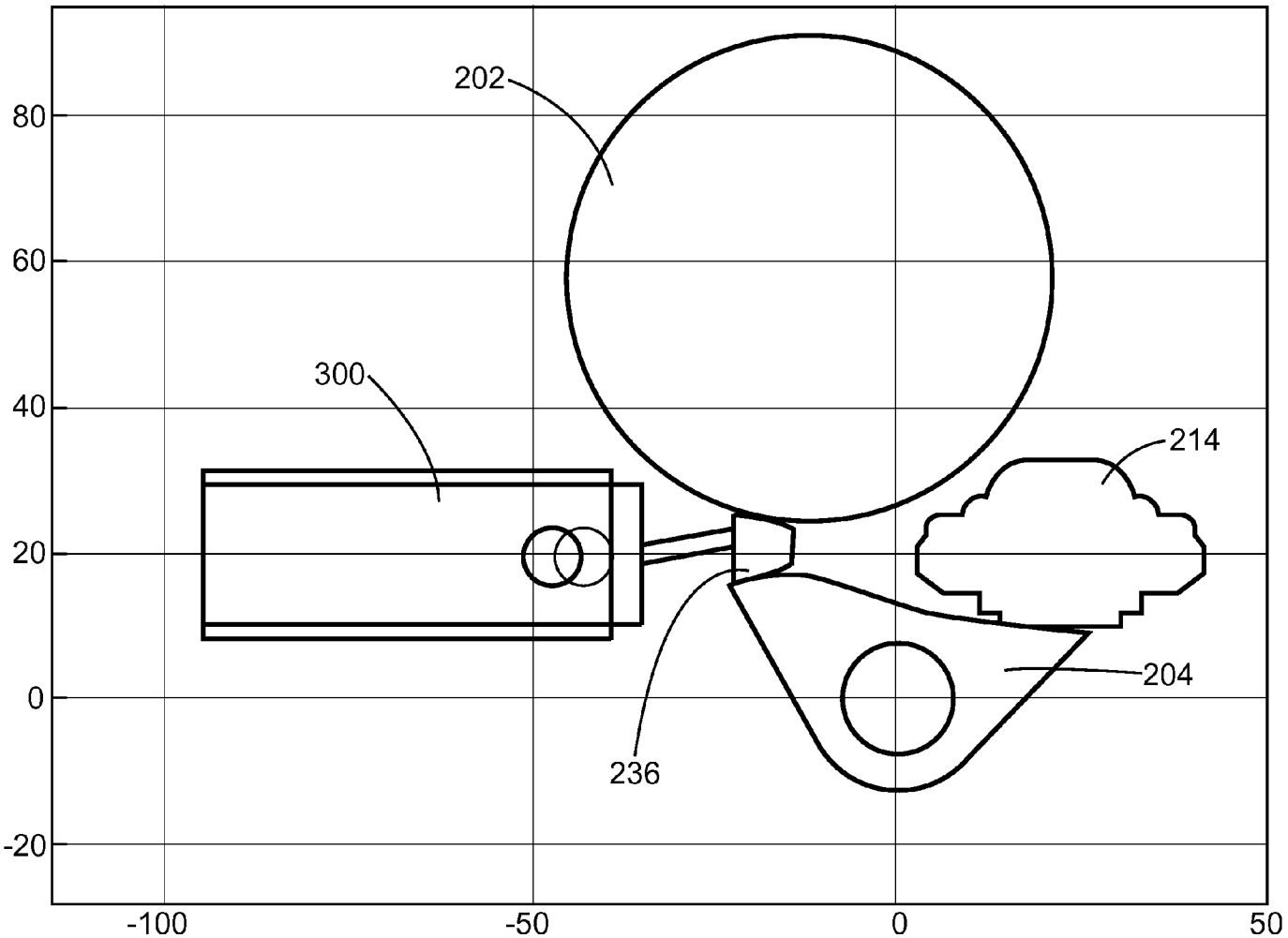
FIG. 6A is a schematic diagram of one exemplary packaging arrangement of valve train components.
Figure 6B:
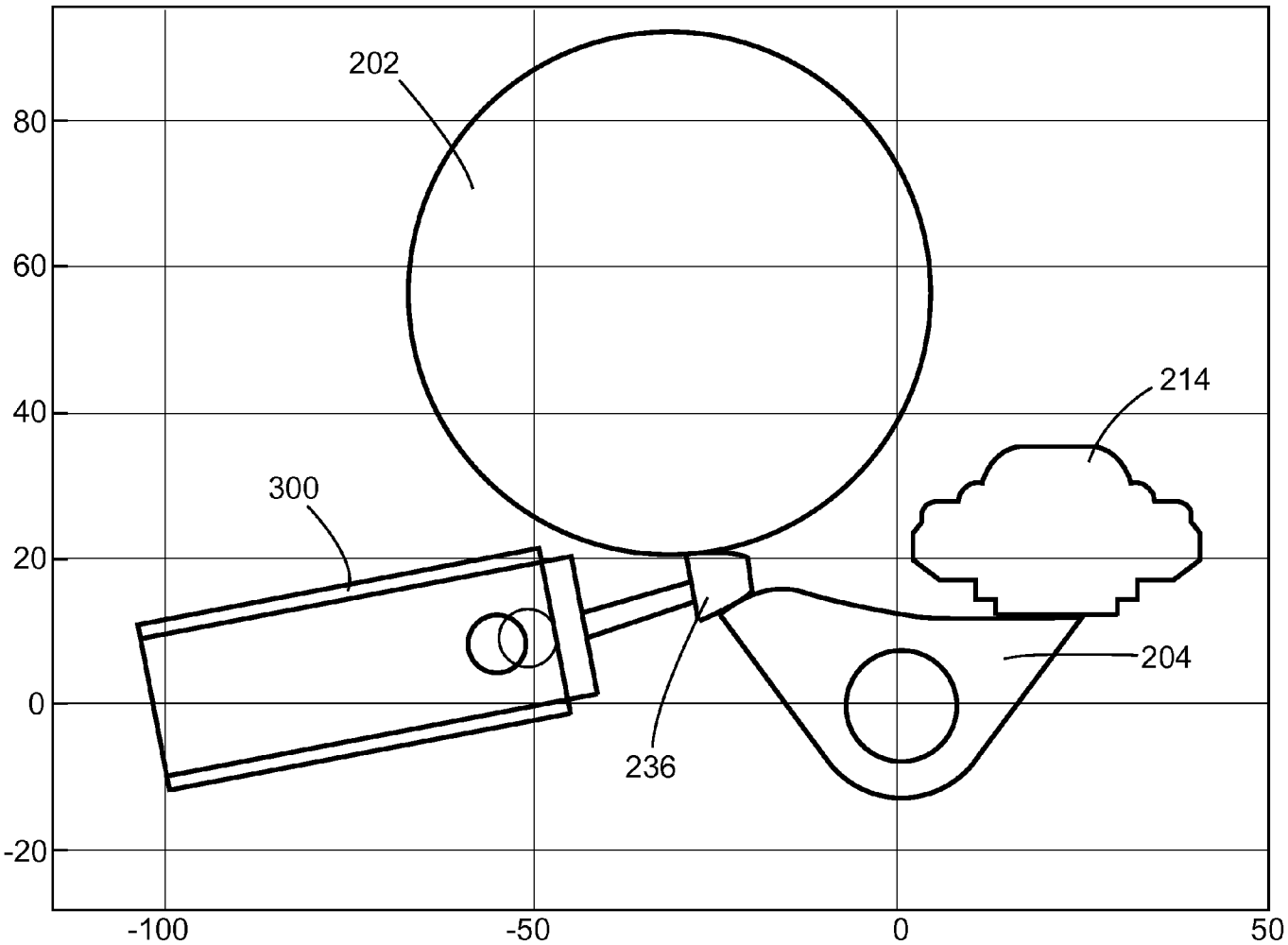
FIG. 6B is a schematic diagram of another exemplary packaging arrangement of valve train components.
Figure 6C:
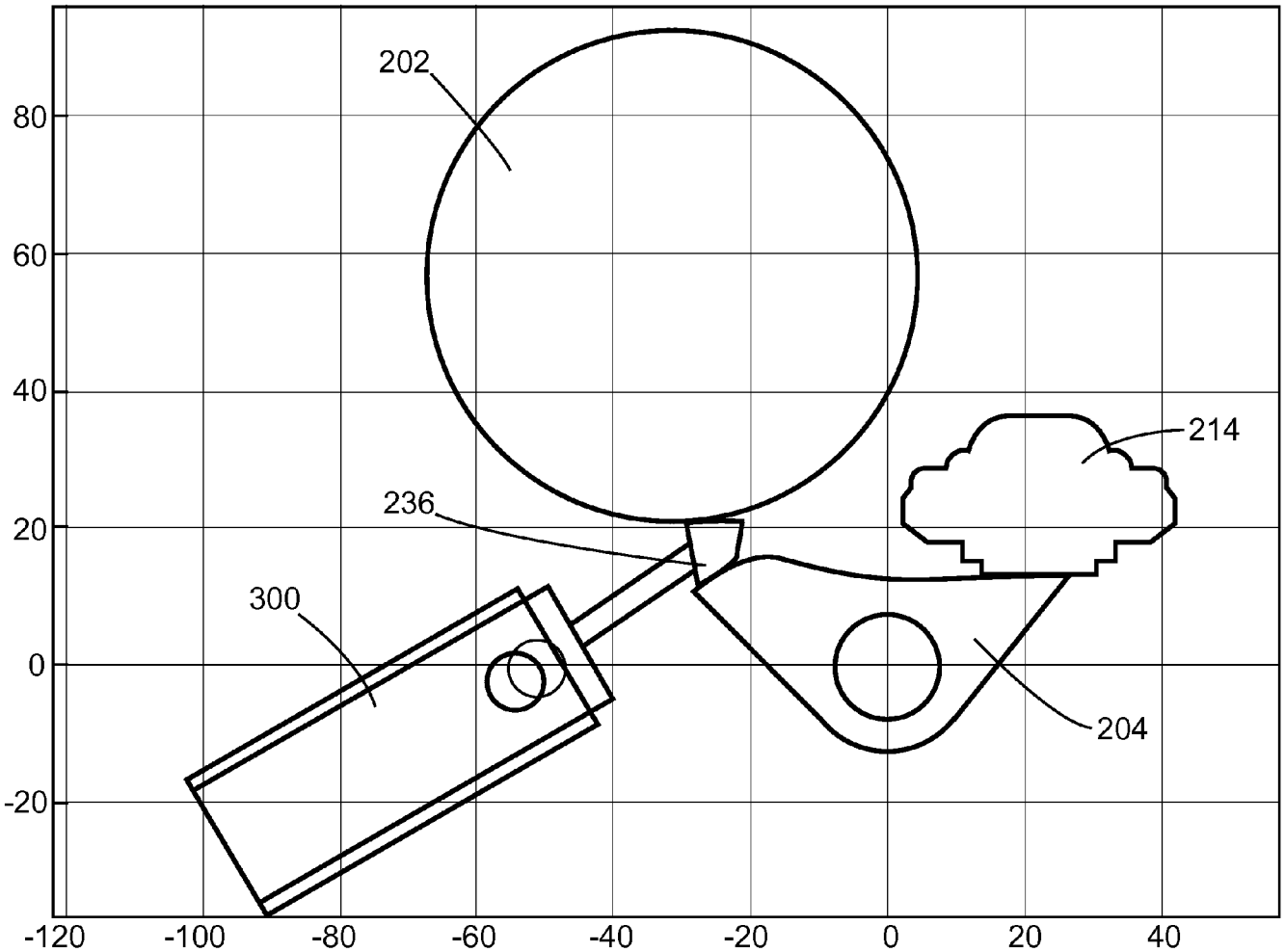
FIG. 6C is a schematic diagram of another exemplary packaging arrangement of valve train components.
Figure 6D:
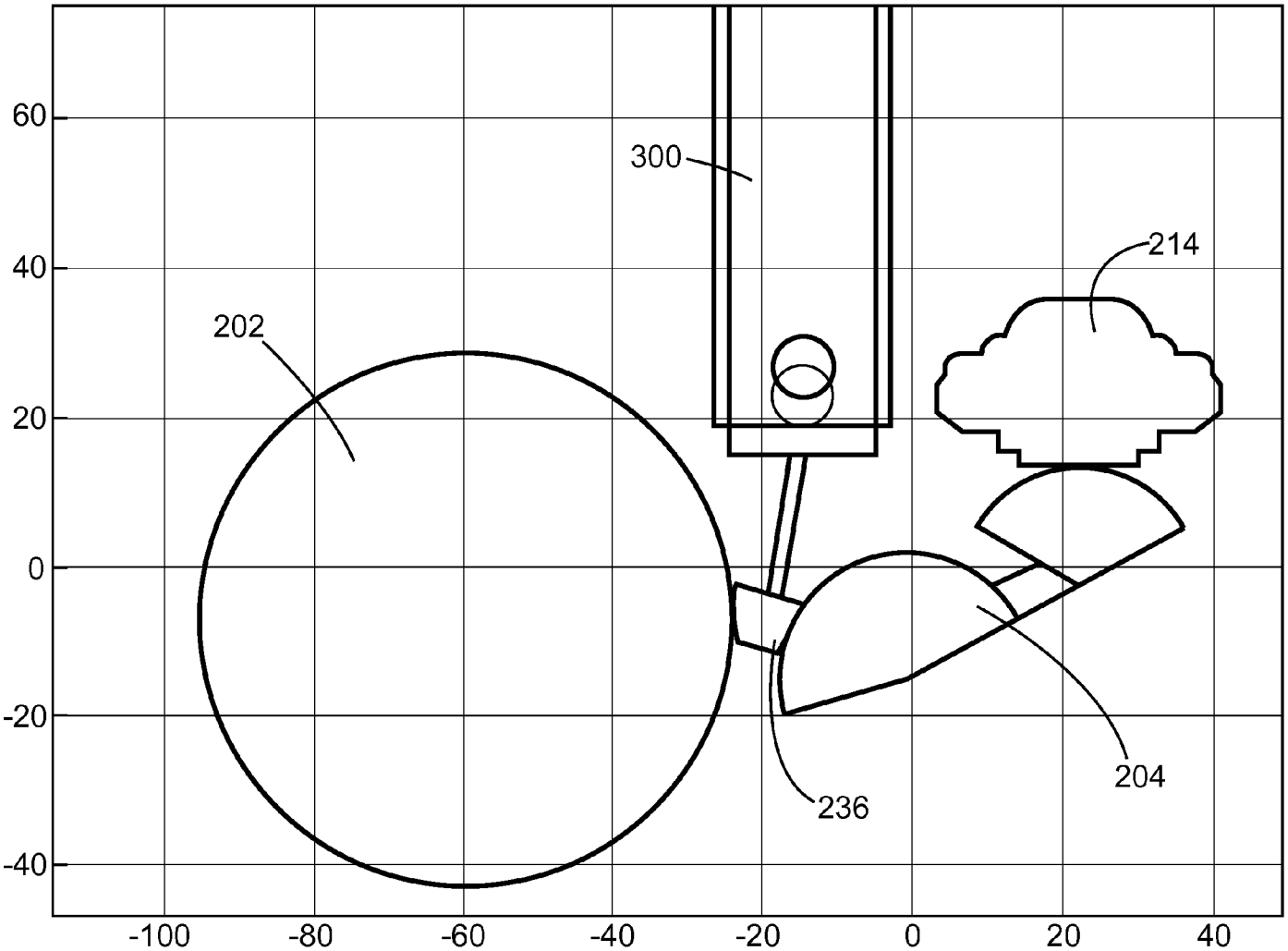
FIG. 6D is a schematic diagram of another exemplary packaging arrangement of valve train components.
Figure 6E:
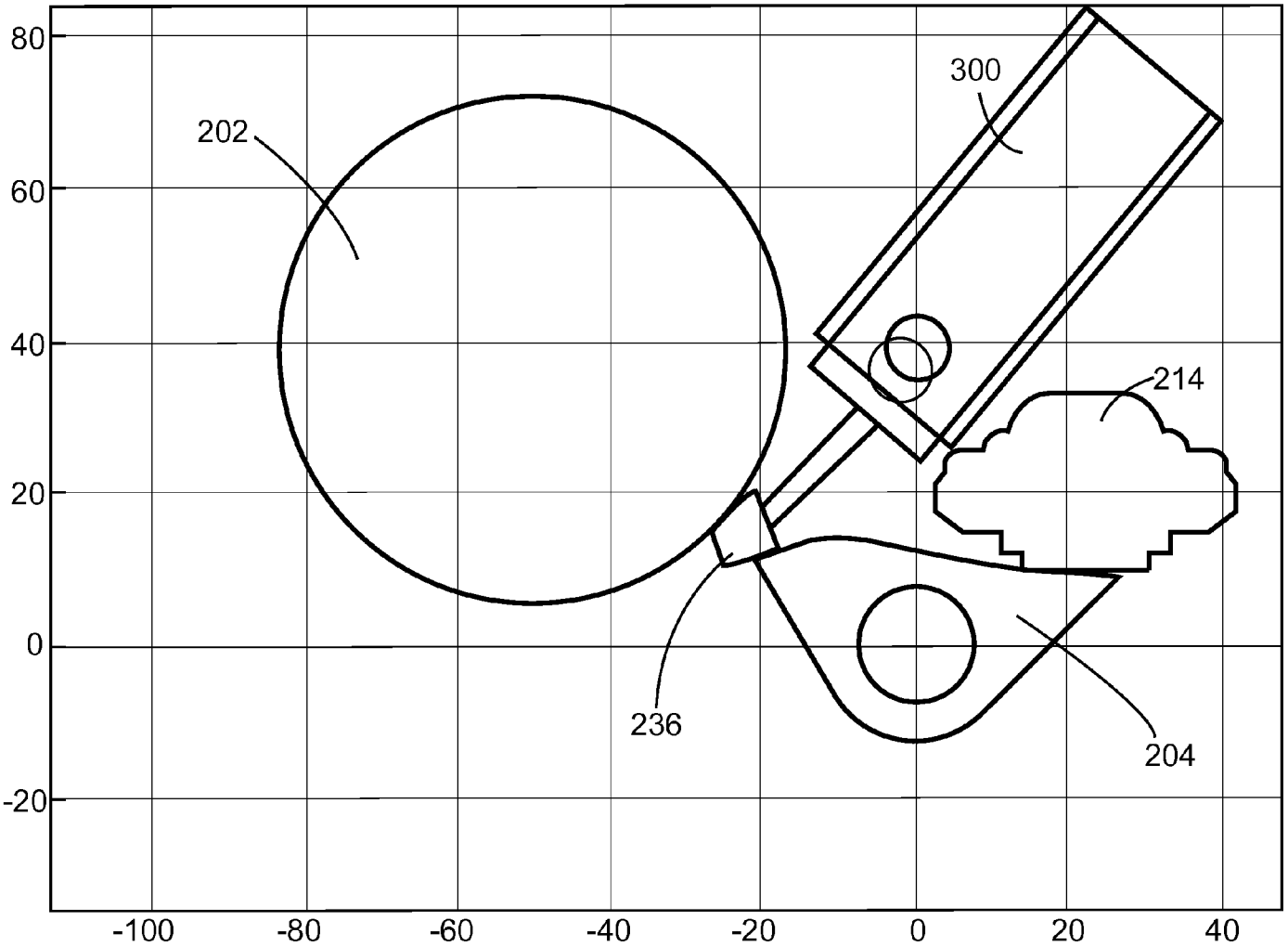
FIG. 6E is a schematic diagram of another exemplary packaging arrangement of valve train components.

It will be appreciated that the arrangements of valve train components shown in the foregoing drawings are merely exemplary, and that any of a variety of arrangements can be used. FIGS. 6A-6E schematically illustrate a series of exemplary arrangements of the cam 202, rocker 204, valve adapter assembly 214, and actuation system 300. In FIG. 6A, the actuation system 300 is positioned such that the bearing element 236 is ejected from the cam 202 and rocker 204 in a purely horizontal direction (i.e., along an axis that is tangent to the cam 202 surface and parallel with the contact surface of the valve adapter assembly 214). In FIG. 6B, the actuation system 300 is inclined slightly relative to the horizontal, such that the direction of ejection of the bearing element 236 has both a horizontal and vertical component. FIG. 6C shows a similar arrangement in which the inclination angle of the actuation system 300 is increased. In FIG. 6D, the actuation system 300 is positioned such that the bearing element 236 is ejected from the cam 202 and rocker 204 in a purely vertical direction (i.e., along an axis that is tangent to the cam 202 surface and perpendicular to the contact surface of the valve adapter assembly 214). In FIG. 6E, the actuation system 300 is angled relative to the vertical such that the direction of ejection of the bearing element 236 has both a horizontal and vertical component. These or other valve train arrangements can be selected based on the packaging constraints of any particular engine or application.

Figure 7A:
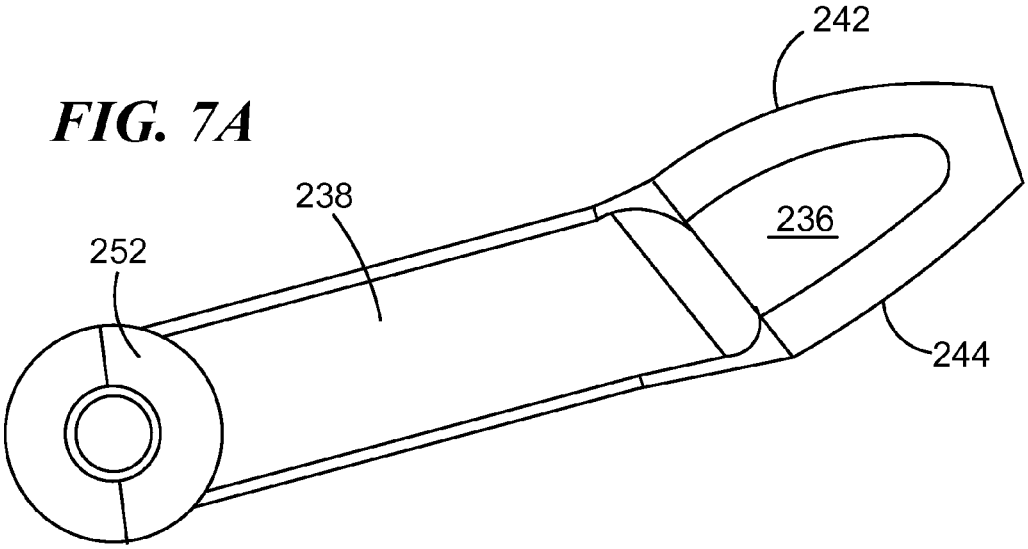
FIG. 7A is a side view of the connecting arm and bearing element of the valve train shown in FIGS. 5A-5E.
Figure 7B:
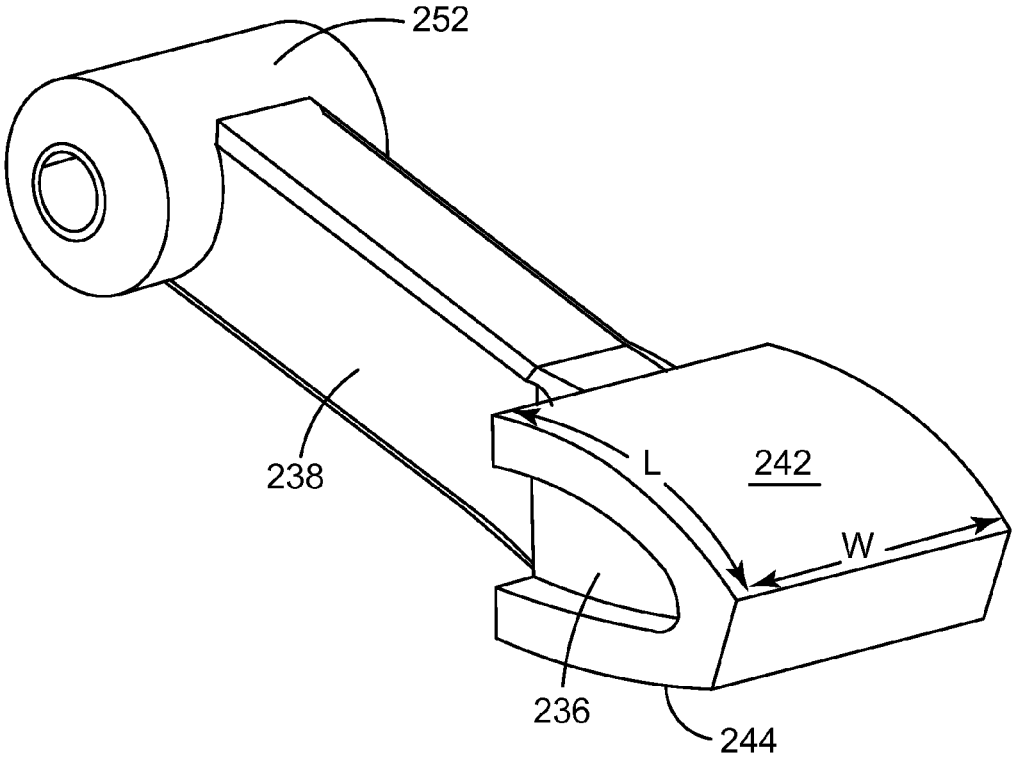
FIG. 7B is a perspective view from above of the connecting arm and bearing element of FIG. 7A.
Figure 7C:
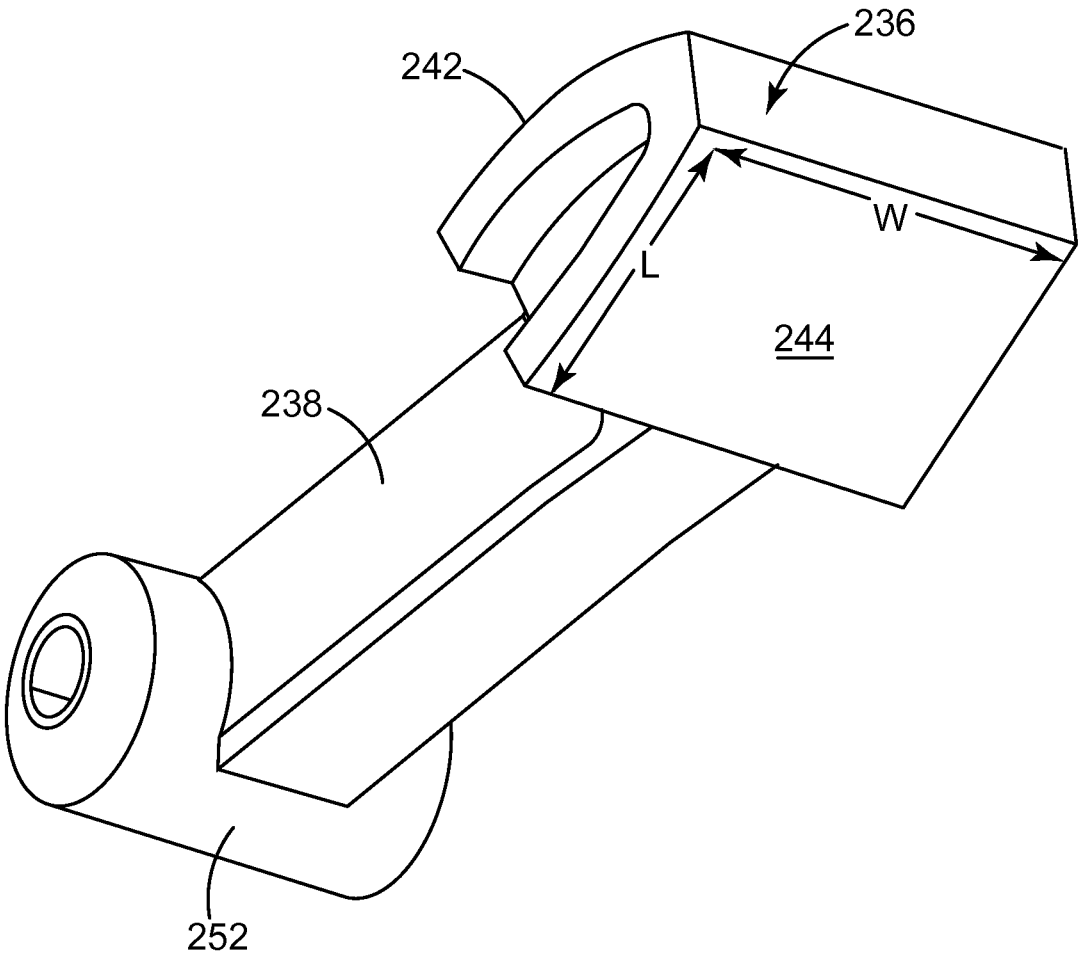
FIG. 7C is a perspective view from below of the connecting arm and bearing element of FIG. 7A.

FIGS. 7A-7C illustrate an exemplary embodiment of a bearing element 236 that is formed integrally with a connecting arm 238. As shown, the bearing element defines a cam-facing bearing surface 242 and a rocker-facing bearing surface 244. The connecting arm 238 is substantially rectangular in cross-section and extends proximally from the bearing element 236 to a cylindrical portion 252 configured to couple the connecting arm 238 to the lost-motion piston 364 of the actuation system 300 described above.

In one embodiment, the surface of the cam 202, the surface of the rocker pad 222, and the bearing element surfaces 242, 244 are all sections of cylinders (i.e., they have a finite radius of curvature in the length direction L and no (or infinite) radius of curvature in the width direction W). If the central axis of one or more of these cylinders is not parallel to the central axis of one or more other cylinders, for example due to manufacturing or assembly tolerances, undesirable point contact can occur between cooperating bearing surfaces. For example, if the central axis of the cam 202 extends at a non-zero angle relative to the central axis of the cam-facing bearing surface 242, only the edge of the cam 202 will contact the cam-facing bearing surface 242. This point contact between the surfaces can lead to decreased surface durability and decreased valve train longevity.

Accordingly, in some embodiments, one or more of the cam 202 surface, the rocker pad 222 surface, and the bearing element surfaces 242, 244 can be crowned along their width W and can thus be barrel-shaped instead of cylindrical. In other words, the surface can have a finite radius of curvature in the length direction L and a finite radius of curvature in the width direction W.

With crowned surfaces, point contact in the case of non-parallel component axes is avoided. Instead of edge contact at a single point, an elliptical contact patch is formed between the opposed crowned surfaces when the axes are misaligned. This elliptical contact patch reduces contact stress as compared with edge contact and thus increases surface longevity. Crowning increases contact stress, however, as compared with perfectly aligned cylindrical contact surfaces, especially where the crowning radius is relatively small.

Contact stress is also increased when the lengthwise radius of curvature of one contact surface is small relative to the lengthwise radius of curvature of a cooperating contact surface. In most cam shapes, the lengthwise radius of curvature is necessarily small at some angular positions (e.g., at the transition point between the opening ramp 230 and the dwell section 234). Thus, crowning of the cam-facing contact surface 242 in the widthwise direction coupled with disparate lengthwise curvature radii can lead to unacceptably high contact stress in some embodiments. As a result, it may be desirable not to crown the cam 202 and the cam-facing bearing surface 242 (thereby employing cylinder-to-cylinder contact instead of barrel-to-barrel contact). In this configuration, the issue of edge contact created by misaligned component axes is addressed at least in part by a film of lubricating oil between the cam 202 and the cam-facing bearing surface 242. Because the cam 202 is continuously picking up oil during its rotation, a consistent slick of fresh oil is maintained between the cam 202 and the cam-facing contact surface 242.

In contrast to the cam 202, the rocker pad 222 does not benefit from continuous oil pickup. The rocker pad 222, however, can have a relatively large lengthwise radius of curvature. Accordingly, when a large lengthwise radius of curvature is used for the rocker pad 222 and the rocker-facing contact surface 244, these surfaces can be crowned in the widthwise direction to compensate for manufacturing tolerances without increasing contact stress to an unacceptable level.

In view of the foregoing, an exemplary valve train embodiment includes a cylindrical cam 202 surface and a cylindrical cam-facing surface 242 (i.e., both the cam surface and the cam-facing surface 242 have substantially no (i.e., substantially infinite) widthwise radius of curvature). This valve train embodiment also includes a crowned, or "barrel-shaped" rocker pad 222 surface and rocker-facing surface 244 (i.e., both the rocker pad 222 surface and the rocker-facing surface 244 have a finite widthwise radius of curvature). Preferably, this widthwise radius of curvature is relatively large, for example, at least about 1 meter.

In one embodiment, the cam-facing bearing surface 242 has a 17 mm radius of curvature along its length L and no radius of curvature along its width W. The rocker-facing bearing surface 244 has a 50 mm radius of curvature along its length L and a 1 meter radius of curvature along its width W. The rocker pad 222 surface has a 35 mm radius of curvature along its length and a 1 meter radius of curvature along its width. The cam 202 surface has a variable radius of curvature along its length (depending on angular position) and no radius of curvature along its width.

The lengthwise radius of the cam-facing bearing surface 242 can be limited in some embodiments by the lengthwise radius of the concave section of the cam 202 located at the base of the opening ramp 230. For example, if the lengthwise radius of the cam-facing bearing surface 242 is greater than the lengthwise radius of the concave section of the cam 202 at the transition from the base circle 218 to the opening ramp 230, the bearing element 236 can transition onto the ramp 230 too roughly, causing unnecessarily high contact stresses. Accordingly, in some embodiments, the lengthwise radius of the cam-facing bearing surface 242 can be substantially smaller (e.g., on the order of about one half to about one third or smaller) than the lengthwise radius of the concave section at the transition from the base circle 218 to the opening ramp 230.

The rocker-facing bearing surface 244 has no such limitation. In fact, because the bearing surface 244 does not have the advantage of a continuous oil slick to ride on (as does the bearing surface 242), then if the lengthwise radius of the bearing surface 244 were as small as the lengthwise radius of the surface 242, the contact stresses would become undesirably high. Accordingly, in some embodiments, the radius of the rocker-facing bearing surface 244 can be larger than the radius of the cam-facing bearing surface 242. Preferably, the lengthwise radius of the rocker-facing bearing surface is about 1.5 times, about 2.0 times, and/or about 2.5 times larger than the lengthwise radius of the cam-facing bearing surface 242.

The proximal end of the connecting arm 238 can have a variety of configurations, and can be coupled to the lost-motion piston 364 of the actuation system 300 in any of a variety of ways.

Figure 8A:
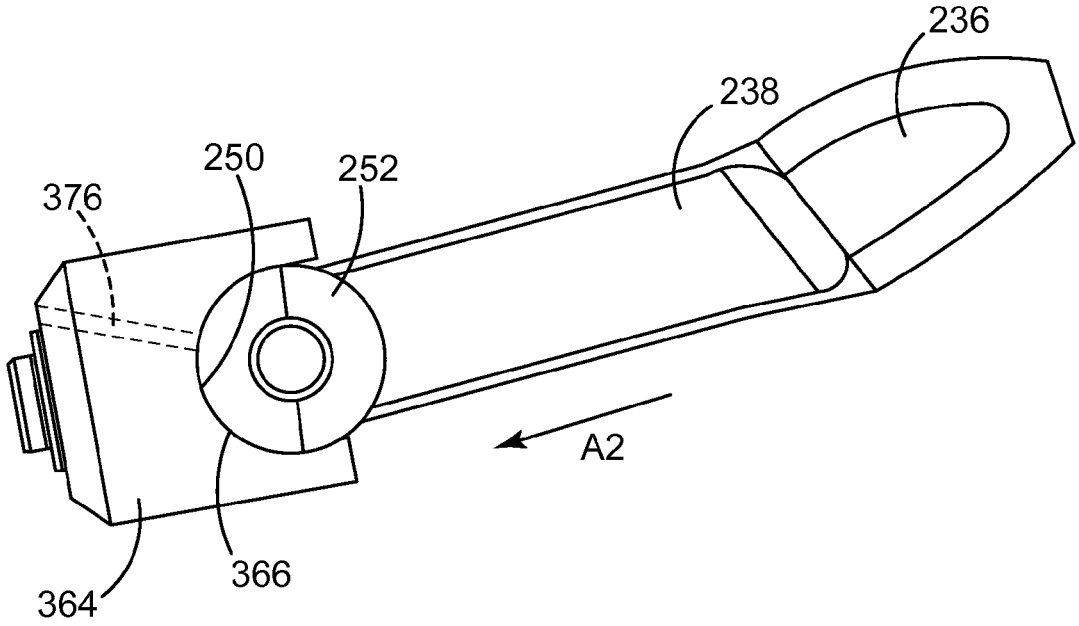
FIG. 8A is a partial cross-sectional side view of the lost-motion piston of FIG. 3 and the connecting arm and bearing element of FIG. 7A.

In one embodiment, as shown in FIG. 8A, the proximal end of the connecting arm 238 defines a substantially-cylindrical portion 252 sized to be received in a corresponding cylindrical recess 366 formed in the lost-motion piston 364. The cylindrical recess 366 formed in the lost-motion piston 364 can be greater than half of a cylinder, such that the cylindrical portion 252 of the connecting arm 238 is captured and positively retained within the recess 366. Alternatively, the recess 366 can be less than half of a cylinder, in which case forces imparted to the connecting arm 238 in the direction of the arrow A2 by the other valve train components can be relied upon to maintain contact between the cylindrical portion 252 and the recess 366. The extent to which the recess 366 extends around the cylindrical portion 252 can also be selected to limit the range of rotational freedom of the connecting arm 238 relative to the lost-motion piston 364.

A lubrication aperture 376 formed in the lost-motion piston 364 supplies lubricating fluid from the distal chamber 322 of the actuation system 300 to the interface between the cylindrical portion 252 and the recess 366 when the actuation system 300 is refilled. It will be appreciated that during opening and closing of the engine valve 206, the contact surface 250 of the cylindrical portion 252 is pressed against the lubrication aperture 376 with sufficient force to prevent the escape of fluid from the distal chamber 322 of the actuation system 300 therethrough.

In an exemplary embodiment, the cylindrical portion 252 has a diameter of approximately 7 mm and a width of approximately 11 mm.

Figure 8B:
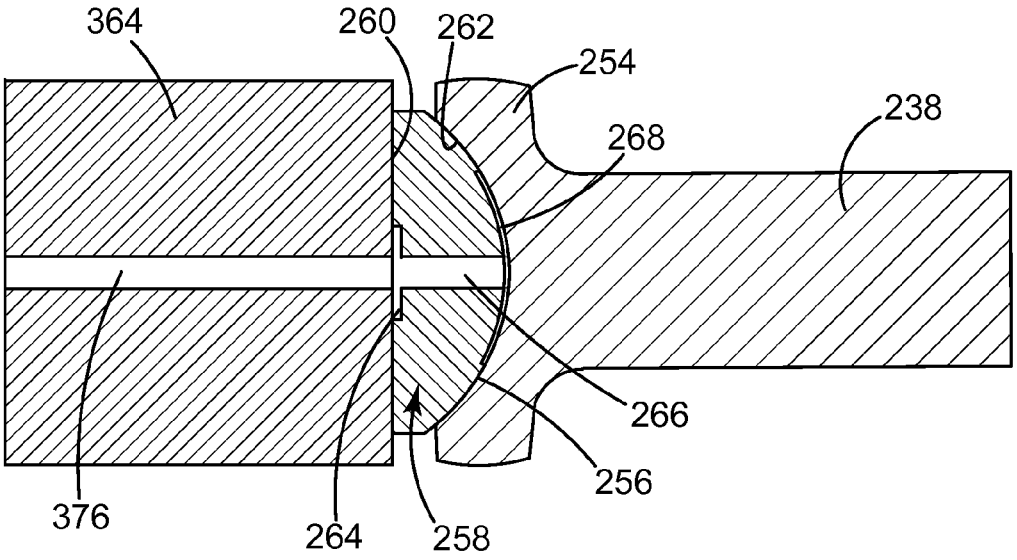
FIG. 8B is a cross-sectional side view of an exemplary valve train arrangement in which a connecting arm is coupled to a lost-motion piston via an intermediate meniscus.

In another embodiment, as shown in FIG. 8B, the connecting arm 238 flares outwards into a bulb 254 at its proximal end. The bulb 254 has a substantially circular transverse cross-section and is sized to fit within the distal chamber 322 of the actuation system 300. A spherical recess 256 is formed in the proximal-facing surface of the bulb 254. A meniscus 258 is sandwiched between the bulb 254 and the substantially-planar distal surface of the lost-motion piston 364. The bulb 254, meniscus 258, and lost-motion piston 364 are all housed within the distal chamber 322 of the autolash piston 306.

The meniscus 258 includes a substantially planar contact surface 260 that engages the distal surface of the lost-motion piston 364 and a spherical contact surface 262 that engages the spherical recess 256 formed in the bulb 254 of the connecting arm 238. The meniscus 258 also includes a proximal cavity 264 that is in fluid communication with a lubrication aperture 376 formed in the lost-motion piston 364. The proximal cavity 264 is sized such that fluid communication is maintained with the lubrication aperture 376 as the meniscus 258 slides up and down along the distal surface of the lost-motion piston 364. A central fluid lumen 266 extends through the meniscus 258 and supplies lubricating fluid from the proximal cavity 264 to a distal cavity 268 (best seen in FIG. 8E) formed in the distal-facing surface 262 of the meniscus 258.

Figure 8C:
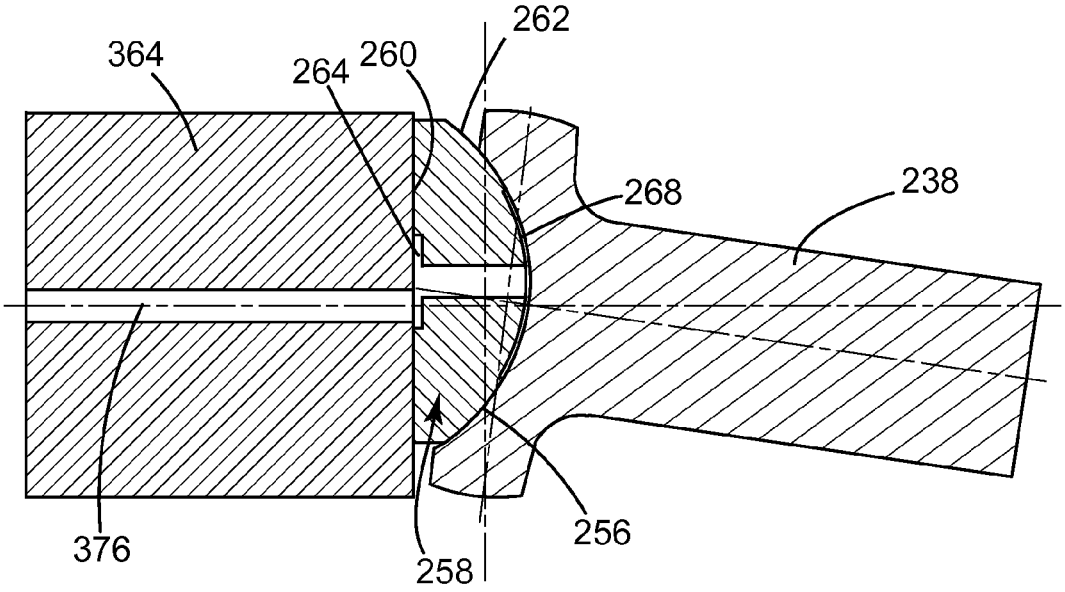
FIG. 8C is a cross-sectional side view of the valve train arrangement of FIG. 8B, shown with the connecting arm articulated relative to the lost-motion piston.

In operation, the meniscus 258 and connecting arm 238 are positioned as shown in FIG. 8B when the bearing element 236 is in contact with the base circle 218 of the cam 202. During this time, a small amount of fluid flows from the distal chamber 322, through the lost-motion piston 364, and into the proximal and distal cavities 264, 268 in the meniscus 258 to lubricate the contact surfaces 260, 262 of the meniscus 258. As shown in FIG. 8C, when the actuating portion 226 of the cam 202 contacts the bearing element 236 to open the engine valve 206, the connecting arm 238 pivots downwards, with the spherical recess 256 formed therein sliding across the spherical contact surface 262 of the meniscus 258. At the same time, the meniscus 258 slides upwards relative to the lost-motion piston 364. Due to the sizing of the proximal and distal cavities 264, 268, lubrication fluid is supplied to the interface between the lost-motion piston 364 and the meniscus 258 and also to the interface between the meniscus 258 and the connecting arm 238, regardless of how the components are articulated.

The configuration shown in FIGS. 8B and 8C advantageously permits a greater radius of curvature to be used for the meniscus spherical contact surface 262 and the connecting arm recess 256, which as described above, reduces contact stress by providing a greater area over which to transmit valve train forces. For example, the meniscus spherical contact surface 262 can have a diameter of 9 mm and a width of 9 mm.

In addition, the separate meniscus component 258 can be formed from a material that is different from the material(s) used for the lost-motion piston 364 and/or the connecting arm 238. This can allow a low-friction, stress-tolerant material to be used for the meniscus 258 without adding extra weight to the lost-motion piston 364 or connecting arm 238. In one embodiment, the lost-motion piston 364 and connecting arm 238 are formed from steel and the meniscus 258 is formed from bronze.

Figure 8D:
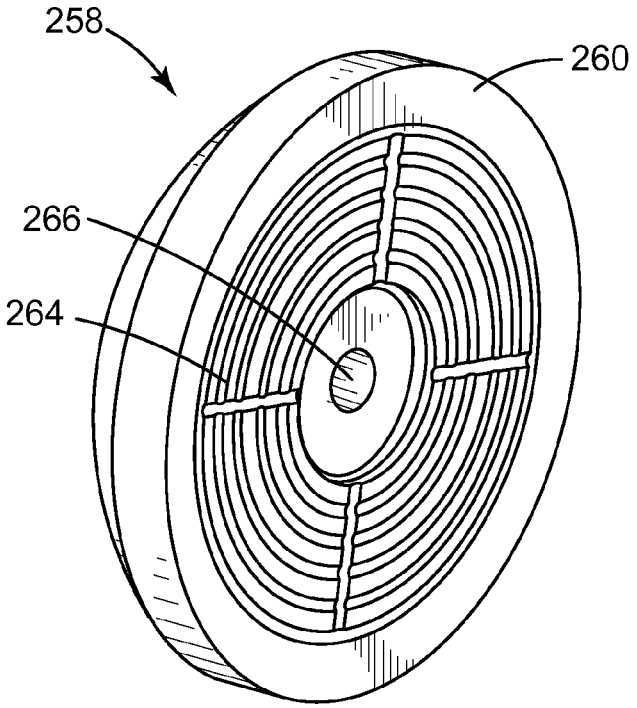
FIG. 8D is a proximal perspective view of the meniscus of FIG. 8A.
Figure 8E:
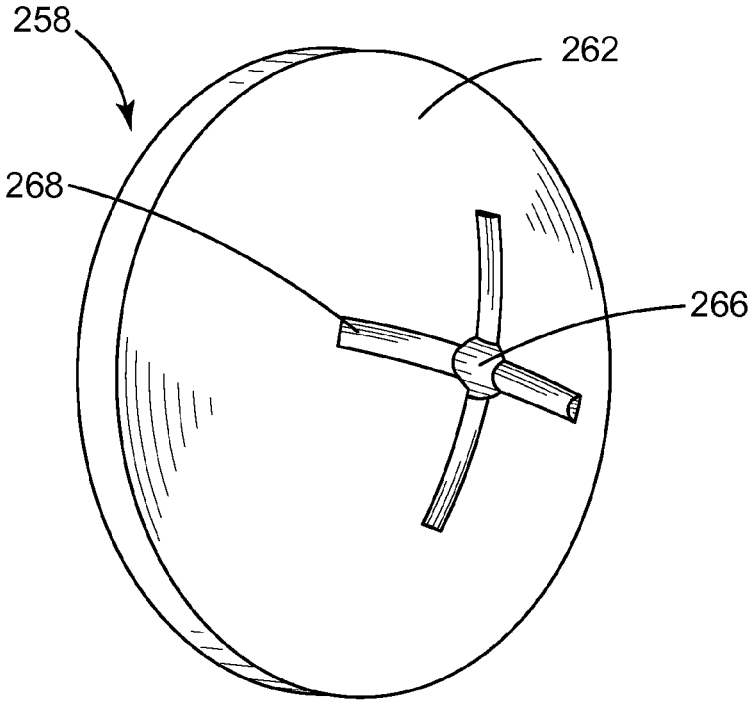
FIG. 8E is a distal perspective view of the meniscus of FIG. 8A.

As shown in FIG. 8D, the proximal fluid cavity 264 of the meniscus 258 can optionally be defined by a groove pattern to allow for lubrication without substantially weakening the structure of the meniscus 258. Preferably, the grooves are shallow and narrow, and do not extend closer than 1 mm to the outer circumference of the meniscus 258, so as to prevent inadvertent escape of oil from the distal chamber 322 of the autolash piston 306. A spiral groove can be provided in the proximal-facing surface 260 of the meniscus 258, or an interconnecting set of concentric circular grooves can be provided as shown. The distal cavity 268 of the meniscus 258 can be defined by two linear intersecting grooves to provide optimal lubrication, as shown in FIG. 8E.

Figure 8F:
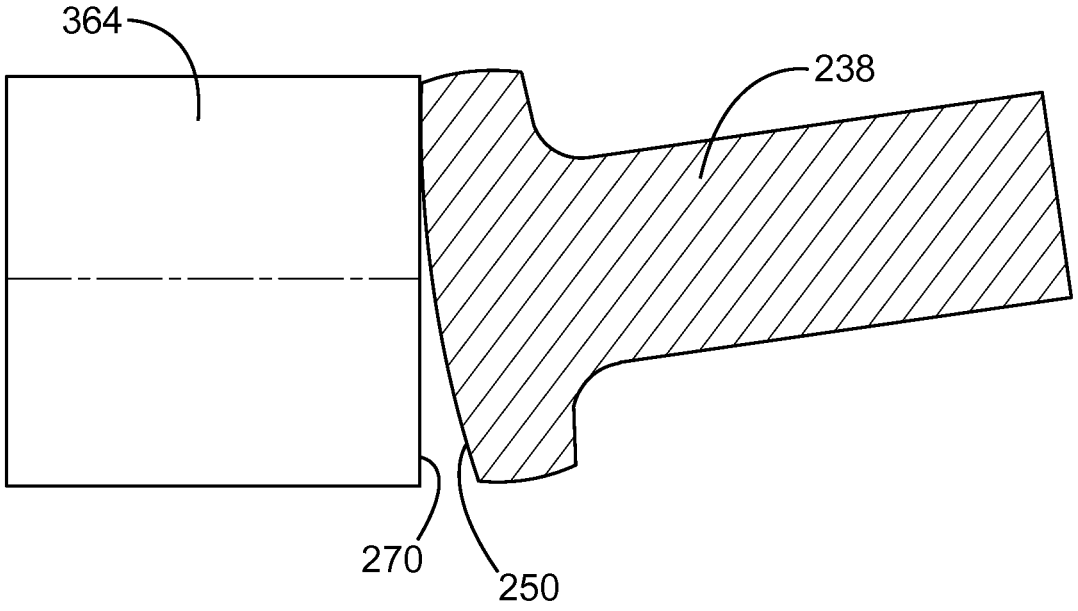
FIG. 8F is a cross-sectional side view of an exemplary valve train arrangement in which a connecting arm having a substantially cylindrical proximal surface is coupled directly to a lost-motion piston having a substantially planar distal surface.

In another embodiment, as shown in FIG. 8F, the proximal end of the connecting arm 238 defines a cylindrical contact surface 250 that is positioned in direct contact with a substantially-planar distal surface 270 of the lost-motion piston 364. In this embodiment, the radius of curvature of the cylindrical contact surface 250 can be made very large to limit angular rotation of the connecting arm 238 relative to the lost-motion piston 364 and to keep the contact line between the cylinder surface 250 and the distal piston surface 270 substantially centered in a direction parallel to the surface 270 (i.e. in the up-down direction in FIG. 8F). An advantage to this embodiment is that lubrication of the interface between the connecting arm 238 and the lost-motion piston 364 is less of a concern, since the articulation is accomplished through rolling contact instead of sliding contact. A cylindrical surface 250 with a large radius of curvature can also help reduce contact stress. In this embodiment, the proximal end of the connecting arm 238 is captured in the distal chamber 322 of the autolash piston 306 to keep the connecting arm 238 from translating in the up-down direction, while allowing the connecting arm 238 to pivot in the up-down direction by rocking against the lost-motion piston 364.

In any of the configurations described above, one or more bearing inserts can be provided between the various contact surfaces. The bearing inserts can be formed from a material such as bronze that is characterized by low friction and high stress tolerance. In one embodiment, the bearing inserts can be press-fit into the contact surface(s).

In the valve train 200 described above, the lost-motion function is achieved by one or more elements disposed between the cam 202 and the rocker 204. This need not always be the case, however. For example, lost-motion can also be achieved by adjusting a pedestal height of the rocker 204 such that the distance between the cam 202 and the pivot point of the rocker 204 can be adjusted.

Figure 9A:
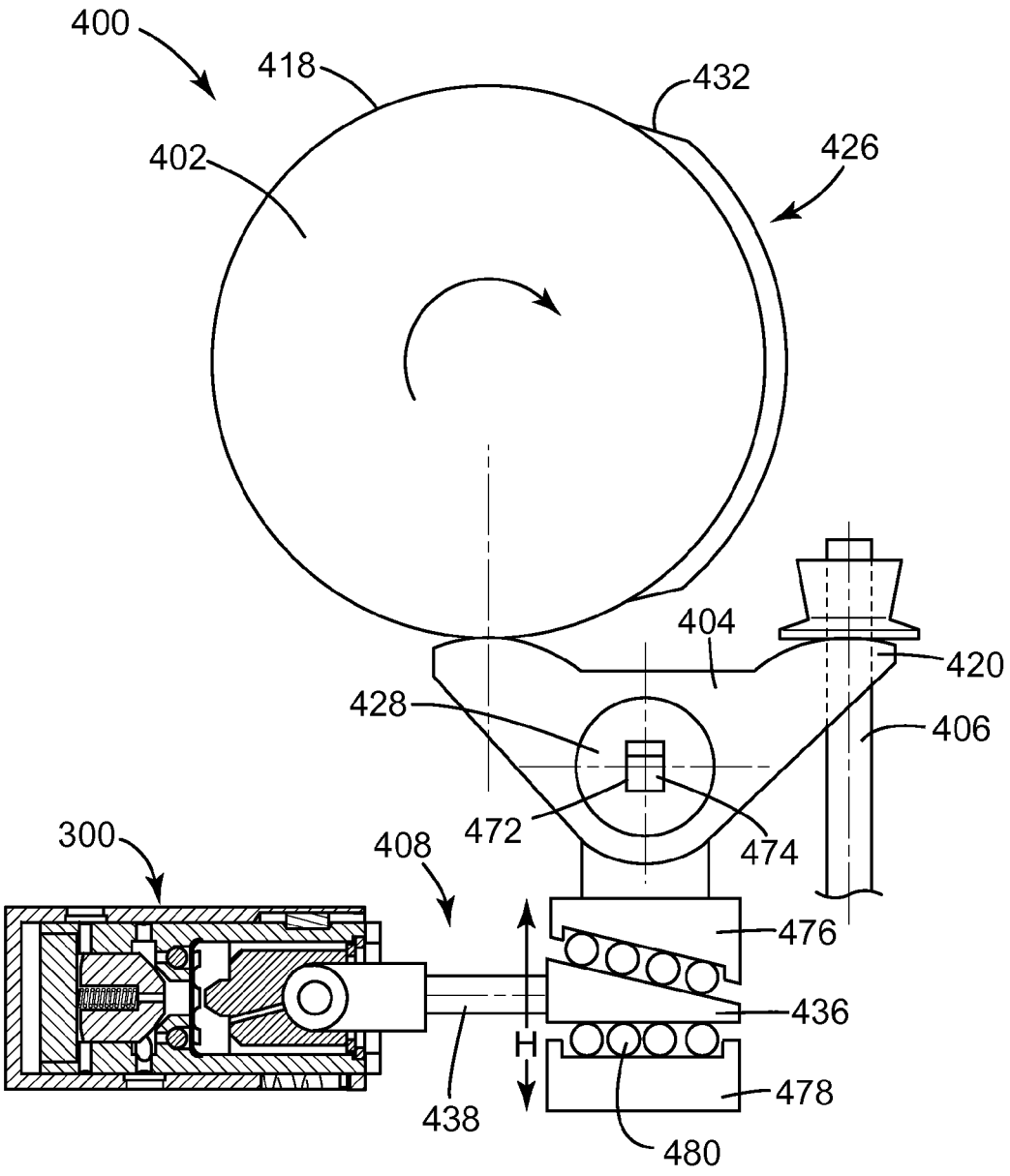
FIG. 9A is a schematic cross-sectional view of one embodiment of a valve train that includes the actuation system of FIG. 3.

FIG. 9A illustrates one exemplary embodiment of a "roller wedge" valve train 400. As shown, the valve train 400 includes a cam 402, a rocker 404, a valve 406, and an adjustable mechanical element 408. The adjustable mechanical element 408 includes a bearing element 436, a connecting arm 438, and the actuation system 300 described above. The rocker 404 is mounted on a rocker shaft 428 having a rectangular aperture 472 formed therein. The aperture 472 is sized to slidably receive a rectangular projection 474 disposed on a rigidly fixed rocker support (not shown). The rectangular projection 474 has a fixed position relative to the cam 402 and can thus guide the vertical movement of the rocker 404 and limit the degree to which the pivot point of the rocker 404 can be adjusted.

The bearing element 436 is disposed between opposed rocker pedestal portions 476, 478 which are movable relative to each other such that sliding movement of the bearing element 436 is effective to adjust a height H of the pedestal assembly. In the illustrated embodiment, the bearing element 436 has a wedge-shaped cross-section, although it will be appreciated that a variety of cross-sections can be used without departing from the scope of the present invention. A plurality of roller bearings 480 can be provided to facilitate sliding movement of the bearing element 436 relative to the pedestal portions 476, 478. Also, in the illustrated embodiment, the upper pedestal portion 476 extends through a slot in the rocker 404 to integrally connect to the rocker shaft 428. The slot is sized to receive the upper pedestal portion 476 and to allow for pivoted movement of the rocker 404 during a valve event.

In operation, the cam 402 rotates clockwise as a camshaft to which it is mounted is driven by rotation of the engine's crankshaft. When the base circle portion 418 of the cam 402 engages the rocker 404, the rocker 404 remains in a position in which the forked rocker pad 420 does not apply sufficient lifting force to the valve 406 to overcome the bias of the valve spring, and therefore the valve 406 remains closed on its seat.

As the cam 402 rotates, a dwelled actuating portion 426 thereof engages the rocker 404. The actuating portion 426 imparts a downward force to the rocker 404, causing it to rotate counterclockwise and lift the valve 406 off of its seat until the actuating portion 426 rotates past the rocker 404 or until a lost-motion function is performed.

An actuation system 300 is used as described above to allow the bearing element 436 to be driven partially out from between the pedestal portions 476, 478 when a lost-motion function is called for (i.e., when it is desired to close the valve 406 before the closing ramp 432 of the cam 402 reaches the rocker 404). As the bearing element 436 is withdrawn, the downward force applied to the rocker 404 by the cam 402 and by the valve spring causes the upper pedestal portion 476 and the rocker shaft 428 attached thereto to move away from the cam 402. In other words, the pivot point of the rocker 404 moves downward as the rocker shaft 428 slides relative to the fixed projection 474 inserted through the aperture 472.

When the bearing element 436 is withdrawn far enough from the pedestal portions 476, 478, insufficient motion is imparted from the cam 402 to the rocker 404 for the valve 406 to actually be lifted off of its seat, and thus the valve 406 closes or remains closed. The valve train 400 thus provides a lost-motion feature that allows for variable valve actuation (i.e., permits the valve 406 to close at an earlier time than that provided by the profile of the cam 402).

It will be appreciated that the angle of the wedge-shaped bearing element 436 can be adjusted to alter the magnitude of valve train forces that are exerted on the actuation system 300 and/or the amount of lost-motion piston 364 stroke required to accomplish the lost-motion. For example, as the angle of the wedge approaches zero, the axial forces on the actuation system 300 decrease but the amount of stroke required for the lost-motion piston 364 increases. Similarly, as the angle of the wedge approaches 90 degrees, the axial forces on the actuation system 300 increase while the amount of stroke required decreases. Higher axial forces require the use of a larger, sturdier actuation system 300. Longer lost-motion piston 364 stroke decreases the reaction time of the system, as it takes longer to drain fluid from the larger distal chamber 322. Also, a shorter stroke reduces the effective mass, which results in a higher actuation speed, while a longer stroke increases the effective mass, which results in a slower actuation speed. The wedge shape of the bearing element 436 permits these parameters to be optimized such that a reasonably-sized actuation system 300 can be used without sacrificing too much in the way of response time. The stroke of the lost-motion piston 364 ranges between a lower value equal to the amount of valve lift to be lost and an upper value equal to about 2-3 times the amount of valve lift to be lost. The angle of the wedge ranges between about 0 degrees and about 25 degrees, and preferably is about 20 degrees. The angle of the wedge can also be adjusted based on the ratio of the rocker 404 being used.

Figure 9B:
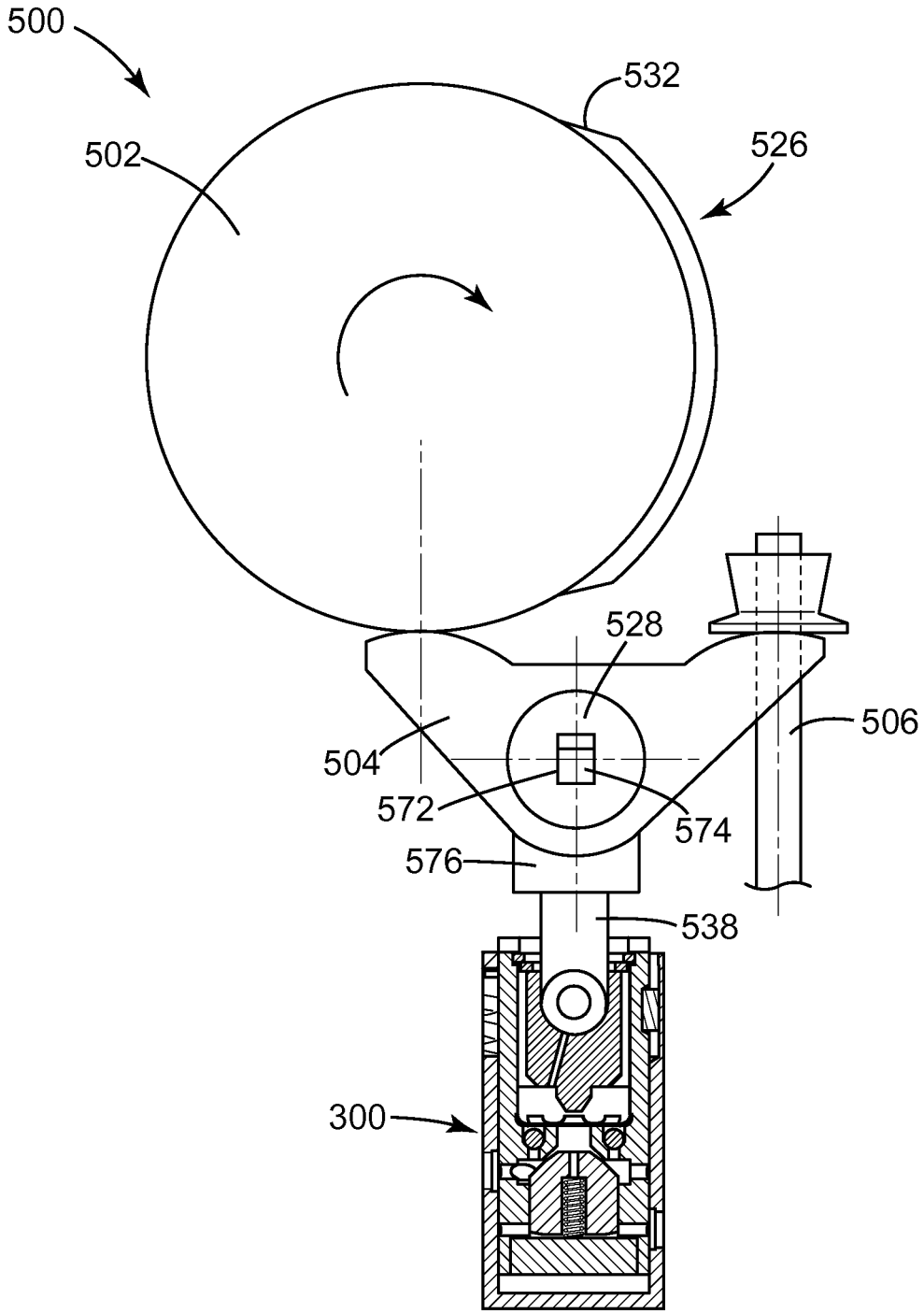
FIG. 9B is a schematic cross-sectional view of another embodiment of a valve train that includes the actuation system of FIG. 3.

FIG. 9B illustrates another exemplary valve train 500 in which the rocker pedestal 576 is supported directly by the connecting arm 538 of the actuation system 300. Operation of the valve train 500 shown in FIG. 9B is substantially identical to that shown in FIG. 9A, except that instead of the actuation system 300 allowing a bearing element to be ejected from between opposing rocker pedestal portions to adjust the pedestal height, the pedestal 576 itself is directly lowered by the actuation system 300. Accordingly, the cam 502 (with its associated dwelled actuating portion 526 and closing ramp 532), rocker 504, outwardly opening valve 506, rocker shaft 528 (with its associated rectangular aperture 572) and rectangular projection 574, as well as the rest of the components of valve train 500, are all substantially identical to and function in substantially the same manner as their corresponding component in valve train 400.

Figure 9C:
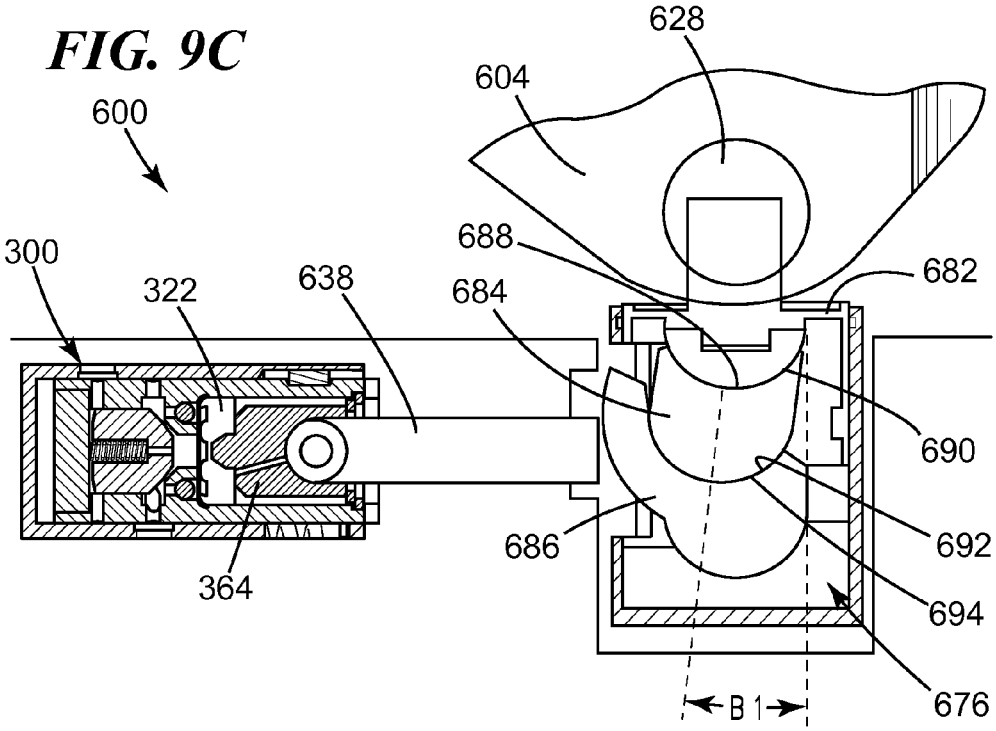
FIG. 9C is a schematic cross-sectional view of another embodiment of a valve train that includes the actuation system of FIG. 3, shown with a rocker pedestal in an extended configuration.
Figure 9D:
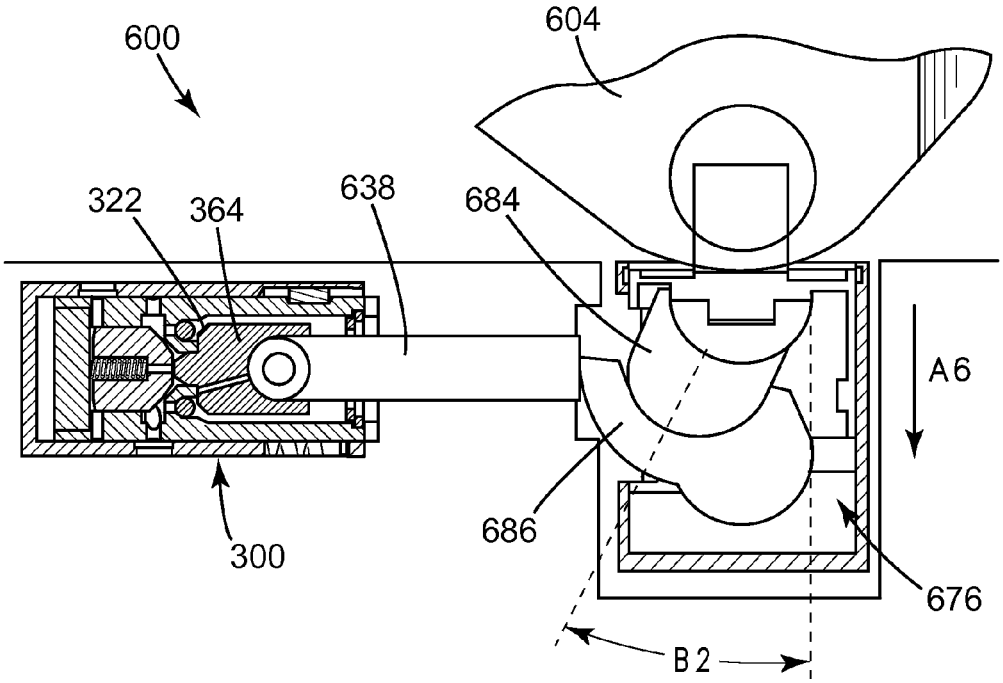
FIG. 9D is a schematic cross-sectional view of the valve train of FIG. 9C, shown with the rocker pedestal in a collapsed configuration.

FIGS. 9C-9D illustrate another exemplary valve train 600 for collapsing the pivot point of a rocker 604 to achieve a lost-motion effect. As shown, a locking knee collapsible rocker pedestal 676 is provided that includes a rocker shaft support housing 682 mounted above a knee linkage that includes a femur 684 and a shin 686. A rocker 604 is rotatably mounted about a rocker shaft 628, which is in turn fixedly mated to the support housing 682. The support housing 682 includes a cylindrical protrusion 688 that is received within a first cylindrical slot 690 formed in the femur 684 such that the femur 684 is rotatable relative to the support housing 682. The femur 684 also includes a cylindrical edge 692 opposite the first cylindrical slot 690. The cylindrical edge 692 is received in a corresponding cylindrical slot 694 formed in the shin 686 such that the femur 684 and the shin 686 are rotatable relative to each other.

In operation, the collapsible rocker pedestal 676 has a first extended configuration (shown in FIG. 9C) in which the femur 684 is positioned at a first angle B1 relative to the support housing 682 that is relatively small (e.g., about 8 degrees). When a lost-motion effect is required, the pivot height of the rocker 604 is dropped, thus allowing an engine valve coupled thereto to close earlier than what is called for by the profile of its corresponding cam. This is accomplished by actuating the actuation system 300, thereby allowing downward forces (e.g., in the direction of the arrow A6) exerted on the rocker 604 by the cam and/or the valve spring to cause the collapsible rocker pedestal 676 to transition to a collapsed configuration, as shown in FIG. 9D. In this configuration, the "knee" formed at the intersection of the femur 684 and the shin 686 buckles or articulates, driving the connecting arm 638 and lost-motion piston 364 proximally into the distal chamber 322 of the actuation system 300. In the collapsed configuration, the femur 684 forms a second angle B2 relative to the housing 682 that is greater than the first angle B1. In one embodiment, the angle B2 can be about 23 degrees.

Once the actuating portion of the cam has rotated past the rocker 604, the collapsible rocker pedestal 676 is transitioned back into the extended configuration by the refilling of the actuation system 300. As the actuation system 300 refills, the lost-motion piston 364 and connecting arm 638 force the femur 684 and the shin 686 to articulate or "straighten," thereby extending the collapsible rocker pedestal 676 and lifting the pivot point of the rocker 604 back to the position shown in FIG. 9C.

Figure 9E:
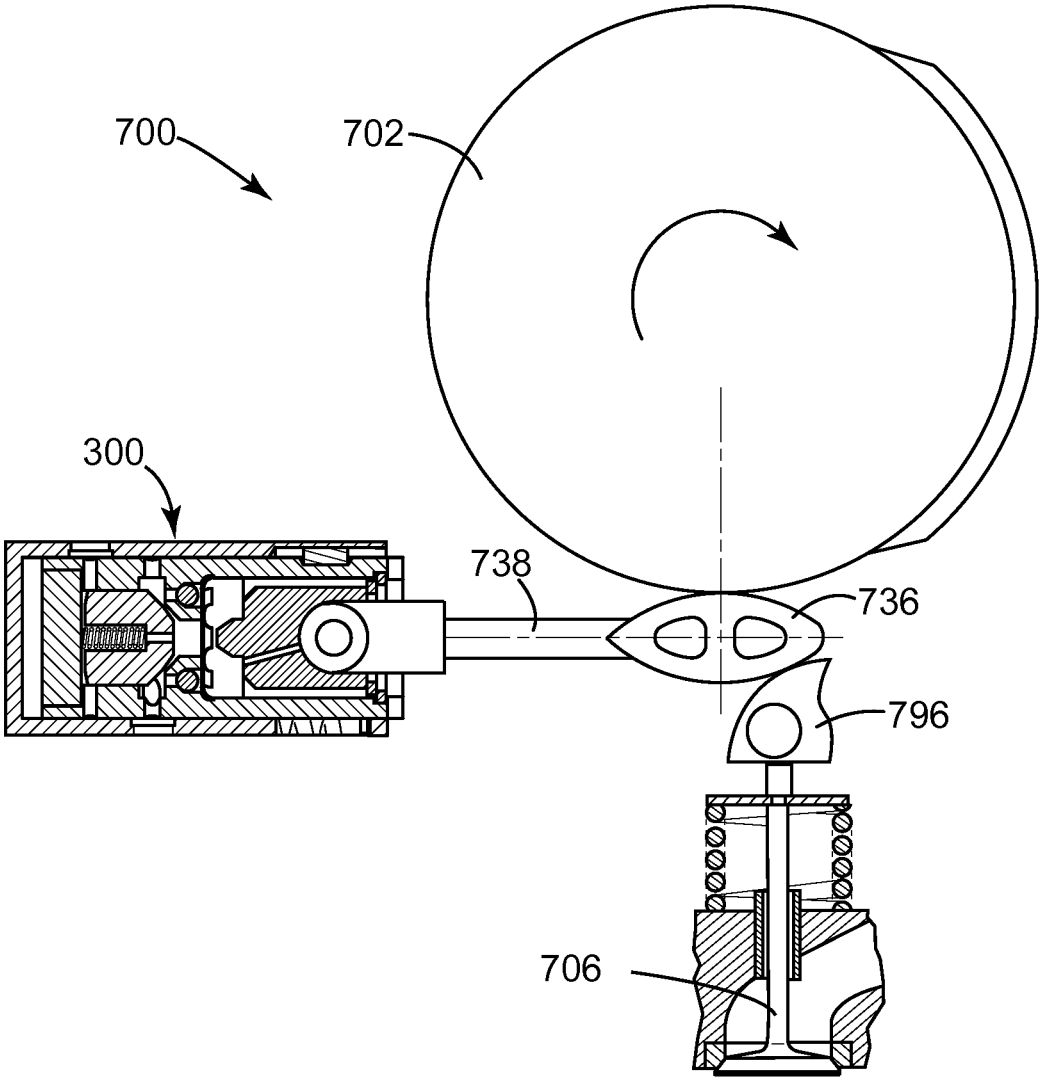
FIG. 9E is a schematic cross-sectional view of another embodiment of a valve train that includes the actuation system of FIG. 3.

FIG. 9E illustrates an exemplary embodiment of a valve train 700 for use with an inwardly-opening engine valve 706 (i.e., an engine valve that opens into or towards the engine cylinder). The structure and operation of the valve train 700 is substantially similar to the valve train 200 described above, except that the rocker is omitted such that the bearing element 736 is in direct contact with the valve 706 or contacts the valve 706 via one or more intermediate elements 796. In particular, the actuation system 300 selectively holds the bearing element 736 between the cam 702 and the intermediate element 796 such that motion of the cam is transferred to the engine valve 706. When lost-motion is desired (e.g., to close the engine valve 706 earlier than what is called for by the cam), the actuation system 300 is actuated to retract the connecting arm 738 and allow the bearing element 736 to be at least partially ejected from between the cam 702 and the intermediate element 796. As the bearing element 736 moves out from between the cam 702 and intermediate element 796, the intermediate element 796 is able to move towards the cam 702, allowing the engine valve 706 to close.

In some of the valve trains described above, a bearing element is positioned between first and second valve train components (e.g., a cam and a rocker). In certain instances, misalignment of these components relative to one another can lead to a substantial bending moment acting on the bearing element. For example, in the case of a bearing element disposed between a cam and a rocker, this bending moment acts to push the bearing element laterally relative to the cam and rocker (e.g., in a direction substantially parallel to the axis of rotation of the cam and/or the axis of rotation of the rocker). This bending moment can be exacerbated when one or more of the valve train contact surfaces are crowned in the widthwise direction, as the lateral component of the forces applied to the bearing element is increased in such embodiments.

FIGS. 10A-10F illustrate an exemplary embodiment of a bearing element 836 that can reduce and/or at least partially compensate for the bending moment applied thereto by a misaligned cam and rocker. The illustrated bearing element 836 includes a plurality of component parts. In particular, the bearing element 836 includes a major portion 837 formed integrally with a connecting arm 838 and a separate pad 839 slidably received in a pocket 841 formed in the major portion 837. As shown, the major portion 837 defines a cam-facing bearing surface 842 and the pad 839 defines a rocker-facing bearing surface 844.

The bearing surfaces 842, 844 in the illustrated embodiment are both sections of cylinders (i.e., they have a finite radius of curvature in the length direction L and no (or infinite) radius of curvature in the width direction W). It will be appreciated, however, that one or both of the bearing surfaces 842, 844 can be crowned instead (i.e., such that the surface has a finite radius of curvature in the length direction L and a finite radius of curvature in the width direction W). Likewise, the surfaces of the cam and rocker pad which interface with the bearing surfaces 842, 844 can be crowned or uncrowned. In some embodiments, the cam-facing bearing surface 842 has a lengthwise radius of curvature that is less than a lengthwise radius of curvature of the rocker-facing bearing surface 844. For example, the cam-facing bearing surface 842 can have a lengthwise radius of curvature of approximately 17 mm and the rocker-facing bearing surface 844 can have a lengthwise radius of curvature of approximately 50 mm.

Figure 10A:
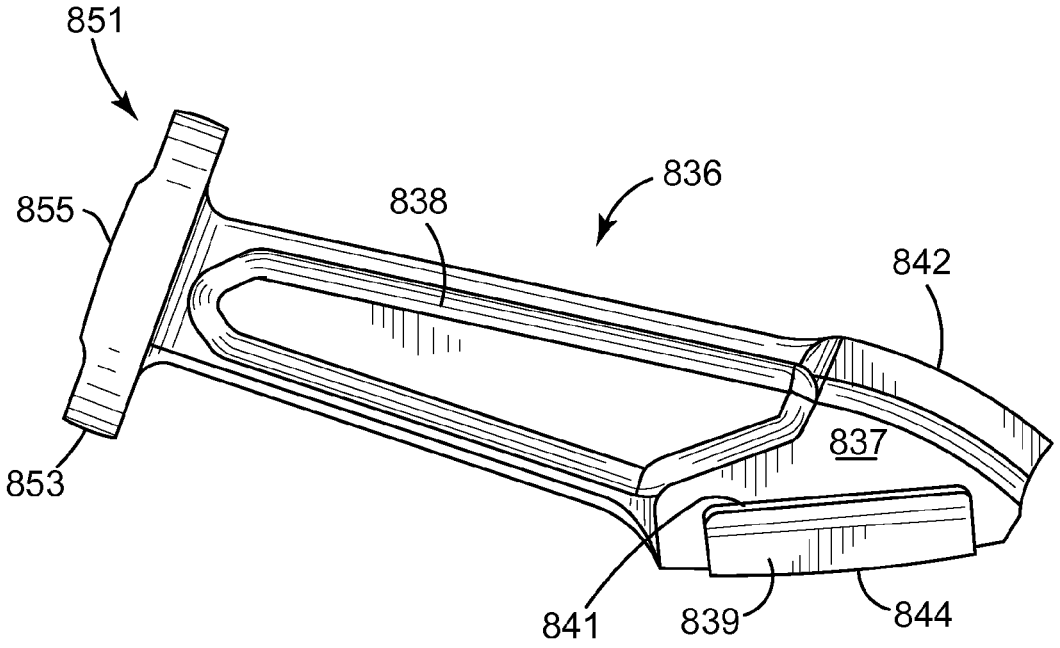
FIG. 10A is a schematic side view of another exemplary embodiment of a bearing element.
Figure 10B:
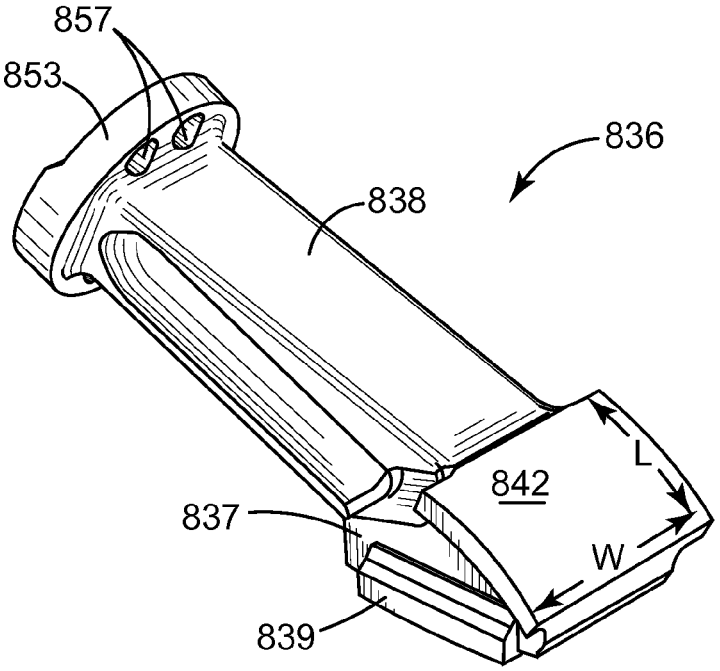
FIG. 10B is a schematic perspective view of the bearing element of FIG. 10A from above and from the front.
Figure 10C:
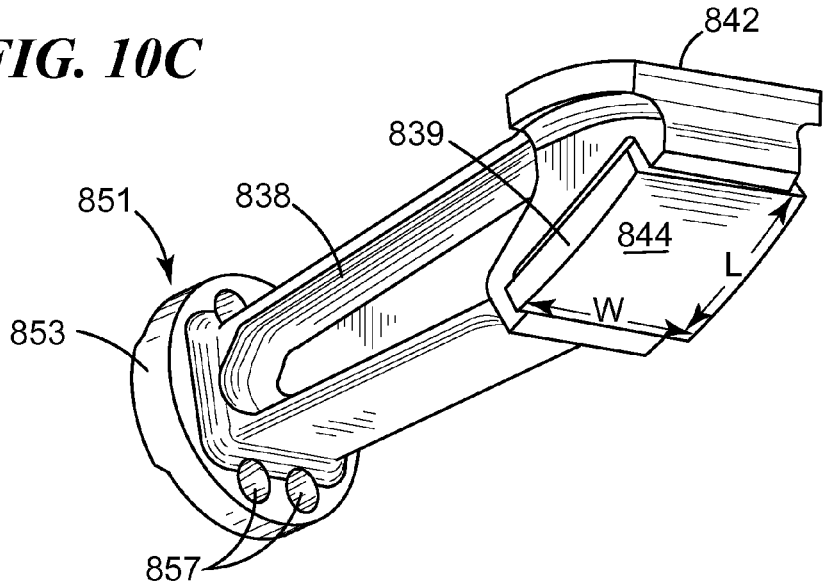
FIG. 10C is a schematic perspective view of the bearing element of FIG. 10A from below and from the front.
Figure 10D:
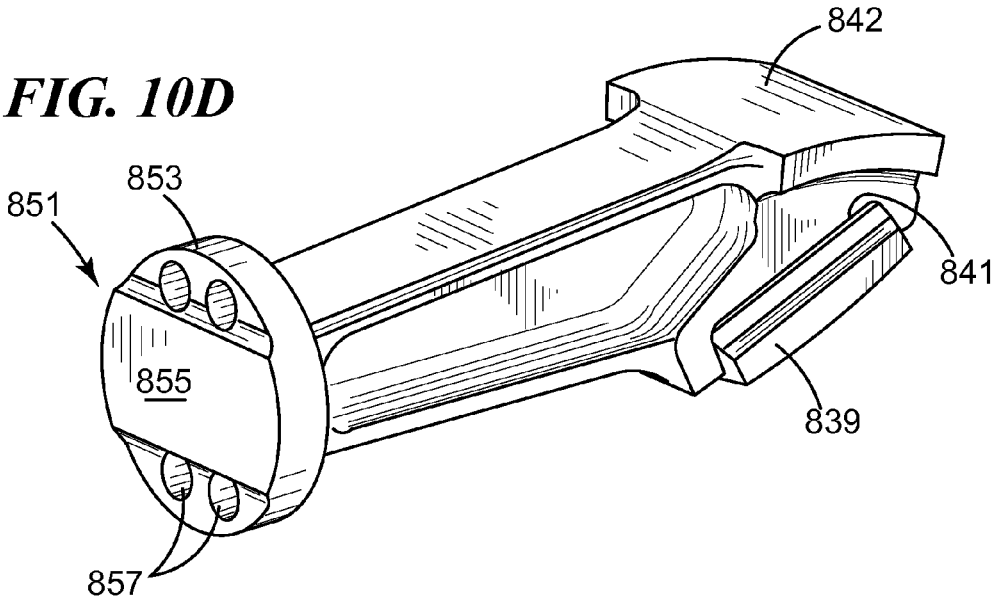
FIG. 10D is a schematic perspective view of the bearing element of FIG. 10A from above and from the rear.
Figure 10E:
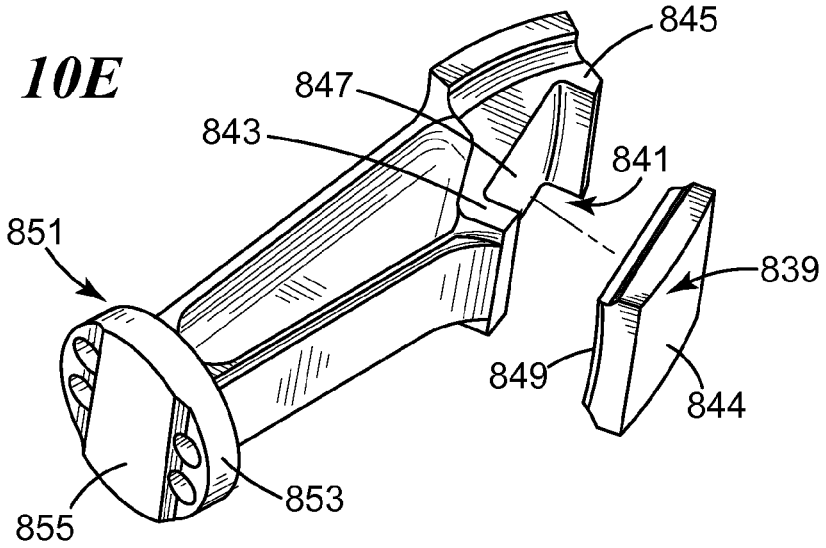
FIG. 10E is an exploded schematic perspective view of the bearing element of FIG. 10A from below and from the rear.
Figure 10F:
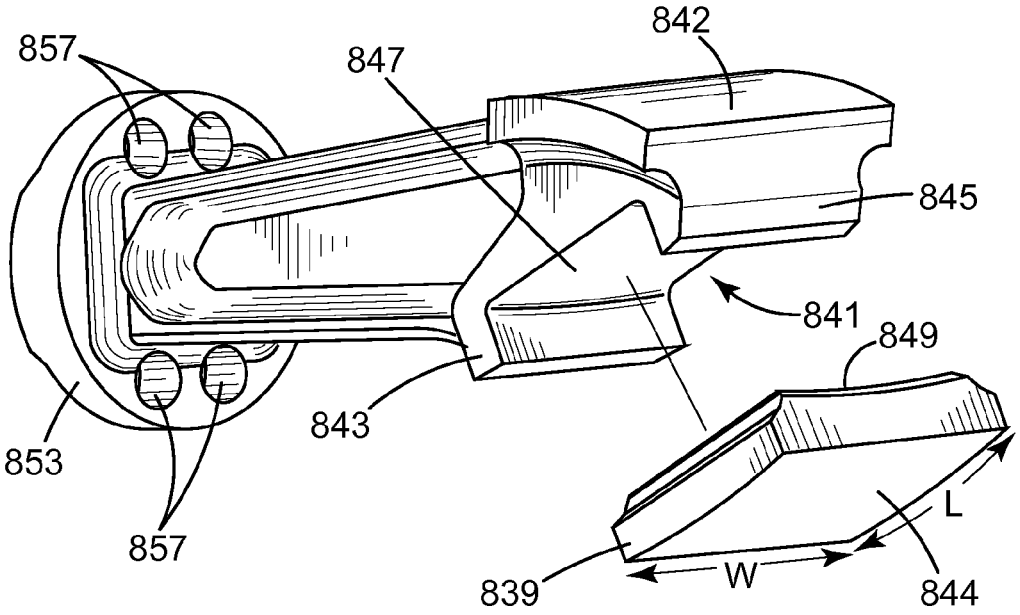
FIG. 10F is an exploded schematic perspective view of the bearing element of FIG. 10A from the side and from the front.

As shown in the exploded views of FIGS. 10E-10F, the pocket 841 is defined by proximal and distal stops 843, 845 and a pad-facing surface 847. A pocket-facing surface 849 formed on the opposite side of the pad 839 from the rocker-facing bearing surface 844 slidably engages the pad-facing surface 847 of the pocket 841. In the illustrated embodiment, the pad-facing surface 847 and the pocket-facing surface 849 are both sections of cylinders oriented transversely to the cylinders from which the bearing surfaces 842, 844 are formed. In other words, the pad-facing surface 847 and the pocket-facing surface 849 both have no (or infinite) radius of curvature in the length direction L and a finite radius of curvature in the width direction W. It will be appreciated, however, that one or both of said surfaces can also be crowned in the length direction (i.e., such that the surface has a finite radius of curvature in the length direction L and a finite radius of curvature in the width direction W).

Figure 11A:
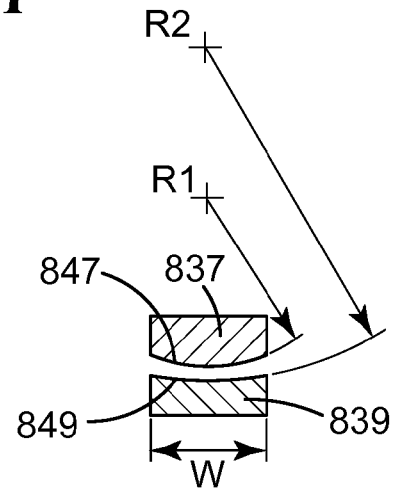
FIG. 11A is a schematic end view of a pad-facing surface and a pocket-facing surface of the bearing element of FIG. 10A.

In some embodiments, the pad-facing surface 847 has a widthwise radius of curvature that is very close to, but slightly less than, a widthwise radius of curvature of the pocket-facing surface 849. For example, the pad-facing surface 847 can have a widthwise radius of curvature of approximately 40 mm and the pocket-facing surface 849 can have a widthwise radius of curvature of approximately 40.4 mm. This difference in curvature is illustrated schematically in FIGS. 11A-11C, and can provide a number of potential advantages. In FIG. 11A, the pad-facing surface 847 has a widthwise radius of curvature R1, and the pocket-facing surface 849 has a widthwise radius of curvature R2 that is greater than R1.

Figure 11B:
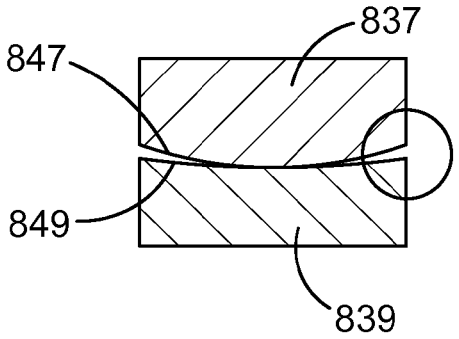
FIG. 11B is another schematic end view of the pad-facing surface and the pocket-facing surface of the bearing element of FIG. 10A.

As shown in FIG. 11B, the difference between R1 and R2 produces a small gap (circled in the figure) between the surfaces 847, 849 at the edges of the pad 839 when the system is not loaded. This gap allows lubricating fluid to flow between the surfaces 847, 849, which is later squeezed out when the system is loaded. This cycle repeats as the system is alternately loaded and unloaded, allowing for a steady supply of lubricating fluid to the contact surfaces 847, 849.

Figure 11C:
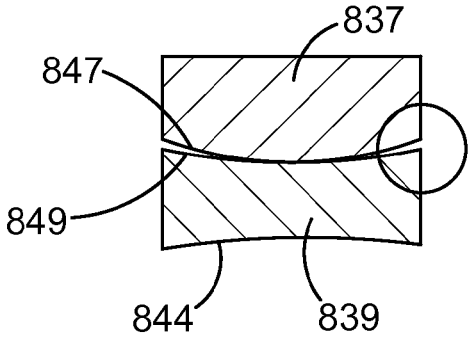
FIG. 11C is a schematic end view of the pad-facing surface and the pocket-facing surface of the bearing element of FIG. 10A when a concave defect is present.

The difference between R1 and R2 also allows the pad 839 to flex slightly when the system is loaded. This can be particularly advantageous when the rocker-facing bearing surface 844 of the pad 839 is formed with a concavity as shown in FIG. 11C (e.g., due to manufacturing defects or tolerances). In such instances, the difference between R1 and R2 allows the pad 839 to flex when the system is loaded and substantially conform to the pad-facing surface 847, thereby allowing the rocker-facing surface 844 to become substantially planar, which prevents the undesirable point contact with the rocker that would otherwise result from the concave nature of the rocker-facing bearing surface 844.

Any of the bearing elements disclosed herein, including the bearing element 836, can include one or more surfaces having various features or coatings configured to improve the durability or other properties of the surface. For example, a hard wearing coating such as DLC ("diamond-like coating") can be applied to one or more surfaces of the bearing element 836. In an exemplary embodiment, the cam-facing bearing surface 842, the pocket-facing surface 849, and the rocker-facing bearing surface 844 are each coated with DLC. In one embodiment, the major portion 837 of the bearing element 836 and the pad 839 are formed from high strength steel, such as BM4-W.

In the embodiment illustrated in FIGS. 10A-10F, the connecting arm 838 has an I-shaped cross section and extends proximally from the bearing element 836 to a mating portion 851 configured to couple the connecting arm 838 to the lost-motion piston 364 of the actuation system 300 described above. As shown, the mating portion 851 includes a major portion 853 that forms a section of a sphere and a minor portion 855 extending from the major portion 853 that forms a section of a cylinder. The minor portion 855 is configured to bear against the planar distal surface of the lost-motion piston 364 of the actuation system 300. In one embodiment the major portion 853 is a section of a sphere having a radius of approximately 6 mm and the minor portion 855 is a section of a cylinder having a radius of approximately 41.5 mm. One or more holes 857 are formed in the mating portion 851 to allow lubricating fluid to flow through the major portion 853 and lubricate the interface between the minor portion 855 and the lost-motion piston 364. The holes 857 also reduce the mass of the mating portion 851, which permits faster actuation speeds. Furthermore, the holes 857 allow for local deformation of the mating portion 851 (e.g., the major portion 853) when the system is loaded to more evenly distribute forces between the mating portion 851 and the sleeve or bore in which the lost-motion piston 364 is disposed.

In use, movement between the pad 839 and the major portion 837 of the bearing element 836 takes up any misalignment that may exist between the valve train components, such as the cam and the rocker, thereby reducing or eliminating the bending moment applied to the bearing element 836. In particular, the pocket-facing surface 849 of the pad 839 slides relative to the pad-facing surface 847 of the pocket 841, continually adapting to changes in alignment between the cam and the rocker.

Figure 12:
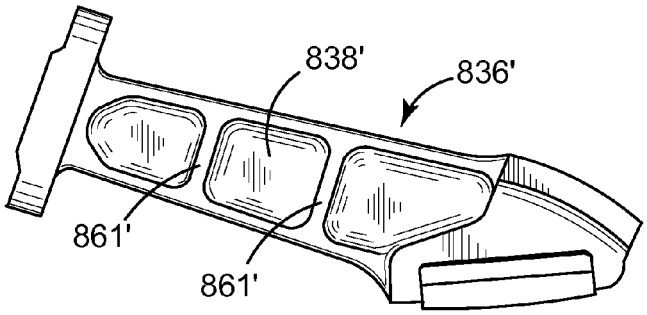
FIG. 12 is a schematic side view of another exemplary embodiment of a bearing element.

FIG. 12 illustrates another embodiment of a bearing element 836' in which a connecting arm 838' having a generally I-shaped cross section is formed with integral vertical struts 861' to increase the stiffness of the connecting arm 838'.

Figure 13A:
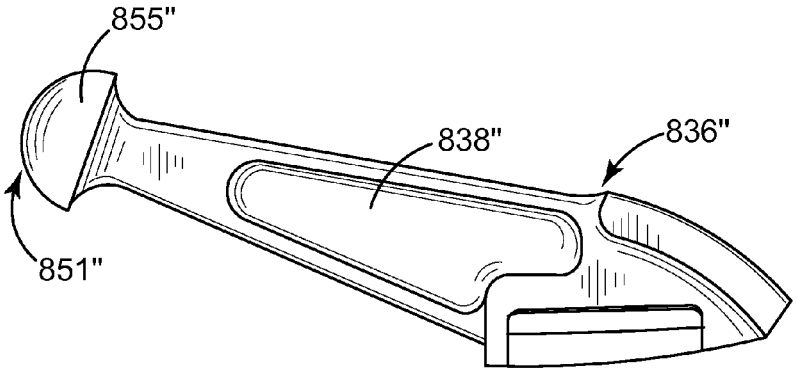
FIG. 13A is a schematic side view of another exemplary embodiment of a bearing element.
Figure 13B:
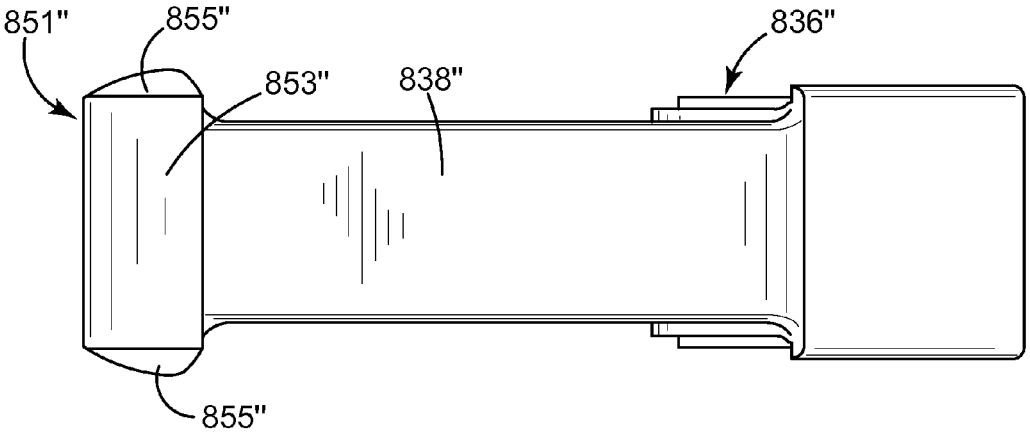
FIG. 13B is a schematic top view of the bearing element of FIG. 13A.
Figure 14A:
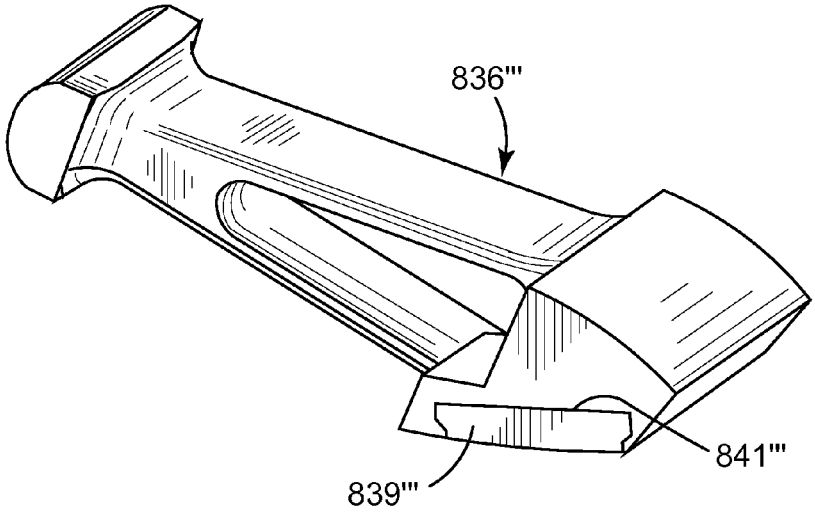
FIG. 14A is a schematic perspective view of another exemplary embodiment of a bearing element from above and from the front.
Figure 14B:
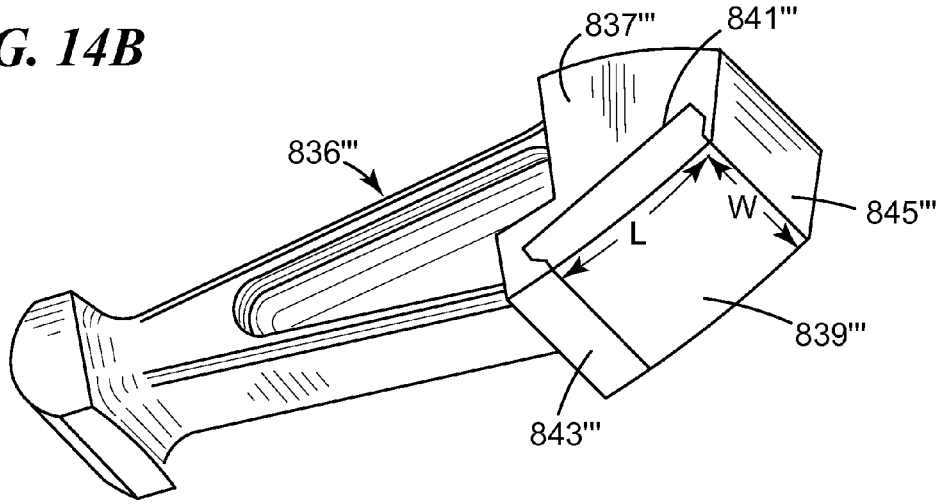
FIG. 14B is a schematic perspective view of the bearing element of FIG. 14A from below and from the front.
Figure 14C:
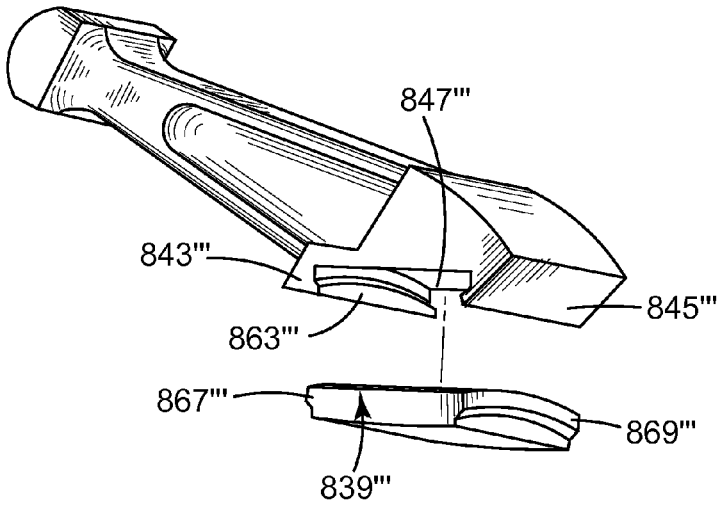
FIG. 14C is an exploded schematic perspective view of the bearing element of FIG. 14A from the side and from the front.
Figure 14D:
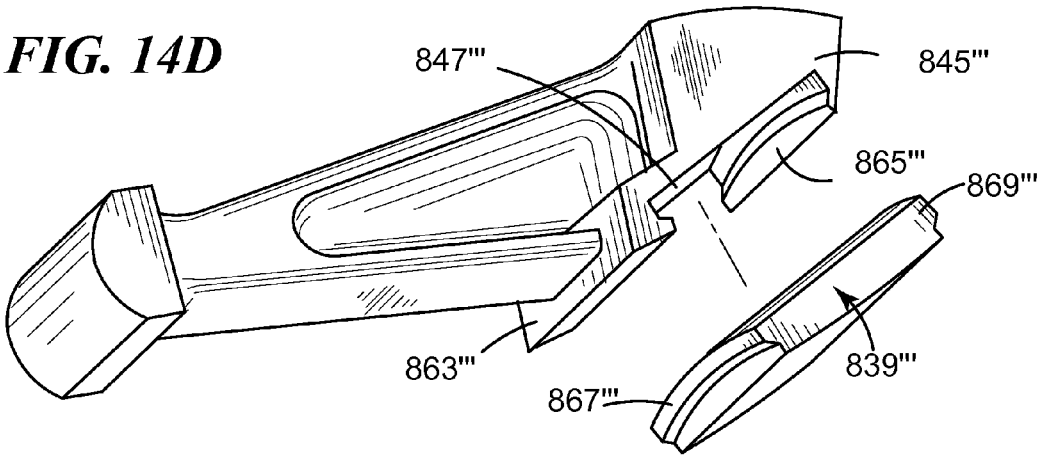
FIG. 14D is an exploded schematic perspective view of the bearing element of FIG. 14A from the side and from the rear.

FIGS. 13A-13B illustrate another embodiment of a bearing element 836" and connecting arm 838" in which the mating portion 851" comprises a major portion 853" that forms a section of a cylinder and first and second minor portions 855" that form sections of a sphere. In one embodiment, the major portion 853" forms a section of a cylinder having a radius of approximately 3.5 mm and the minor portions 855" form sections of a sphere having a radius of approximately 6 mm.

FIGS. 14A-14D illustrate another embodiment of a bearing element 836''' in which features are provided to limit the degree to which the pad 839''' is permitted to move relative to the pocket 841'''. As shown, the bearing element 836''' includes a major portion 837''' having a pocket 841''' formed therein, the pocket being defined by proximal and distal stops 843''', 845''' and a pad-facing surface 847'. The proximal stop 843''' has a rib 863''' projecting distally therefrom, and the distal stop 845''' has a rib 865''' projecting proximally therefrom. A pad 839''' is slidably received within the pocket 841''', and includes proximal and distal tabs 867', 869''' extending therefrom and configured to fit between the ribs 863''', 865''' and the pad-facing surface 847'''. The ribs and tabs are curved in the widthwise direction. In addition, the radius of curvature of the ribs and the tabs is selected relative to the widthwise radius of curvature of the pad-facing surface 847''' such that sliding movement of the pad 839''' relative to the pocket 841''' is limited to a particular range.

Figure 15:
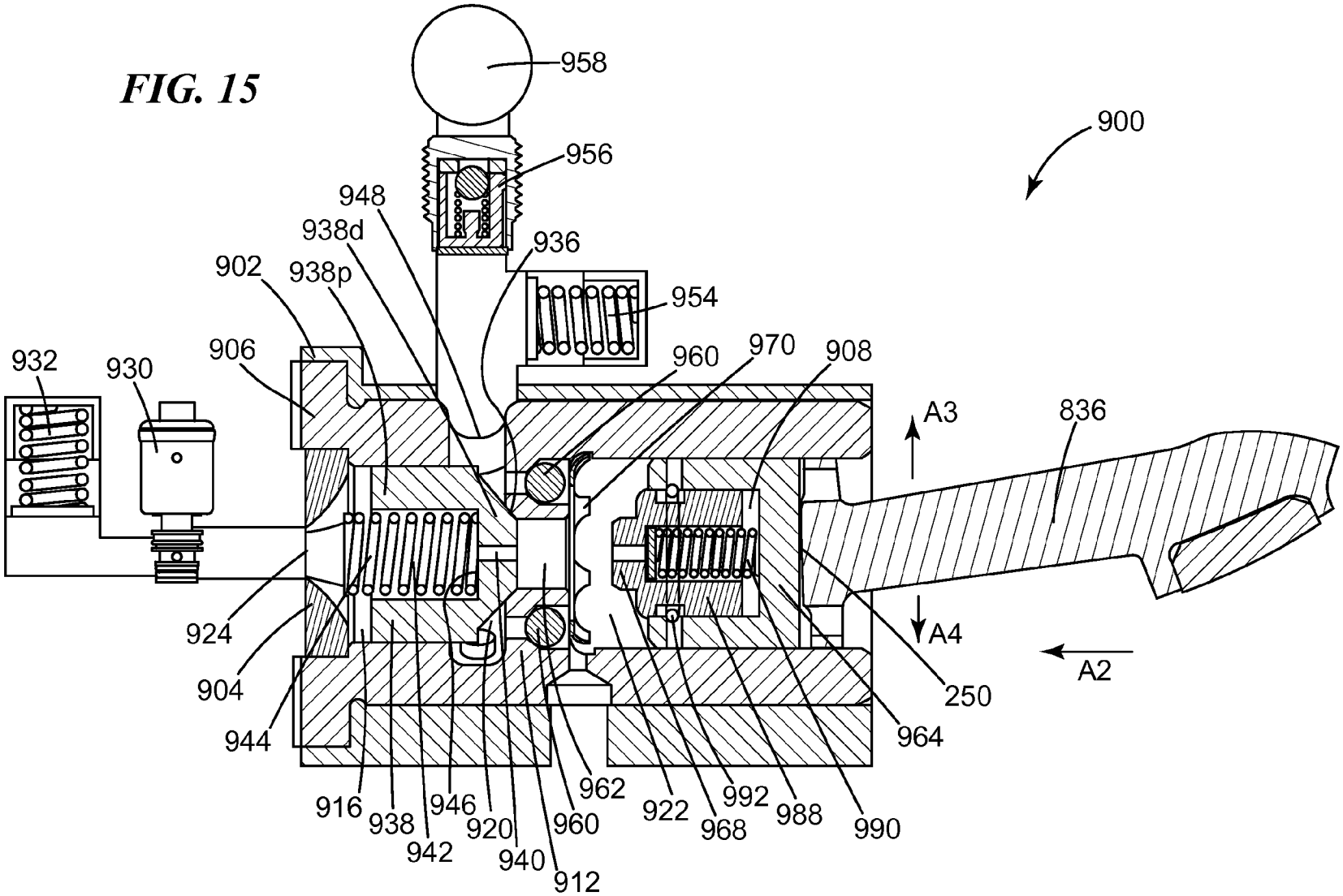
FIG. 15 is a schematic cross-sectional view of another embodiment of an actuation system.

FIG. 15 illustrates another exemplary embodiment of an actuation system 900. The actuation system 900 can be used in place of the actuation system 300 described above in any of the valve trains disclosed herein. The structure and operation of the actuation system 900 is substantially similar to that of the actuation system 300, except as described below and as will be readily appreciated by those having ordinary skill in the art. Accordingly, a detailed description thereof is omitted here for the sake of brevity.

As shown in FIG. 15, the system 900 includes a cylindrical housing 902 having a sleeve 906 disposed therein. Unlike the piston 306 of the actuation system 300, the sleeve 906 is fixed within the housing 902. In other words, the sleeve 906 does not slide relative to the housing 902. The sleeve 906 includes a dividing wall 912 that defines two generally cylindrical chambers. A proximal chamber 916 is defined between a spring seat 904 and the dividing wall 912. A distal chamber 922 is defined between the dividing wall 912 and the open distal end of the sleeve 906.

The proximal chamber 916 is in fluid communication with a hydraulic circuit that includes a high-speed trigger (or pilot) valve 930 and a trigger (or pilot) accumulator 932 via an opening 924 formed in the spring seat 904. The trigger valve 930 can be actuated (e.g., under the control of a engine control computer or other electronic controller) to selectively place the proximal chamber 916 in fluid communication with the trigger accumulator 932. Any of a variety of trigger valves can be used, such as solenoid-type valves available from Jacobs Vehicle Systems, Inc. of Bloomfield, Conn. In one embodiment, the high-speed trigger valve 930 has a volume of 0.492 $cm^3$ and a 0.8 ms actuation time.

A main valve 938 is slidably disposed in the proximal chamber 916 such that it can travel between a fully closed position (in which a distal tapered portion 938*d* of the main valve 938 is seated against a valve seat 936 formed in the dividing wall 912) and a fully-opened position (in which the main valve 938 approaches and/or contacts the spring seat 904 that defines the proximal extent of the proximal chamber 916).

The main valve 938 has a proximal portion 938*p* that is generally cylindrical and a distal portion 938*d* that is tapered. In one embodiment, the proximal portion 938*p* has an outside diameter of approximately 11 mm and the distal portion 938*d* has an outside diameter of approximately 5 mm at the contact line where the tapered distal portion 938*d* contacts the valve seat 936. In this exemplary embodiment, the distal portion 938*d* tapers further distally from the contact line until it terminates at a distal end having an outside diameter that is less than approximately 5 mm. The taper of the distal portion 938*d* can be linear or non-linear. An orifice 940 formed through the distal portion 938*d* is in fluid communication with a central lumen 942 formed in the proximal portion 938*p*, in which a bias spring 944 is disposed. The bias spring 944 is compressed between the spring seat 904 and a shoulder 946 formed at the junction of the orifice 940 and the lumen 942 such that the spring 944 biases the main valve 938 towards the fully-closed position. In one embodiment, the bias spring 944 has a preload of approximately 50N and a stiffness of approximately 13 N/mm.

The orifice 940 and the central lumen 942 together define a fluid passageway that extends all the way through the valve 938, which facilitates pressure balancing across the valve 938 as discussed below. In one embodiment, the orifice 940 can have a diameter of approximately 1 mm.

The main valve 938 can optionally be a multi-component device formed from one or more different materials. For example, the exterior of the main valve 938 can be formed from steel to provide stiffness and favorable thermal expansion and contraction properties, while the core of the main valve 938 can be formed from aluminum, resin, or plastic to reduce the weight of the valve 938 and increase its reaction time.

A middle chamber 920 of generally annular shape is formed below the main valve 938 adjacent to the main valve seat 936. The middle chamber 920 is in fluid communication, via an opening 948, with a hydraulic circuit that includes a main accumulator 954 and check valve 956 coupled to a hydraulic fluid source 958 (e.g., the oil supply of an engine in which the actuation system 900 is installed). The check valve 956 permits one-way flow of fluid from the source 958 to the middle chamber 920. The main accumulator 954 is positioned in close proximity to the chamber 920, which is preferred over alternative arrangements (such as those in which the accumulator 954 is omitted in favor of a long threading back to the engine oil supply) because it allows fluid to be supplied to refill the middle chamber 920 and distal chamber 922 very quickly.

The dividing wall 912 also includes one or more refill check valves 960 which permit one-way flow of fluid from the middle chamber 920 to the distal chamber 922. In one embodiment, four check valves 960 are provided in the dividing wall 912, spaced approximately 90 degrees apart from one another about the circumference of the valve seat 936. The use of multiple small check valves 960 provides a faster reaction time than a single large check valve, allowing a large aggregate flow area to be provided very quickly. A seating control opening 962 extends through the valve seat 936 and the dividing wall 912 to provide a fluid passageway between the distal chamber 922 and the middle chamber 920.

A lost-motion piston 964 is slidably disposed in the distal chamber 922 and is coupled to a bearing element of a valve train (e.g., the bearing element 836 shown in FIGS. 10A-10F). The lost-motion piston 964 can be coupled to the bearing element 836 in any of a variety of ways, as described in detail above. In the illustrated embodiment, the proximal end of the bearing element 836 has a convex surface 250 that forms part of a cylinder. The convex surface 250 is seated against the planar distal surface of the lost-motion piston 964, such that the bearing element 836 can pivot relative to the lost-motion piston 964 in the direction of the illustrated arrows A3, A4. In one embodiment, the lost-motion piston 964 has a diameter of between about 10 mm and about 14 mm. Preferably, the lost-motion piston 964 has a diameter of about 12 mm.

Figure 16:
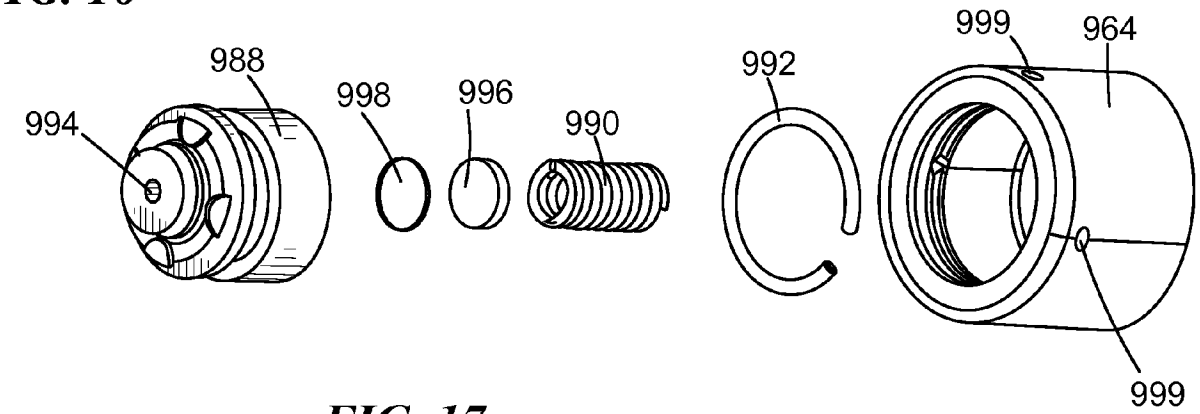
FIG. 16 is an exploded view of the lost-motion piston and valve catch plunger of the actuation system of FIG. 15.

An autolash plenum 908 is formed in the lost-motion piston 964 with a valve catch plunger 988 slidably disposed therein. An autolash spring 990 is compressed between the lost-motion piston 964 and the valve catch plunger 988 such that the two are biased apart from one another by the spring force. In some embodiments, the autolash spring 990 can provide a force equivalent to a 1 bar pressure differential between the autolash plenum 908 and the distal chamber 922. A locking ring 992 is disposed within an annular recess formed in the interior of the lost-motion piston 964 and an annular recess formed in the exterior of the valve catch plunger 988. The locking ring 992 acts both as a proximal end stop and as a distal end stop to limit the range of movement of the valve catch plunger 988 within the lost-motion piston 964. The lost-motion piston 964 and valve catch plunger 988 assembly is shown in greater detail in the exploded view of FIG. 16. As shown, a small orifice 994 is provided in the proximal surface of the valve catch plunger 988. One end of the autolash spring 990 contacts the lost-motion piston 964. The other end contacts a washer 996 which in turn contacts a rubber layer 998. When the components are assembled, the lost-motion piston 964 has oil in it, which creates a hydraulic lock preventing insertion of the valve catch plunger 988. The oil escapes during assembly through the center of the washer 996 and the rubber layer 998 acts as a check disc. The lost-motion piston 964 also includes a plurality of holes 999 through which a tool can be inserted to compress the locking ring 992, facilitating assembly and disassembly of the lost-motion piston 964 and the valve catch plunger 988.

Referring again to FIG. 15, the valve catch plunger 988 includes a seating control protrusion 968 that extends from the proximal-facing surface of the valve catch plunger 988 and that is sized to be received in the seating control opening 962 of the dividing wall 912. The seating control protrusion 968 can have a variety of shapes and sizes depending on the valve deceleration profile that is desired, as will be understood by one skilled in the art.

The dimensions of the valve catch plunger 988 and the distal chamber 922 in one exemplary embodiment of the actuation system 900 can be the same as those shown in FIG. 4A. As the valve catch plunger 988 translates proximally within the distal chamber 922, the seating control protrusion 968 enters the seating control opening 962, thereby forming a variable area flow opening and slowing the rate at which the engine valve 206 closes.

Proximal movement of the lost-motion piston 964 is limited by end stops 970 formed on the dividing wall 912, whereas distal movement of the lost-motion piston 964 is limited by the bearing element 836, cam 202, and rocker 204.

Figure 17:
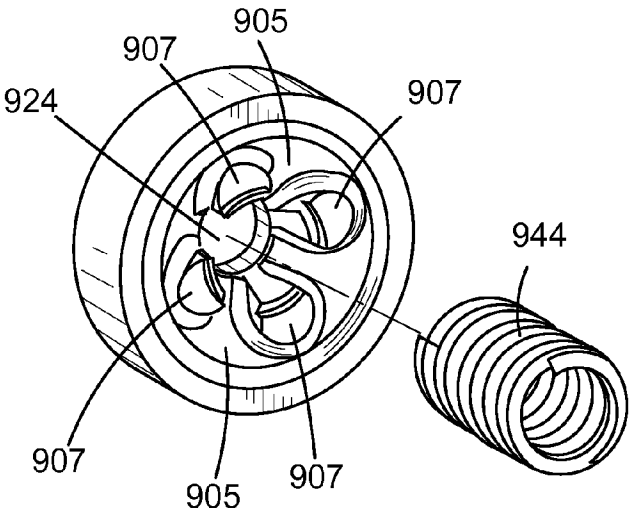
FIG. 17 is an exploded view of the spring seat and main valve bias spring of the actuation system of FIG. 15.

The spring seat 904 and main valve bias spring 944 are shown in greater detail in the exploded view of FIG. 17. As shown, the spring seat includes a conically tapered surface 905 that converges at an opening 924. Four radially spaced standoffs 907 extend distally from the surface 905 and define a ledge on which the proximal-most coil of the spring 944 is seated. During operation of the actuation system 900, the spring 944 can become compressed such that the distance between adjacent coils is reduced and the flow of hydraulic fluid from portions of the proximal chamber 916 external to the spring 944 into portions of the proximal chamber 916 internal to the spring 944 is restricted. In other words, when the spring 944 is compressed, it can undesirably restrict the flow of oil between the exterior of the spring and the interior of the spring. This is mitigated by the geometry of the spring seat 904, as the standoffs 907 provide a clearance space between the spring 944 and the tapered surface 905. Fluid external to the spring 944 is free to flow through this clearance space and into the opening 924, which is aligned with the interior of the spring 944.

Operation of the actuation system 900 is similar to that of the actuation system 300 described above with respect to FIGS. 5A-5E, except that the autolash function is performed by the valve catch plunger 988 and a stationary sleeve 906, instead of by a slidable autolash piston as in the embodiment of FIGS. 5A-5E.

In particular, the actuating portion 226 of the cam 202 can initially be in contact with the bearing element 836, which is fully advanced towards the cam 202 and rocker 204. In this configuration, the actuating portion 226 of the cam 202 bears against the bearing element 836, causing it to pivot relative to the lost-motion piston 964 and causing the rocker 204 to rotate counterclockwise to open the outwardly-opening engine valve. The valve train 200 is thus configured as shown schematically in FIG. 2B.

At this time, the bearing element 836 is loaded in the direction of arrow A2 by the cam rotation, the valve spring acting on the rocker 204, and net cylinder/port pressure acting on the engine valve head. This loading causes the pressure to rise in the distal chamber 922 of the actuation system 900. With the high-speed trigger valve 930 closed, the pressure in the proximal chamber 916 above the main valve 938 approximates that of the distal chamber 922, as fluid is unable to escape from the proximal chamber 916 and the pressure from the distal chamber 922 is communicated to the proximal chamber 916 through the orifice 940 in the main valve 938. Although the pressure is substantially the same, the main valve 938 is held closed against its seat 936 because the surface area of the main valve 938 exposed to the proximal chamber 916 is greater than the surface area of the main valve 938 exposed to the distal chamber 922. In addition, the main valve bias spring 944 helps hold the main valve 938 in the closed position, particularly during transient pressure fluctuations. Preferably, the volume of the proximal chamber 916 above the main valve 938 is small relative to the volume of the distal chamber 922. This allows the pressure across the main valve 938 to be balanced quickly, preventing the valve 938 from inadvertently popping open when the lost-motion piston 964 is loaded by the valve train 200. At the same time, the volume of the proximal chamber 916 above the main valve 938 must be large enough to allow the main valve 938 to open far enough to achieve the desired flow rate therethrough. The volume of the proximal chamber 916 includes the fluid line running to the trigger valve 930, and therefore to help balance this tradeoff, the trigger valve 930 can be positioned in very close proximity to the proximal chamber 916 to keep the volume down.

During this time, the autolash spring 990 urges the valve catch plunger 988 away from the lost-motion piston 964, effectively creating a pressure differential between the autolash plenum 908 and the distal chamber 922. This results in migration of hydraulic fluid from the distal chamber 922 into the autolash plenum 908, taking up any lash in the valve train 200.

At some later time, the actuation system 900 can be actuated to close the engine valve 206 early (i.e., before the closing ramp 232 of the cam 202 is reached). When valve closing control is called for, the high-speed trigger valve 930 is opened, which allows the pressurized fluid in the proximal chamber 916 to flow into the trigger accumulator 932. Fluid also begins to flow from the distal chamber 922, through the main valve orifice 940, and into the proximal chamber 916 and trigger accumulator 932. The size of the orifice 940 is small enough, however, that the fluid cannot flow fast enough to balance the pressure across the main valve 938. The resulting pressure differential causes the main valve 938 to slide proximally, opening off of its seat 936. With the main valve 938 open, the forces acting on the lost-motion piston 964 drive it proximally within the distal chamber 922, evacuating fluid into the middle chamber 920, through the opening 948, and into the main accumulator 954. It will thus be appreciated that the size of the orifice 940 in the main valve 938 is critical to operation of the actuation system 900. The orifice 940 must be small enough so that, when the system 900 is actuated, the main valve 938 opens instead of pressure just flowing through the orifice 940. At the same time, the orifice 940 must be big enough to allow pressure across the valve 938 to balance quickly as described above. In an exemplary embodiment, the orifice has a diameter of about 1 mm.

As the lost-motion piston 964 moves proximally within the distal chamber 922, the bearing element 836 is partially ejected from the cam 202 and rocker 204 interface. The portion of the bearing element 836 positioned between the cam 202 and rocker 204 when it is partially ejected is thinner than the portion that is so-positioned when the bearing element 836 is fully inserted. As a result, the rocker 204 begins to rotate clockwise to close the engine valve 206. This is illustrated schematically in FIG. 2C.

As the engine valve 206 approaches its seat 216 with the peak dwell portion of the cam 202 active, the seating control protrusion 968 on the valve catch plunger 988 begins to enter the seating control opening 962 formed in the dividing wall 912, throttling the flow of fluid out of the distal chamber 922. The tapered shape of the seating control protrusion 968, coupled with the cylindrical seating control opening 962 defines a valve catch orifice having an area that decreases progressively as the engine valve 206 gets closer to its seat. The decreasing area causes the pressure in the distal chamber 922 to increase, slowing the engine valve 206.

The valve catch plunger 988 can contact the end stop 970 on the dividing wall 912 when the engine valve 206 is very close to being fully closed. The lost-motion piston 964, however, continues to move proximally until the engine valve 206 is fully closed, causing the pressure within the autolash plenum 908 to increase and fluid to leak out from the autolash plenum 908, around the valve catch plunger 988 and into the distal chamber 922. Eventually, the engine valve 206 completely closes against its seat 216, at which point the seat 216 bears the majority of the valve spring force. This reduces the pressure in the autolash plenum 908 to pre-actuation levels, thereby "resetting" the autolash function of the actuation system 900, such that when the peak dwell portion of the cam 202 is active and the engine valve 206 is shut, the valve catch plunger 988 is in contact with the end stop 970.

When the orifice area between the seating control protrusion 968 and the seating control opening 962 approaches zero, a squeeze film contact effect helps to seat the engine valve 206 at the required low velocity.

During the seating control operation, a significant portion of the engine valve's kinetic energy is dissipated in the fluid in the distal chamber 922 as thermal energy. To prevent overheating, the main accumulator 954, or optionally the trigger accumulator 932, includes a leakage path to allow some of this heated fluid to escape. The heated fluid is then replaced with cooler fluid fed from the fluid source 958 through the check valve 956, as described below. This bleed cooling process repeats with each actuation of the system 900.

The cam 202 eventually rotates to a point where the end of the actuating portion 226 reaches the bearing element 836 and the bearing element 836 is in contact with a closing/refill ramp 232 of the cam 202 and/or the base circle 218 of the cam 202 while the engine valve 206 is closed (e.g., as shown schematically in FIG. 2A). At this time, the accumulator springs of the main accumulator 954 and the trigger accumulator 932 force fluid back into the proximal chamber 916 and the middle chamber 920 of the actuation system 900. Any fluid that was lost during the previous cycle is replenished by fluid flowing from the fluid source 958 through the check valve 956. The fluid entering the middle chamber 920 opens the refill check valves 960 and flows into the distal chamber 922, displacing the lost-motion piston 964 distally and returning the bearing element 836 to the fully-inserted position between the cam 202 and rocker 204. The valve catch plunger 988 moves generally with the lost-motion piston 964, and the leakage filling of the autolash plenum 908 resumes. Meanwhile, the pressure in the distal chamber 922 drops enough to allow the main valve 938 to close, under the pressure of the trigger accumulator 932 and the bias spring 944. When sufficient time has passed to allow the distal chamber 922 to refill, the high-speed trigger valve 930 is closed, locking the main valve 938 in the closed position and readying the actuation system 900 for the next engine valve 206 opening event. Preferably, the main accumulator 954 and the trigger accumulator 932 are sized such that they are never completely filled or emptied (i.e., such that their accumulator springs are never "bottomed-out").

In the actuation system 900, the volume of the autolash plenum 908 between the valve catch plunger 988 and the lost-motion piston 964 is cyclically increased (by the autolash spring 990 when the plunger 988 is not in contact with the sleeve 906) and cyclically decreased (by the sleeve 906 when the plunger 988 is in contact therewith).

When the system 900 is in equilibrium, the opposed actions of increasing and decreasing this volume cancel each other during each cycle of actuation of the valve 206 (one engine revolution). The occurrence of a transient (e.g., initial assembly, thermal expansion, or wear) upsets this balance causing a progressive change of position of the valve catch plunger 988 until a new equilibrium condition is reached, because one of the two opposing actions is larger than the other. For example, if thermal expansion causes the lost-motion piston 964 to be further from the sleeve 906, the valve catch plunger 988 might not come into contact with the sleeve 906 at all, therefore cancelling the action of reducing the volume. In this case, however, the autolash spring 990 is free to increase the volume within the autolash plenum 908 and move the valve catch plunger 988 and the lost-motion piston 964 further apart.

Eventually, this will cause the valve catch plunger 988 to start touching the sleeve 906 again, re-establishing the balance.

In the opposite situation of a thermal contraction, the valve catch plunger 988 would start contacting the sleeve 906 earlier as the engine valve 206 closes, therefore causing a larger volume contraction than the opposing leakage flow driven by the autolash spring 990 and therefore bringing the valve catch plunger 988 and the lost-motion piston 964 closer together. This will retard the contact of the valve catch plunger 988 with the sleeve 906, thereby re-establishing the balance.

The actuation system 900 provides a number of distinct advantages. For example, in the actuation system 900, the stationary nature of the sleeve 906 allows the trigger valve 930 to be coupled in very close proximity to the proximal end of the main valve 938, advantageously reducing the volume above the main valve 338.

Another advantage of the actuation system 900 is that the autolash function ensures that the seating control begins at the appropriate time, regardless of thermal expansion and contraction and wear of the valve train 200 components. This prevents the seating control function from starting too early or too late relative to the engine valve 206 approaching its valve seat 216.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An actuation system, comprising:

a housing having a bore formed therein;

an autolash piston slidably disposed within the bore in the housing, the autolash piston including a proximal chamber, a middle chamber, and a distal chamber;

a main valve slidably disposed within the autolash piston, the main valve having a closed configuration in which the main valve substantially prevents fluid flow between the distal chamber and the middle chamber, and an open configuration in which the distal chamber is in fluid communication with the middle chamber and a main accumulator;

a trigger valve configured to selectively place the proximal chamber in fluid communication with a trigger accumulator;

a lost-motion piston slidably disposed within the distal chamber, the lost-motion piston being coupled to a component of a valve train;

wherein when the trigger valve is opened, fluid flows out of the proximal chamber through the trigger valve, the main valve moves to the open configuration, fluid flows out of the distal chamber into the main accumulator, and the lost-motion piston moves proximally within the autolash piston, thereby allowing the valve train component to be pushed away from one or more other valve train components to allow an engine valve to close.

2. The actuation system of claim 1, wherein the valve train component is a bearing element coupled to the lost-motion piston by a connecting arm, the one or more other valve train components comprise a cam and a rocker, and the bearing element is positioned between the cam and the rocker.

3. The actuation system of claim 1, wherein the main valve includes a pressure-balancing orifice formed therethrough, the orifice placing the distal chamber in fluid communication with the proximal chamber.

4. The actuation system of claim 1, further comprising a bias spring configured to bias the main valve towards the closed configuration.

5. The actuation system of claim 1, wherein an autolash plenum is defined by a clearance space between the autolash piston and the housing, the autolash plenum being selectively filled with and drained of fluid to adjust a position of the autolash piston relative to the housing to take up lash in the valve train.

6. The actuation system of claim 5, further comprising a first fluid leakage path extending from the autolash plenum to a drain.

7. The actuation system of claim 6, further comprising a second fluid leakage path extending from the proximal chamber to the autolash plenum.

8. The actuation system of claim 7, further comprising a third leakage path extending from the main accumulator to a drain.

9. The actuation system of claim 1, wherein the lost-motion piston includes a seating control protrusion configured to be received within a seating control opening formed in a dividing wall that separates the distal chamber from the middle chamber, such that the seating control opening is progressively occluded by the seating control protrusion as the engine valve approaches an engine valve seat.

10. The actuation system of claim 9, wherein the seating control protrusion has a substantially cylindrical distal portion and a tapered proximal portion.

11. The actuation system of claim 1, further comprising at least one refill check valve configured to permit one-way flow of fluid from the middle chamber to the distal chamber when pressure in the middle chamber is greater than pressure in the distal chamber.

12. The actuation system of claim 1, wherein the lost-motion piston includes a lubrication aperture that supplies fluid from the distal chamber to an interface between the lost-motion piston and the valve train component.

13. The actuation system of claim 1, further comprising a check valve configured to permit one-way flow of fluid from a fluid source to the main accumulator when pressure in the main accumulator is less than pressure in the fluid source.

14. The actuation system of claim 1, wherein the engine valve is an outwardly-opening crossover valve of a split-cycle engine.

15. An actuation system, comprising:

an autolash piston configured to slide within a housing to take up lash in a valve train to which the actuation system is coupled;

a main valve disposed within the autolash piston and having a first position in which fluid is prevented from escaping from a lost-motion chamber formed in the autolash piston and a second position in which fluid is permitted to escape from the lost-motion chamber;

a lost-motion piston that slides within the lost-motion chamber when the main valve moves from the first position to the second position, thereby allowing an engine valve to close;

wherein the lost-motion piston progressively occludes a fluid path through which fluid escapes the lost-motion chamber when the main valve is in the second position.

16. The actuation system of claim 15, further comprising a trigger valve that, when opened, allows the main valve to move from the first position to the second position.

17. The actuation system of claim 16, wherein a flow area through the main valve is approximately five times greater than a flow area through the trigger valve.

18. A method of operating an engine that includes an engine valve actuated by a valve train, the method comprising:

adjusting a position of an autolash piston relative to a housing in which the autolash piston is disposed to take up lash in the valve train, the autolash piston having a main valve chamber and a lost-motion chamber formed therein;

opening a main valve disposed within the main valve chamber to permit fluid to escape from the lost-motion chamber, thereby allowing a lost-motion piston to slide within the lost-motion chamber to allow the engine valve to close; and progressively occluding a fluid path through which fluid escapes the lost-motion chamber with a portion of the lost-motion piston to control a seating velocity of the engine valve.

19. The method of claim 18, wherein opening the main valve comprises opening a trigger valve to allow fluid to escape from the main valve chamber.

20. A lost-motion variable valve actuation system, comprising:

a bearing element;

an actuation system configured to selectively permit the bearing element to be at least partially ejected from between first and second valve train components to allow an engine valve to close;

wherein the bearing element is coupled to a lost-motion piston disposed within the actuation system by a connecting arm.

21. The system of claim 20, wherein the connecting arm is pivotally coupled to the lost-motion piston.

22. The system of claim 20, wherein the connecting arm has a cylindrical proximal end that is seated within a corresponding cylindrical recess formed in a distal end of the lost-motion piston.

23. The system of claim 20, further comprising a meniscus having a planar proximal surface and a spherical distal surface, the meniscus being disposed between a planar distal surface of the lost-motion piston and a spherical recess formed in a proximal surface of the connecting arm.

24. The system of claim 23, wherein the lost-motion piston includes a lubrication aperture through which fluid can be communicated to proximal and distal fluid cavities formed in the meniscus.

25. The system of claim 24, wherein the proximal fluid cavity comprises a set of interconnected concentric grooves formed in the proximal surface of the meniscus and the distal fluid cavity comprises first and second linear intersecting grooves formed in the distal surface of the meniscus.

26. The system of claim 20, wherein the connecting arm has a cylindrical proximal end that bears against a planar distal surface of the lost-motion piston.

27. The system of claim 20, wherein the first valve train component is a cam and the second valve train component is a rocker.

28. The system of claim 20, wherein the first valve train component is an upper portion of a rocker pedestal and the second valve train component is a lower portion of the rocker pedestal.

29. The system of claim 20, wherein the first valve train component is a cam and the second valve train component is an engine valve stem.

30. The system of claim 20, wherein the engine valve is an outwardly-opening crossover valve of a split-cycle engine.

31. The system of claim 20, wherein the bearing element comprises a major portion and a pad, the pad being slidably disposed in a pocket formed in the major portion.

32. The system of claim 31, wherein the pocket includes a convex pad-facing surface and the pad includes a concave pocket-facing surface, the convex pad-facing surface having a widthwise radius of curvature that is less than a widthwise radius of curvature of the concave pocket-facing surface.

33. The system of claim 31, wherein the pocket includes a concave pad-facing surface and the pad includes a convex pocket-facing surface, the concave pad-facing surface having a widthwise radius of curvature that is greater than a widthwise radius of curvature of the convex pocket-facing surface.

34. The system of claim 31, wherein the major portion has a bearing surface formed thereon that engages the first valve train component and the pad has a bearing surface formed thereon that engages the second valve train component.

35. The system of claim 31, wherein the connecting arm has a mating portion at its proximal end, the mating portion comprising a major portion that is a section of a sphere and a minor portion that is a section of a cylinder, the minor portion bearing against a planar distal surface of the lost-motion piston.

36. The system of claim 31, wherein the pocket is defined by proximal and distal stops, the proximal and distal stops each having a rib projecting therefrom on which proximal and distal tabs extending from the pad are slidably disposed.

37. A valve train comprising:

a cam having a cam surface;

a rocker having a rocker pad surface;

a bearing element having a cam-facing surface that slidably engages the cam surface and a rocker-facing surface that slidably engages the rocker pad surface;

an actuation system configured to selectively permit the bearing element to be at least partially ejected from between the cam and the rocker;

wherein:

the cam surface has a substantially infinite widthwise radius of curvature;

the cam-facing surface has a finite lengthwise radius of curvature and a substantially infinite widthwise radius of curvature;

the rocker-facing surface has a finite lengthwise radius of curvature and a finite widthwise radius of curvature; and the rocker pad surface has a finite lengthwise radius of curvature and a finite widthwise radius of curvature.

38. The valve train of claim 37, wherein the lengthwise radius of curvature of the cam-facing surface is less than the lengthwise radius of curvature of the rocker-facing surface.

39. The valve train of claim 37, wherein the widthwise radius of curvature of the rocker-facing surface is substantially the same as the widthwise radius of curvature of the rocker pad surface.

40. The valve train of claim 37, wherein the widthwise radius of curvature of the rocker-facing surface is greater than the lengthwise radius of curvature of the rocker-facing surface.

41. The valve train of claim 37, wherein:

the lengthwise radius of curvature of the cam-facing surface is about 17 mm;

the lengthwise radius of curvature of the rocker-facing surface is about 50 mm;

the widthwise radius of curvature of the rocker-facing surface is about 1 meter;

the lengthwise radius of curvature of the rocker pad surface is about 35 mm; and the widthwise radius of curvature of the rocker pad surface is about 1 meter.

* * * * *